United States Patent [19]

Maskasky

[11] Patent Number: 4,724,200

[45] Date of Patent: Feb. 9, 1988

[54] EMULSIONS AND PHOTOGRAPHIC ELEMENTS CONTAINING SILVER HALIDE GRAINS HAVING ICOSITETRAHEDRAL CRYSTAL FACES

[75] Inventor: Joe E. Maskasky, Rochester, N.Y.

[73] Assignee: Eastman Kodak Company, Rochester, N.Y.

[21] Appl. No.: 882,113

[22] Filed: Jul. 3, 1986

Related U.S. Application Data

[63] Continuation-in-part of Ser. No. 772,230, Sep. 3, 1985, abandoned.

[51] Int. Cl.[4] ..... G03C 1/02

[52] U.S. Cl. ..... 430/567; 423/489; 423/491

[58] Field of Search ..... 430/567; 423/489, 491

[56] References Cited

U.S. PATENT DOCUMENTS

| | | | |
|---|---|---|---|
| 3,885,970 | 5/1975 | Miyahara | 430/567 |
| 4,183,756 | 1/1980 | Locker | 430/569 |
| 4,225,666 | 9/1980 | Locker et al. | 430/569 |
| 4,463,087 | 7/1984 | Maskasky | 430/567 |

FOREIGN PATENT DOCUMENTS

| | | | |
|---|---|---|---|
| 0048521 | 4/1979 | Japan | 423/491 |
| 2038972 | 7/1980 | United Kingdom | 423/491 |
| 0709540 | 1/1980 | U.S.S.R. | 423/491 |
| 0823271 | 4/1981 | U.S.S.R. | 423/491 |

OTHER PUBLICATIONS

James, *The Theory of the Photographic Process*, 4th Ed., Macmillan, New York, 1977, pp. 98 through 100.

Berry, "Surface Structure and Reactivity of AgBr Dodecahedra", *Photographic Science and Engineering*, vol. 19, No. 3, May/Jun. 1975, pp. 171 and 172.

Klein et al, "Formation of Twins of AgBr and AgCl Crystals in Photographic Emulsions", *Photographische Korrespondenz*, vol. 99, No. 7, pp. 99–102 (1963).

A. P. H. Trivelli and S. E. Sheppard, *The Silver Bromide Grain of Photographic Emulsions*, Van Nostrand, Chapters VI and VIII, 1921.

W. Reinders, "Studies of Photohalide Crystals", *Kolloid-Zeitschrift*, vol. 9, pp. 10–14 (1911).

W. Reinders, "Study of Photohalides III Absorption of Dyes, Proteins and Other Organic Compounds in Crystalline Silver Chloride", *Zeitschrift fur Physikalische Chemie*, vol. 77, pp. 677–699 (1911).

Hirata et al, "Crystal Habit of Photographic Emulsion Grains", *J. Photog. Soc. of Japan*, vol. 36, pp. 359–363 (1973).

Journal of Crystal Growth 10 (1971), 144–150.

P. Junod et al, "Growth and Characterization of AgBr Single Crystals.

*Primary Examiner*—John E. Kittle
*Assistant Examiner*—Mukund J. Shah
*Attorney, Agent, or Firm*—Carl O. Thomas

[57] ABSTRACT

Silver halide photographic emulsions are disclosed comprised of radiation sensitive silver halide grains of a cubic crystal lattice structure comprised of icositetrahedral crystal faces.

11 Claims, 40 Drawing Figures

.5 μm

1μm

1 μm

1μm

1 μm

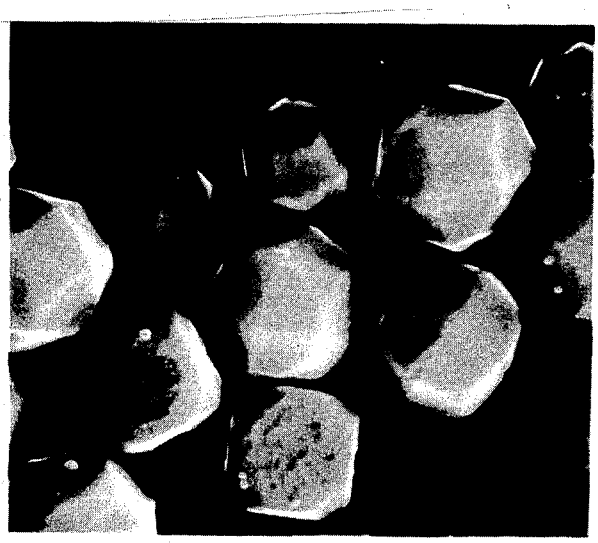
FIG 19a 2μm
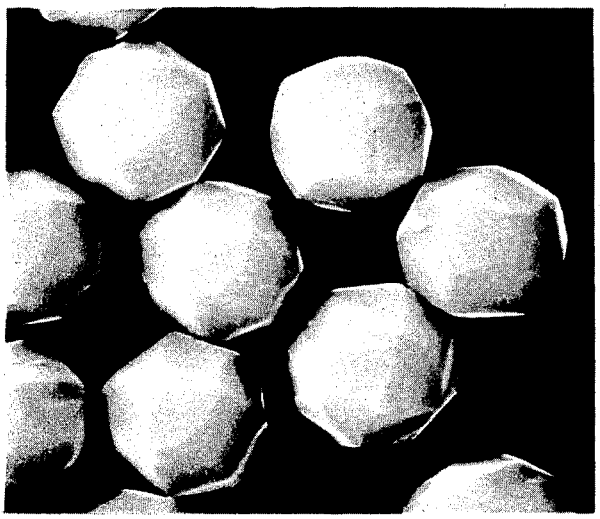
FIG 19b 2μm

1 μm

1 μm

1 μm

1 μm

1μm

1μm

1 μm

1μm

2 μm

1 μm

1μm

1μm

1 μm

1 μm

1 μm

1 μm

1 μm

EMULSIONS AND PHOTOGRAPHIC ELEMENTS CONTAINING SILVER HALIDE GRAINS HAVING ICOSITETRAHEDRAL CRYSTAL FACES

FIELD OF THE INVENTION

This invention relates to photography. More specifically, this invention is directed to photographic emulsions containing silver halide grains and to photographic elements containing these emulsions.

BACKGROUND OF THE INVENTION

Silver halide photography has been practiced for more than a century. The radiation sensitive silver halide compositions initially employed for imaging were termed emulsions, since it was not originally appreciated that a solid phase was present. The term "photographic emulsion" has remained in use, although it has long been known that the radiation sensitive component is present in the form of dispersed microcrystals, typically referred to as grains.

Over the years silver halide grains have been the subject of intense investigation. Although high iodide silver halide grains, those containing at least 90 mole percent iodide, based on silver, are known and have been suggested for photographic applications, in practice photographic emulsions almost always contain silver halide grains comprised of bromide, chloride, or mixtures of chloride and bromide optionally containing minor amounts of iodide. Up to about 40 mole percent iodide, based on silver, can be accommodated in a silver bromide crystal structure without observation of a separate silver iodide phase. However, in practice silver halide emulsions rarely contain more than about 15 mole percent iodide, with iodide well below 10 mole percent being most common.

All silver halide grains, except high iodide silver halide grains, exhibit cubic crystal lattice structures. However, grains of cubic crystal lattice structures can differ markedly in appearance.

In one form silver halide grains when microscopically observed are cubic in appearance. A cubic grain 1 is shown in FIG. 1. The cubic grain is bounded by six identical crystal faces. In the photographic literature these crystal faces are usually referred to as {100} crystal faces, referring to the Miller index employed for designating crystal faces. While the {100} crystal face designation is most commonly employed in connection with silver halide grains, these same crystal faces are sometimes also referred to as {200} crystal faces, the difference in designation resulting from a difference in the definition of the basic unit of the crystal structure. Although the cubic crystal shape is readily visually identified in regular grains, in irregular grains cubic crystal faces are not always square. In grains of more complex shapes the presence of cubic crystal faces can be verified by a combination of visual inspection and the 90° angle of intersection formed by adjacent cubic crystal faces.

The practical importance of the {100} crystal faces is that they present a unique surface arrangement of silver and halide ions, which in turn influences the grain surface reactions and adsorptions typically encountered in photographic applications. This unique surface arrangement of ions as theoretically hypothesized is schematically illustrated by FIG. 2, wherein the smaller spheres 2 represent silver ions while the larger spheres 3 designate bromine ions. Although on an enlarged scale, the relative size and position of the silver and bromide ions is accurately represented. When chloride ions are substituted for bromide ions, the relative arrangement would remain the same, although the chloride ions are smaller than the bromide ions. It can be seen that a plurality of parallel rows, indicated by lines 4, as present, each formed by alternating silver and bromine ions. In FIG. 2 a portion of the next tier of ions lying below the surface tier is shown to illustrate their relationship to the surface tier of ions.

In another form silver halide grains when microscopically observed are octahedral in appearance. An octahedral grain 5 is shown in FIG. 3. The octahedral grain is bounded by eight identical crystal faces. These crystal faces are referred to as {111} crystal faces. Although the octahedral crystal shape is readily visually identified in regular grains, in irregular grains octahedral crystal faces are not always triangular. In grains of more complex shapes the presence of octahedral crystal faces can be verified by a combination of visual inspection and the 109.5° angle of intersection formed by adjacent octahedral crystal faces.

Ignoring possible ion adsorptions, octahedral crystal faces differ from cubic crystal faces in that the surface tier of ions can be theoretically hypothesized to consist entirely of silver ions or halide ions. FIG. 4 is a schematic illustration of a {111} crystal face, analogous to FIG. 2, wherein the smaller spheres 2 represent silver ions while the larger spheres 3 designate bromine ions. Although silver ions are shown at the surface in every available lattice position, it has been suggested that having silver ions in only every other available lattice position in the surface tier of atoms would be more compatible with surface charge neutrality. Instead of a surface tier of silver ions, the surface tier of ions could alternatively be bromide ions. The tier of ions immediately below the surface silver ions consists of bromide ions.

In comparing FIGS. 1 and 2 with FIGS. 3 and 4 it is important to bear in mind that both the cubic and octahedral grains have exactly the same cubic crystal lattice structure and thus exactly the same internal relationship of silver and halide ions. The two grains differ only in their surface crystal faces. Note that in the cubic crystal face of FIG. 2 each surface silver ion lies immediately adjacent five halide ions, whereas in FIG. 4 the silver ions at the octahedral crystal faces each lie immediately adjacent only three halide ions.

Much less common than either cubic or octrahedral silver halide grains are rhombic dodecahedral silver halide grains. A rhombic dodecahedral grain 7 is shown in FIG. 5. The rhombic dodecahedral grain is bounded by twelve identical crystal faces. These crystal faces are referred to as {110} (or, less commonly in reference to silver halide grains, {220}) crystal faces. Although the rhombic dodecahedral crystal shape is readily visually identified in regular grains, in irregular grains rhombic dodecahedral crystal faces can vary in shape. In grains of more complex shapes the presence of rhombic dodecahedral crystal faces can be verified by a combination of visual inspection and measurement of the angle of intersection formed by adjacent crystal faces.

Rhombic dodecahedral crystal faces can be theoretically hypothesized to consist of alternate rows of silver ions and halide ions. FIG. 6 is a schematic illustration analogous to FIGS. 2 and 4, wherein it can be seen that the surface tier of ions is formed by repeating pairs of silver and bromide ion parallel rows, indicated by lines 8a and 8b, respectively. In FIG. 6 a portion of the next tier of ions lying below the surface tier is shown to illustrate their relationship to the surface tier of ions. Note that each surface silver ion lies immediately adjacent four halide ions.

Although photographic silver halide emulsions containing cubic crystal lattice structure grains are known which contain only regular cubic grains, such as the grain shown in FIG. 1, regular octahedral grains, such as the grain shown in FIG. 3, or, in rare instances, regular rhombic dodecahedral grains, such as the grain shown in FIG. 5, in practice many other varied grain shapes are also observed. For example, silver halide grains can be cubo-octahedral-that is, formed of a combination of cubic and octahedral crystal faces. This is illustrated in FIG. 7, wherein cubo-octahedral grains 9 and 10 are shown along with cubic grain 1 and octahedral grain 5. The cubo-octahedral grains have fourteen crystal faces, six cubic crystal faces and eight octahedral crystal faces. Analogous combinations of cubic and/or octahedral crystal faces and rhombic dodecahedral crystal faces are possible, though rarely encountered. Other grain shapes, such as tabular grains and rods, can be attributed to internal crystal irregularities, such as twin planes and screw dislocations. In most instances some corner or edge rounding due to solvent action is observed, and in some instances rounding is so pronounced that the grains are described as spherical.

It is known that for cubic crystal lattice structures crystal faces can take any one of seven possible distinct crystallographic forms. However, for cubic crystal lattice structure silver halides only grains having {100} (cubic), {111} (octahedral), or, rarely, {110} (rhombic dodecahedral) crystal faces, individually or in combination, have been identified.

It is thus apparent that the photographic art has been limited in the crystal faces presented by silver halide grains of cubic crystal lattice structure. As a result the art has been limited to modifying photographic properties to the choice of surface sensitizers and adsorbed addenda that are workable with available crystal faces, in most instances cubic and octahedral crystal faces. This has placed restrictions on the combinations of materials that can be employed for optimum photographic performance or dictated accepting less than optimum performance.

Relevant Art

Silver halide emulsions having faces of the hexoctahedral, tetrahexahedral, or trisoctahedral crystallographic form are separately the subject matter of commonly assigned U.S. Ser. Nos. 771,861, 772,228, and 772,229, filed Sept. 3, 1985, titled SILVER HALIDE PHOTOGRAPHIC EMULSIONS WITH NOVEL GRAIN FACES (1), (2), or (3), respectively.

Silver halide emulsions having ruffled grain faces presenting crystal faces of varied crystallographic forms, including the icositetrahedral form, are the subject of commonly assigned U.S. Ser. No. 772,271, filed Sept. 3, 1985, titled SILVER HALIDE PHOTOGRAPHIC EMULSIONS WITH NOVEL GRAIN FACES (5).

F. C. Phillips, *An Introduction to Crystallography*, 4th Ed., John Wiley & Sons, 1971, is relied upon as authority for the basic precepts and terminology of crystallography herein presented.

James, *The Theory of the Photographic Process*, 4th Ed., Macmillan, New York, 1977, pp. 98 through 100, is corroborative of the background of the invention described above. In addition, James at page 98 in reference to silver halide grains states that high Miller index faces are not found.

Berry, "Surface Structure and Reactivity of AgBr Dodecahedra", *Photographic Science and Engineering*, Vol. 19, No. 3, May/June 1975, pp. 171 and 172, illustrates silver bromide emulsions containing {110} crystal faces.

Klein et al, "Formation of Twins of AgBr and AgCl Crystals in Photographic Emulsions", *Photographische Korrespondenz*, Vol. 99, No. 7, pp. 99–102 (1963) describes a variety of singly and doubly twinned silver halide crystals having {100} (cubic) and {111} (octahedral) crystal faces. Klein et al is of interest in illustrating the variety of shapes which twinned silver halide grains can assume while still exhibiting only {111} or {100} crystal faces.

A. P. H. Trivelli and S. E. Sheppard, *The Silver Bromide Grain of Photographic Emulsions*, Van Nostrand, Chapters VI and VIII, 1921, is cited for historical interest. Magnifications of 2500× and lower temper the value of these observations. Much higher resolutions of grain features are obtainable with modern electron microscopy.

W. Reinders, "Studies of Photohalide Crystals", *Kolloid-Zeitschrift*, Vol. 9, pp. 10–14 (1911); W. Reinders, "Study of Photohalides III Absorption of Dyes, Proteins and Other Organic Compounds in Crystalline Silver Chloride", *Zeitschrift fur Physikalische Chemie*, Vol. 77, pp. 677–699 (1911); Hirata et al, "Crystal Habit of Photographic Emulsion Grains", *J. Photog. Soc. of Japan*, Vol. 36, pp. 359–363 (1973); Locker U.S. Pat. No. 4,183,756; and Locker et al U.S. Pat. No. 4,225,666 illustrate teachings of modifying silver halide grain shapes through the presence of various materials present during silver halide grain formation.

SUMMARY OF THE INVENTION

In one aspect this invention is directed to a silver halide photographic emulsion comprised of radiation sensitive silver halide grains of a cubic crystal lattice structure comprised of icositetrahedral crystal faces.

In another aspect this invention is directed to a photographic element containing at least one emulsion of the type previously described.

The invention presents to the art for the first time the opportunity to realize the unique surface configuration of icositetrahedral crystal faces in photographic silver halide emulsions. The invention thereby renders accessible for the first time a new choice of crystal faces for modifying photographic characteristics and improving interactions with sensitizers and adsorbed photographic addenda.

BRIEF DESCRIPTION OF THE DRAWINGS

FIGS. 12 through 27 and 31B are electron micrographs of icositetrahedral silver halide grains;

DESCRIPTION OF PREFERRED EMBODIMENTS

The present invention relates to silver halide photographic emulsions comprised of radiation sensitive silver halide grains of a cubic crystal lattice structure comprised of icositetrahedral crystal faces and to photographic elements containing these emulsions.

Figure 8:
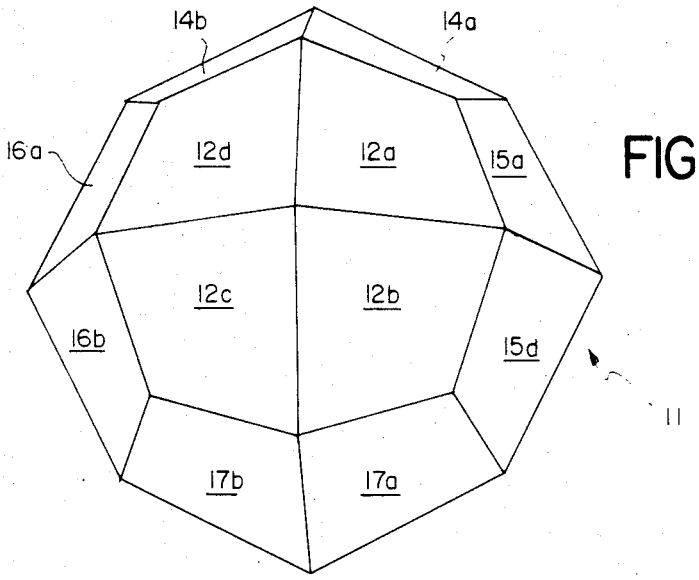
FIGS. 8 and 9 are front and rear isometric views of a regular {211} icositetrahedron.
Figure 9:
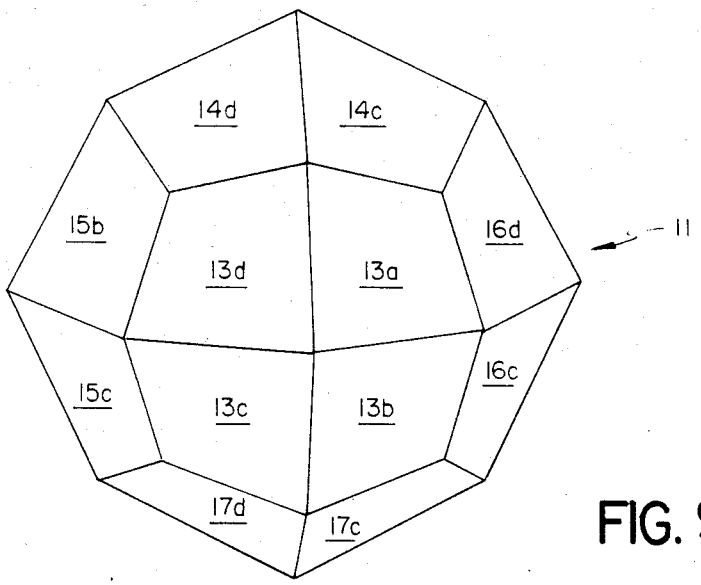

In one form the silver halide grains can take the form of regular icositetrahedra. A regular icositetrahedron 11 is shown in FIGS. 8 and 9, which are front and back views of the same regular icositetrahedron. An icositetrahedron has twenty-four identical faces. Although any grouping of faces is entirely arbitrary, the icositetrahedron can be visualized as six separate clusters of crystal faces, each cluster containing four separate faces. In FIG. 8 faces 12*a*, 12*b*, 12*c*, and 12*d* can be visualized as members of a first cluster of faces. In FIG. 9 faces 13*a*, 13*b*, 13*c*, and 13*d* can be visuallized as members of a second cluster of faces. The remaining four clusters of faces each have two faces visible in FIG. 8 and two faces visible in FIG. 9. Faces 14*a* and 14*b*, shown in FIG. 8, and faces 14*c* and 14*d*, shown in FIG. 9, represent the four faces of a third cluster of four faces. Similarly, faces 15*a* and 15*b*, shown in FIG. 8, and faces 15*c* and 15*d*, shown in FIG. 9, represent the four faces of a fourth cluster of four faces. Faces 16*a* and 16*b*, shown in FIG. 8, and faces 16*c* and 16*d*, shown in FIG. 9, represent the four faces of a fifth cluster of four faces while 16*a*, 16*b*, and 16*c*, shown in FIG. 8, and face 16*d*, shown in FIG. 9, complete a fifth cluster of faces while faces 17*a* and 17*b*, shown in FIG. 8, and faces 17*c* and 17*d*, shown in FIG. 9, represent the four faces of a sixth cluster of four faces.

Looking at the icositetrahedron it can be seen that there are four intersections of adjacent faces within each cluter, and there are two face intersections of each cluster with each of the four clusters adjacent to it for a total of forty-eight face edge intersections. The relative angles formed by intersecting faces have only two different values All intersections of a face from one cluster with a face from another cluster are identical, forming a first relative angle. Looking at FIG. 8, the relative angle of adjacent faces 12*a* and 14*a*, 12*a* and 15*a*, 12*b* and 15*d*, 12*b* and 17*a*, 12*c* and 16*b*, 12*c* and 17*b*, 12*d* and 16*a*, and 12*d* and 14*b* are all at the identical first relative angle. All adjacent faces within each cluster intersect at the same relative angle, which is different from the relative angle of intersection of faces in different clusters. Looking at one cluster in which all faces are fully visible, the intersections between faces 12*a* and 12*b*, 12*b* and 12*c*, 12*c* and 12*d*, and 12*d* and 12*a* are all at the same relative angle, referred to as a second relative angle. While the regular icositetrahedron has a distinctive appearance that can be recognized by visual inspection, it should be appreciated that measurement of any one of the two relative angles provides a corroboration of adjacent hexoctahedral crystal faces.

In crystallography measurement of relative angles of adjacent crysttal faces is employed for positive crystal face identification. Such techniques are described, for example, by Phillips, cited above. These techniques can be combined with techniques for the microscopic examination of silver halide grains to identify positively the icositetrahedral crystal faces of silver halide grains. Techniques for preparing electron micrographs of silver halide grains are generally well known in the art, as illustrated by B. M. Spinell and C. F. Oster, "Photographic Materials", *The Encyclopedia of Microscopy and Microtechnique*, P. Gray, ed., Van Nostrand, N.Y., 1973, pp. 427–434, note particularly the section dealing with carbon replica electron microscopy on pages 429 and 430. Employing techniques well known in electron microscopy, carbon replicas of silver halide grains are first prepared. The carbon replicas reproduce the grain shape while avoiding shape altering silver print-out that is known to result from employing the silver halide grains without carbon shells. An electron scanning beam rather than light is employed for imaging to permit higher ranges of magnification to be realized than when light is employed. When the grains are sufficiently spread apart that adjacent grains are not impinging, the grains lie flat on one crystal face rather than on a coign (i.e., a point). By tilting the sample being viewed relative to the electron beam a selected grain can be oriented so that the line of sight is substantially parallel to both the line of intersection of two adjacent crystal faces, seen as a point, and each of the two intersecting crystal faces, seen as edges. When the grain faces are parallel to the imaging electron beam, the two corresponding edges of the grain which they define will appear sharper than when the faces are merely close to being parallel. Once the desired grain orientation with two intersecting crystal faces presenting a parallel edge to the electron beam is obtained, the angle of intersection can be measured from an electron micrograph of the oriented grain. In this way adjacent icositetrahedral crystal faces can be identified. Relative angles of icositetrahedral and adjacent crystal faces of other Miller indices can also be determined in the same way. Again, the unique relative angle allows a positive identification of the crystal faces. While relative angle measurements can be definitive, in many, if not most, instances visual inspection of grains by electron microscopy allows immediate identification of icositetrahedral crystal faces.

Referring to the mutually perpendicular x, y, and z axes of a cubic crystal lattice, it is well recognized in the art that cubic crystal faces are parallel to two of the axes and intersect the third, thus the {100} Miller index assignment; octahedral crystal faces intersect each of the three axes at an equal interval, thus the {111} Miller index assignment; and rhombic dodecahedral crystal faces intersect two of the three axes at an equal interval and are parallel to the third axis, thus the {110} Miller index assignment. For a given definition of the basic crystal unit, there is one and only one Miller index assignment for each of cubic, octahedral, and rhombic dodecahedral crystal faces.

Icositetrahedral crystal faces include a family of crystal faces that can have differing Miller index values. Icositetrahedral crystal faces are generically designated as {hll} crystal faces, wherein h and l are different integers each greater than zero and h is greater than l. The regular icositetrahedron 11 shown in FIGS. 8 and 9 consists of {211} crystal faces, which corresponds to the lowest value that h and l can each represent. A regular icositetrahedron having {311}, {322}, {411}, {433}, {511}, {522}, {533}, or {544} crystal faces would appear similar to the icositetrahedron 11, but the higher Miller indices would result in changes in the angles of intersection. Although there is no theoretical limit on the maximum values of the integers h and l, icositetrahedral crystal faces having a value of h of 5 or less are more easily generated. For this reason, silver halide grains having icositetrahedral crystal faces of the exemplary Miller index values identified above are preferred. With practice one icositetrahedral crystal face can often be distinguished visually from another of a different Miller index value. Measurement of relative angles permits positive corroboration of the specific Miller index value icositetrahedral crystal faces present.

In one form the emulsions of this invention contain silver halide grains which are bounded entirely by icositetrahedral crystal faces, thereby forming basically regular icositetrahedra. In practice although some edge rounding of the grains is usually present, the unrounded residual flat icositetrahedral faces permit positive identification, since a sharp intersecting edge is unnecessary to establishing the relative angle of adjacent icositetrahedral crystal faces. Sighting to orient the grains is still possible employing the residual flat crystal face portions.

The radiation sensitive silver halide grains present in the emulsions of this invention are not confined to those in which the icositetrahedral crystal faces are the only flat crystal faces present. Just as cubo-octahedral silver halide grains, such as 9 and 10, exhibit both cubic and octahedral crystal faces and Berry, cited above, reports grains having cubic octahedral, and rhombic dodecahedral crystal faces in a single grain, the radiation sensitive grains herein contemplated can be formed by icositetrahedral crystal faces in combination with any one or combination of the other types of crystal faces possible with a silver halide cubic crystal lattice structure. For example, if conventional silver halide grains having cubic, octahedral, and/or rhombic dodecahedral crystal faces are employed as host grains for the preparation of silver halide grains having icositetrahedral crystal faces, stopping silver halide deposition onto the host grains before the original crystal faces have been entirely overgrown by silver halide under conditions favoring icositetrahedral crystal face formation results in both icositetrahedral crystal faces and residual crystal faces corresponding to those of the original host grain being present.

In another variant form deposition of silver halide onto host grains under conditions which favor icositetrahedral crystal faces can initially result in ruffling of the grain surfaces. Under close examination it has been observed that the ruffles are provided by protrusions from the host grain surface. Protrusions in the form of ridges have been observed, but protrusions, when present, are more typically in the form of pyramids. Pyramids presenting icositetrahedral crystal faces on host grains initially presenting {100} crystal faces have four surface faces. These correspond to the four faces of any one of the 12, 13, 14, 15, 16, or 17 series clusters described above in connection with the icositetrahedron 11. When the host grains initially present {111} crystal faces, pyramids bounded by three surface faces are formed. Turning to FIG. 8, the apex of the pyramid corresponds to the coign formed faces **12*b*, 15*d*, and 17*a***. The protrusions, whether in the form of ridges or pyramids, can within a short time of initiating precipitation onto the host grains substantially cover the original host grain surface. If silver halide deposition is continued after the entire grain surface is bounded by icositetrahedral crystal faces, the protrusions become progressively larger and eventually the grains lose their ruffled appearance as they present larger and larger icositetrahedral crystal faces. It is possible to grow a regular icositetrahedron from a ruffled grain by continuing silver halide deposition. Silver halide grains which have had their surface to volume ratios increased by ruffling are the specific subject matter of commonly assigned Ser. No. 772,271, titled SILVER HALIDE PHOTOGRAPHIC EMULSIONS WITH NOVEL GRAIN FACES (5), cited above.

Even when the grains are not ruffled and bounded entirely by icositetrahedral crystal faces, the grains can take overall shapes differing from regular icositetrahedrons. This can result, for example, from irregularities, such as twin planes, present in the host grains prior to growth of the icositetrahedral crystal faces or introduced during growth of the icositetrahedral crystal faces.

Figure 1:
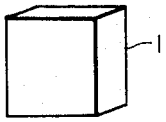
FIG. 1 is an isometric view of a regular cubic silver halide grain.
Figure 3:
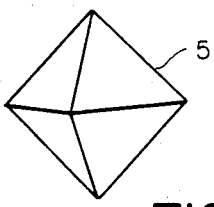
FIG. 3 is an isometric view of a regular octahedral silver halide grain.
Figure 2:
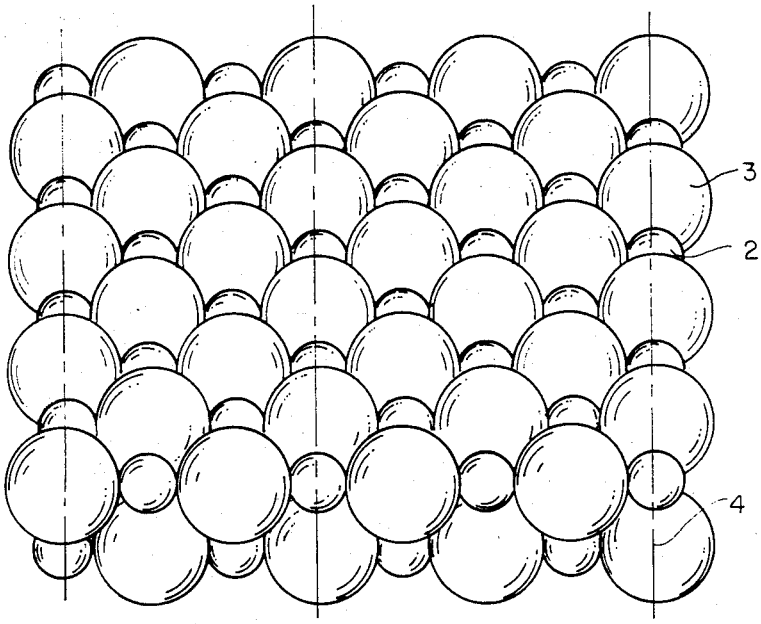
FIG. 2 is a schematic diagram of the atomic arrangement at a silver bromide cubic crystal surface.
Figure 4:
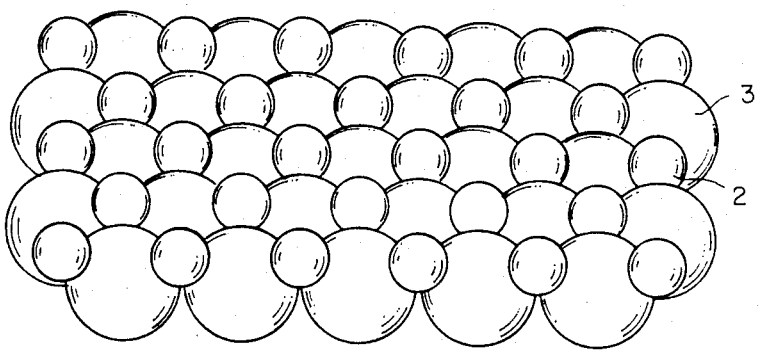
FIG. 4 is a schematic diagram of the atomic arrangement at a silver bromide octahedral crystal surface.
Figure 5:
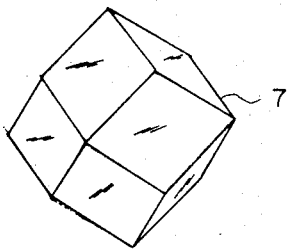
FIG. 5 is an isometric view of a regular rhombic dodecahedron.
Figure 6:
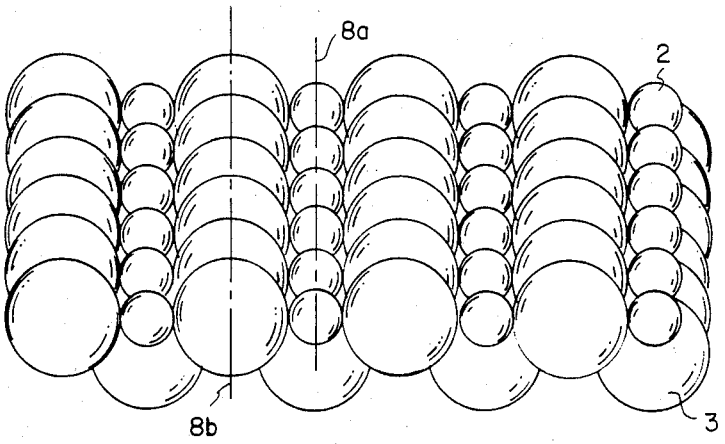
FIG. 6 is a schematic diagram of the atomic arrangement at a silver bromide rhombic dodecahedral crystal surface.
Figure 10:
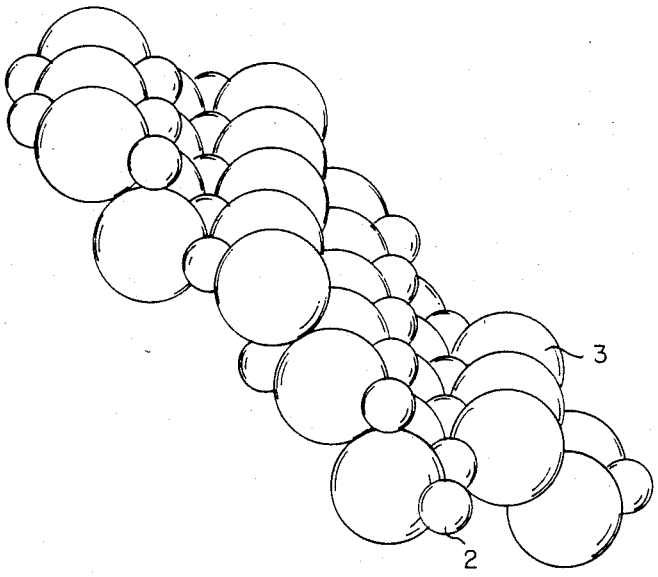
FIGS. 10 and 11 are schematic diagrams of theorized atomic arrangements at silver bromide icositetrahedral crystal surfaces of Miller indices of {211} and {533}, respectively.
Figure 11:
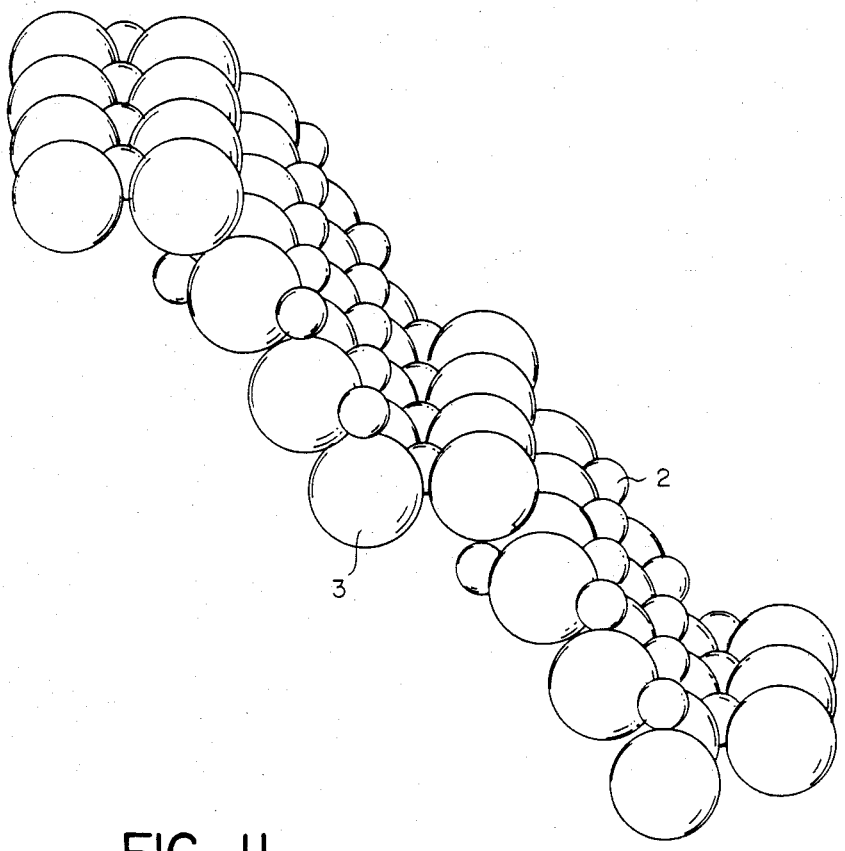

The important feature to note is that if any crystal face of a silver halide grain is an icositetrahedral crystal face, the resulting grain presents a unique arrangement of surface silver and halide ions that differs from that presented by all other possible crystal faces for cubic crystal lattice structure silver halides. This unique surface arrangement of ions as theoretically hypothesized is schematically illustrated by FIG. 10, wherein a {211} icositetrahedral crystal face is shown formed by silver ions 2 and bromide ions 3. Comparing FIG. 10 with FIGS. 2, 4, and 6, it is apparent that the surface positioning of silver and bromide ions in each figure is distinctive. The {211} is icositetrahedral crystal face presents an ordered, but more varied arrangement of surface silver and bromide ions than is presented at the cubic, octahedral, or rhombic dodecahedral silver bromide crystal faces. This is the result of the tiering that occurs at the {211} icositetrahedral crystal face. Icositetrahedral crystal faces with differing Miller indices also exhibit tiering. The differing Miller indices result in analogous, but nevertheless unique surface arrangements of silver and halide ions. The difference between icositetrahedral crystal faces of differing Miller indices is illustrated by comparing FIG. 10, which is a hypothetical schematic diagram of a {211} crystal face, and FIG. 11, which is a corresponding diagram of a {533} crystal face.

While FIGS. 2, 4, 6, 10, and 11 all contain bromide ions as the sole halide ions, it is appreciated that the same observations as to differences in the crystal faces obtain when each wholly or partially contains chloride ions instead. Although chloride ions are substantially smaller in effective diameter than bromide ions, an icositetrahedral crystal surface presented by silver chloride ions would be similar to the corresponding silver and bromide ion surfaces.

The cubic crystal lattice structure silver halide grains containing icositetrahedral crystal faces can contain minor amounts of iodide ions, similarly as conventional silver halide grains. Iodide ions have an effective diameter substantially larger than that of bromide ions. As is well known in silver halide crystallography, this has a somewhat disruptive effect on the order of the crystal structure, which can be accommodated and actually employed photographically to advantage, provided the iodide ions are limited in concentration. Preferably iodide ion concentrations below 15 mole percent and optimally below 10 mole percent, based on silver, are employed in the practice of this invention. Iodide ion concentrations of up to 40 mole percent, based on silver, can be present in silver bromide crystals. Since iodide ions as the sole halide ions in silver halide do not form a cubic crystal lattice structure, their use alone has no applicability to this invention.

It is appreciated that the larger the proportion of the total silver halide grain surface area accounted for by icositetrahedral crystal faces the more distinctive the silver halide grains become. In most instances the icositetrahedral crystal faces account for at least 50 percent of the total surface area of the silver halide grains. Where the grains are regular, the icositetrahedral crystal faces can account for all of the flat crystal faces observable, the only remaining grain surfaces being attributable to edge rounding. In other words, silver halide grains having icositetrahedral crystal faces accounting for at least 90 percent of the total grain surface area are contemplated.

It is, however, appreciated that distinctive photographic effects may be realized even when the icositetrahedral crystal faces are limited in areal extent. For example, where in an emulsion containing the silver halide grains a photographic addendum is present that shows a marked adsorption preference for an icositetrahedral crystal face, only a limited percentage of the total grain surface may be required to produce a distinctive photographic effect. Generally, if any icositetrahedral crystal face is observable on a silver halide grain, it accounts for a sufficient proportion of the total surface area of the silver halide grain to be capable of influencing photographic performance. Stated another way, by the time an icositetrahedral crystal face becomes large enough to be identified by its relative angle to adjacent crystal faces, it is already large enough to be capable of influencing photographic performance. Thus, the minimum proportion of total grain surface area accounted for by icositetrahedral crystal faces is limited only by the observer's ability to detect the presence of icositetrahedral crystal faces.

Figure 7:
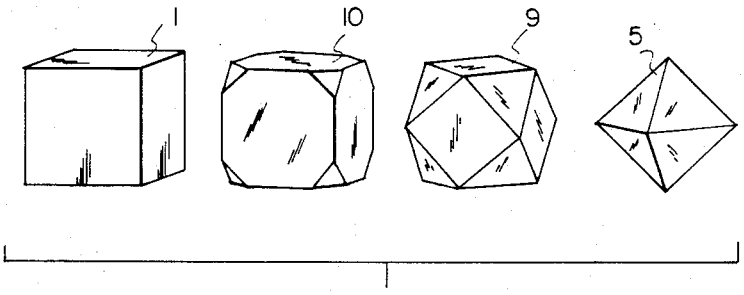
FIG. 7 is an isometric view of a regular cubic silver halide grain, a regular octahedral silver halide grain, and intermediate cubo-octahedral silver halide grains.

The successful formation of icositetrahedral crystal faces on silver halide grains of a cubic crystal lattice structure depends on identifying silver halide grain growth conditions that retard the surface growth rate on icositetrahedral crystal planes. It is generally recognized in silver halide crystallography that the predominant crystal faces of a silver halide grain are determined by choosing grain growth conditions that are least favorable for the growth of that crystal face. For example, regular cubic silver halide grains, such as grain 1, are produced under grain growth conditions that favor more rapid deposition of silver and halide ions on all other available crystal faces than on the cubic crystal faces. Referring to FIG. 7, if an octahedral grain, such as regular octahedral grain 5 is subjected to growth under conditions that least favor deposition of silver and halide ions onto cubic crystal faces, grain 5 during continued silver halide precipitation will progress through the intermediate cubo-octahedral grain forms 9 and 10 before reaching the final cubic grain configuration 1. Once only cubic crystal faces remain, then silver and halide ions deposit isotropically on these surfaces. In other words, the grain shape remains cubic, and the cubic grains merely grow larger as additional silver and halide ions are precipitated.

By analogy, grains having icositetrahedral crystal faces have been prepared by introducing into a silver halide precipitation reaction vessel host grains of conventional crystal faces, such as cubic grains, while maintaining growth conditions to favor retarding silver halide deposition along icositetrahedral crystal faces. As silver halide precipitation continues icositetrahedral crystal faces first become identifiable and then expand in area until eventually, if precipitation is continued, they account for all of the crystal faces of the silver halide grains being grown. Since icositetrahedral crystal faces accept additional silver halide deposition at a slow rate, renucleation can occur, creating a second grain population. Precipitation conditions can be adjusted by techniques generally known in the art to favor either continued grain growth or renucleation.

Failure of the art to observe icositetrahedral crystal faces for silver halide grains over decades of intense investigation as evidenced by published silver halide crystallographic studies suggests that there is not an extensive range of conditions that favor the selective retarding of silver halide deposition along icositetrahedral crystal faces. It has been discovered that growth modifiers can be employed to retard silver halide deposition selectively at icositetrahedral crystal faces, thereby producing these icositetrahedral crystal faces as the external surfaces of the silver halide grains being formed. The growth modifiers which have been identified are organic compounds. They are believed to be effective by reason of showing an adsorption preference for a icositetrahedral crystal face by reason of its unique arrangement of silver and halide ions. Growth modifiers that have been empirically proven to be effective in producing icositetrahedral crystal faces are described in the examples, below.

These growth modifiers are effective under the conditions of their use in the examples. From empirical screening of a variety of candidate growth modifiers under differing conditions of silver halide precipitation it has been concluded that multiple parameters must be satisfied to achieve icositetrahedral crystal faces, including not only the proper choice of a growth modifier, but also proper choice of other precipitation parameters identified in the examples. Failures to achieve icositetrahedral crystal faces with compounds shown to be effective as growth modifiers for producing icositetrahedral crystal faces have been observed when accompanying conditions for silver halide precipitation have been varied. However, it is appreciated that having demonstrated success in the preparations of silver halide emulsions containing grains with icositetrahedral crystal faces, routine empirical studies systematically varying parameters are likely to lead to additional useful preparation techniques.

Once silver halide grain growth conditions are satisfied that selectively retard silver halide deposition at icositetrahedral crystal faces, continued grain growth usually results in icositetrahedral crystal faces appearing on all the grains present in the silver halide precipitation reaction vessel. It does not follow, however, that all of the radiation sensitive silver halide grains in the emulsions of the present invention must have icositetrahedral crystal faces. For example, silver halide grains having icositetrahedral crystal faces can be blended with any other conventional silver halide grain population to produce the final emulsion. While silver halide emulsions containing any identifiable icositetrahedral crystal face grain surface are considered within the scope of this invention, in most applications the grains having at least one identifiable icositerahedral crystal face account for at least 10 percent of the total grain population and usually these grains will account for greater than 50 percent of the total grain population.

The emulsions of this invention can be substituted for conventional emulsions to satisfy known photographic applications. In addition, the emulsions of this invention can lead to unexpected photographic advantages.

For example, when a growth modifier is present adsorbed to the icositetrahedral crystal faces of the grains and has a known photographic utility that is enhanced by adsorption to a grain surface, either because of the more intimate association with the grain surface or because of the reduced mobility of the growth modifier, improved photographic performance can be expected. The reason for this is that for the growth modifier to produce a icositetrahedral crystal face it must exhibit an adsorption preference for the icositetrahedral crystal face that is greater than that exhibited for any other possible crystal face. This can be appreciated by considering growth in the presence of an adsorbed growth modifier of a silver halide grain having both cubic and icositetrahedral crystal faces. If the growth modifier shows an adsorption preference for the icositetrahedral crystal faces over the cubic crystal faces, deposition of silver and halide ions onto the icositetrahedral crystal faces is retarded to a greater extent than along the cubic crystal faces, and grain growth results in the elimination of the cubic crystal faces in favor of icositetrahedral crystal faces. From the foregoing it is apparent that growth modifiers which produce icositetrahedral crystal faces are more tightly adsorbed to these grain surfaces than to other silver halide grain surfaces during grain growth, and this enhanced adsorption carries over to the completed emulsion.

To provide an exemplary photographic application, Locker U.S. Pat. No. 3,989,527 describes improving the speed of a photographic element by employing an emulsion containing radiation sensitive silver halide grains having a spectral sensitizing dye adsorbed to the grain surfaces in combination with silver halide grains free of spectral sensitizing dye having an average diameter chosen to maximize light scattering, typically in the 0.15 to 0.8 μm range. Upon imagewise exposure radiation striking the undyed grains is scattered rather than being adsorbed. This results in an increased amount of exposing radiation striking the radiation sensitive imaging grains having a spectral sensitizing dye adsorbed to their surfaces.

A disadvantage encountered with this approach has been that spectral sensitizing dyes can migrate in the emulsion, so that to some extent the initially undyed grains adsorb spectral sensitizing dye which has migrated from the initially spectrally sensitized grains. To the extent that the initially spectrally sensitized grains were optimally sensitized, dye migration away from their surfaces reduces sensitization. At the same time, adsorption of dye on the grains intended to scatter imaging radiation reduces their scattering efficiency.

In the examples below it is to be noted that a specific spectral sensitizing dye has been identified as a growth modifier useful in forming silver halide grains having icositetrahedral crystal faces. When radiation sensitive silver halide grains having icositetrahedral crystal faces and a growth modifier spectral sensitizing dye adsorbed to the icositetrahedral crystal faces are substituted for the spectrally sensitized silver halide grains employed by Locker, the disadvantageous migration of dye from the icositetrahedral crystal faces to the silver halide grains intended to scatter light is reduced or eliminated. Thus, an improvement in photographic efficiency can be realized.

To illustrate another advantageous photographic application, the layer structure of a multicolor photographic element which introduces dye image providing materials, such as couplers, during processing can be simplified. An emulsion intended to record green exposures can be prepared using a growth modifier that is a green spectral sensitizing dye while an emulsion intended to record red exposures can be prepared using a growth modifier that is a red spectral sensitizing dye. Since the growth modifiers are tightly adsorbed to the grains and non-wandering, instead of coating the green and red emulsions in separate color forming layer units, as is conventional practice, the two emulsions can be blended and coated as a single color forming layer unit. The blue recording layer can take any conventional form, and a conventional yellow filter layer can be employed to protect the blended green and red recording emulsions from blue light exposure. Except for blending the green and red recording emulsions in a single layer or group of layers differing in speed in a single color forming layer unit, the structure and processing of the photographic element is unaltered. If silver chloride emulsions are employed, the approach described above can be extended to blending in a single color forming layer unit blue, green, and red recording emulsions, and the yellow filter layer can be eliminated. The advantage in either case is a reduction in the number of emulsion layers required as compared to a corresponding conventional multicolor photographic element.

In more general applications, the substitution of an emulsion according to the invention containing a growth modifier spectral sensitizing dye should produce a more invariant emulsion in terms of spectral properties than a corresponding emulsion containing silver halide grains lacking icositetrahedral crystal faces. Where the growth modifier is capable of inhibiting fog, such as 2-methyl-5-nitro-1-H-benzimidazole, 2-mercaptoimidazole, or 7-ethoxycarbonyl-6-methyl-2-methylthio-4-oxo-1,3,3a, 7-tetraazaindene, shown to be effective growth modifiers in the examples, more effective fog inhibition at lower concentrations may be expected. It is recognized that a variety of photographic effects, such as photographic sensitivity, minimum background density levels, latent image stability, nucleation, developability, image tone, adsorption, and reflectivity, are influenced by grain surface interactions with other components. By employing components, such as peptizers, silver halide solvents, sensitizers or desensitizers, supersensitizers, halogen acceptors, dyes, antifoggants, stabilizers, latent image keeping agents, nucleating agents, tone modifiers, development accelerators or inhibitors, development restrainers, developing agents, and other addenda that are uniquely matched to the icositetrahedral crystal surface, distinct advantages in photographic performance over that which can be realized with silver halide grains of differing crystal faces are possible.

The silver halide grains having icositetrahedral crystal faces can be varied in their properties to satisfy varied known photographic applications as desired. Generally the techniques for producing surface latent image forming grains, internal latent image forming grains, internally fogged grains, surface fogged grains, and blends of differing grains described in *Research Disclosure,* Vol. 176, December 1978, Item 17643, Section I, can be applied to the preparation of emulsions according to this invention. *Research Disclosure* is published by Kenneth Mason Publications, Ltd., Emsworth, Hampshire P010 7DD, England. The silver halide grains having icositetrahedral crystal faces can have silver salt deposits on their surfaces, if desired. Selective site silver salt deposits on host silver halide grains are taught by Maskasky U.S. Pat. Nos. 4,463,087 and 4,471,050, here incorporated by reference.

The growth modifier used to form the icositetrahedral crystal faces of the silver halide grain can be retained in the emulsion, adsorbed to the grain faces, displaced from the grain faces, or destroyed entirely. For example, where, as noted above, the growth modifier is also capable of acting as a spectral sensitizing dye or performing some other useful function, it is advantageous to retain the growth modifier in the emulsion. Where the growth modifier is not relied upon to perform an additional useful photographic function, its presence in the emulsion can be reduced or eliminated, if desired, once its intended function is performed. This approach is advantageous where the growth modifier is at all disadvantageous in the environment of use. The growth modifier can itself be modified by chemical interactions, such as oxidation, hydrolysis, or addition reactions, accomplished with reagents such as bromine water, base, or acid—e.g., nitric, hydrochloric, or sulfuric acid.

Apart from the novel grain structures identified above, the radiation sensitive silver halide emulsions and the photographic elements in which they are incorporated of this invention can take any convenient conventional form. The emulsions can be washed as described in *Research Disclosure,* Item 17643, cited above, Section II.

The radiation sensitive silver halide grains of the emulsions can be surface chemically sensitized. Noble metal (e.g., gold), middle chalcogen (e.g., sulfur, selenium, or tellurium), and reduction sensitizers, employed individually or in combination are specifically contemplated. Typical chemical sensitizers are listed in *Research Disclosures,* Item 17643, cited above, Section III. From comparisons of surface halide and silver ion arrangements in general the chemical sensitization response of silver halide grains having icositetrahedral crystal faces should be analogous, but not identical, to that of cubic and octahedral silver halide grains. That observation can be extended to emulsion addenda generally which adsorb to grain surfaces.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

The silver halide emulsions as well as other layers of the photographic elements of this invention can contain as vehicles hydrophilic colloids, employed alone or in combination with other polymeric materials (e.g., lattices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelatin (pigskin gelatin), gelatin derivatives—e.g., acetylated gelatin, phthalated gelatin, and the like, polysaccharides such as dextran, gum arabic, zein, casein, pectin, collagen derivatives, collodion, agar-agar, arrowroot, and albumin. It is specifically contemplated to employ hydrophilic colloids which contain a low proportion divalent sulfur atoms. The proportion of divalent sulfur atoms can be reduced by treating the hydrophilic colloid with a strong oxidizing agent, such as hydrogen peroxide. Among preferred hydrophilic colloids for use as peptizers for the emulsions of this invention are gelatino-peptizers which contain less than 30 micromoles of methionine per gram. Preferred hydrophilic colloids are disclosed in Maskasky U.S. Ser. No. 811,133, filed Dec. 18, 1985, titled A PROCESS FOR PRECIPITATING A TABULAR GRAIN EMULSION IN THE PRESENCE OF A GELATINO-PEPTIZER AND AN EMULSION PRODUCED THEREBY, commonly assigned. The vehicles can be hardened by conventional procedures. Further details of the vehicles and hardeners are provided in *Research Disclosure,* Item 17643, cited above, Sections IX and X.

The silver halide photographic elements of this invention can contain other addenda conventional in the photographic art. Useful addenda are described, for example, in *Research Disclosure,* Item 17643, cited above. Other conventional useful addenda include antifoggants and stabilizers, couplers (such as dye forming couplers, masking couplers and DIR couplers) DIR compounds, anti-stain agents, image dye stabilizers, absorbing materials such as filter dyes and UV absorbers, light scattering materials, antistatic agents, coating aids, and plasticizers and lubricants.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure,* Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred multicolor photographic element according to this invention containing incorporated dye image providing materials comprises a support bearing at least one blue sensitive silver halide emulsion layer having associated therewith a yellow dye forming coupler, at least one green sensitive silver halide emulsion layer having associated therewith a magenta dye forming coupler, and at least one red sensitive silver halide emulsion layer having associated therewith a cyan dye forming coupler, at least one of the silver halide emulsion layers containing grains having icositetrahedral crystal faces as previously described.

The elements of the present invention can contain additional layers conventional in photographic elements, such as overcoat layers, spacer layers, filter layers, antihalation layers, and scavenger layers. The support can be any suitable support used with photographic elements. Typical supports include polymeric films, paper (including polymer-coated paper), glass, and metal supports. Details regarding supports and other layers of the photographic elements of this invention are contained in *Research Disclosure,* Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements, such as those illustrated by *Research Disclosure,* Vol. 184, August 1979, Item 18431.

Processing of the imagewise exposed photographic elements can be accomplished in any convenient conventional manner. Processing procedures, developing agents, and development modifiers are illustrated by *Research Disclosure,* Item 17643, cited above, Sections XIX, XX, and XXI, respectively.

EXAMPLES

The invention can be better appreciated by reference to the following specific examples. In each of the examples the term "percent" means percent by weight, unless otherwise indicated, and all solutions, unless otherwise indicated, are aqueous solutions. Dilute nitric acid or dilute sodium hydroxide was employed for pH adjustment, as required.

EXAMPLE 1

This example illustrates the preparation of an icositetrahedral silver bromide emulsion having the Miller index {211}, beginning with a cubic host emulsion and using as growth modifier Compound I.

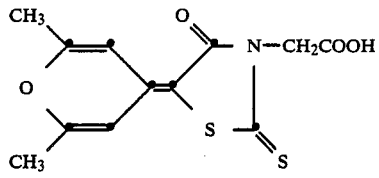

Compound I

To a reaction vessel supplied with a stirrer was added 0.05 mole of a cubic silver bromide emulsion of mean grain size 0.8 μm, containing about 10 g/Ag mole of gelatin. Water was added to make the total weight 50 g. To the emulsion at 40° C. was added 2.0 millimole/initial Ag mole of compound I dissolved in 2 mL. of methanol and 2 drops of triethylamine. The emulsion was then held for 15 min. at 40° C. The pH was adjusted to 6.0 at 40° C. The temperature was raised to 60° C., and the pAg adjusted to 8.5 at 60° C. with KBr and maintained at that value during the precipitation. A 2.5M solution of $AgNO_3$ was introduced at a constant rate over a period of 125 min. while a 2.5M solution of KBr was added as needed to hold the pAg constant. A total of 0.0625 mole Ag was added.

Figure 12:
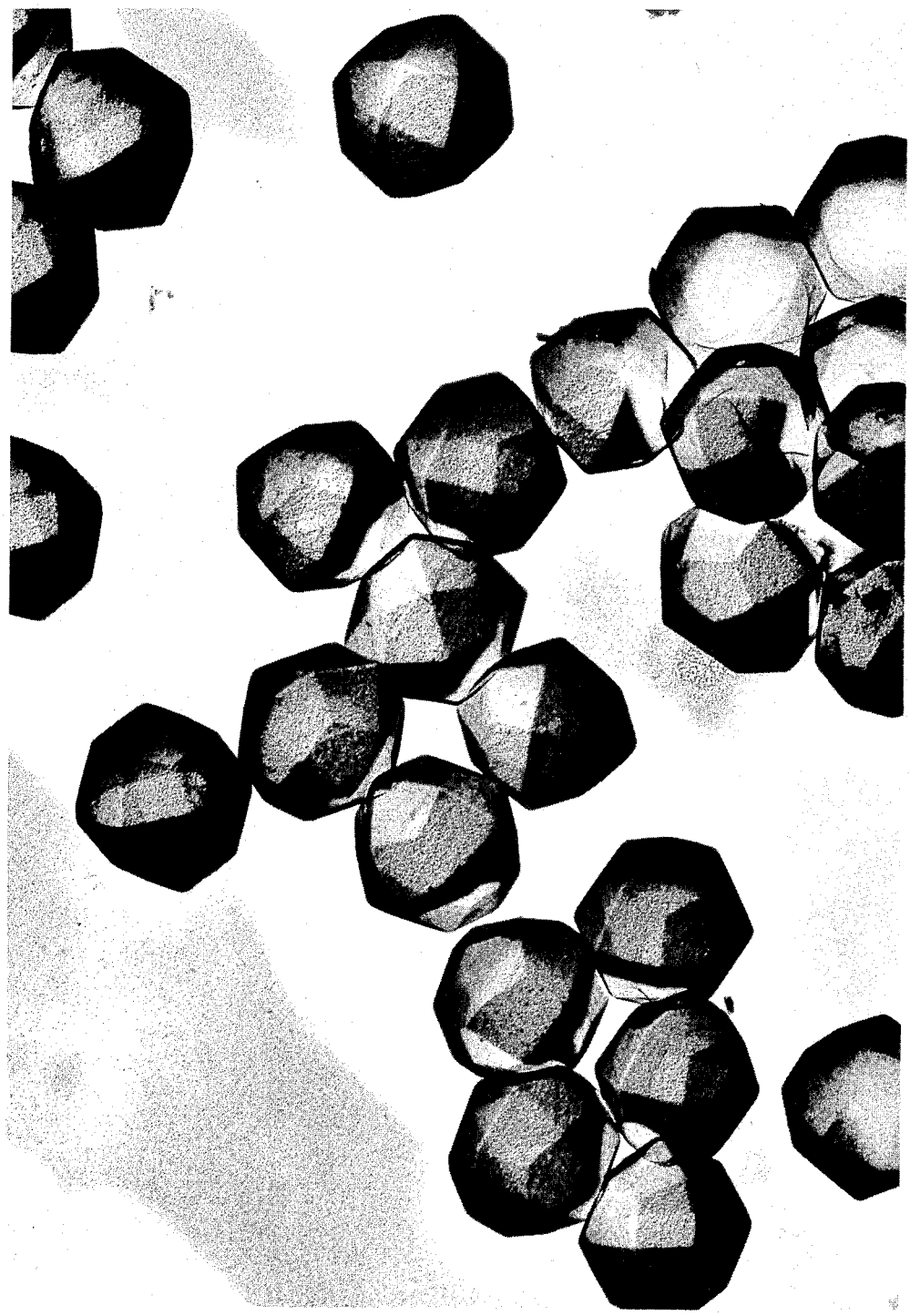

A carbon replica electron micrograph (FIG. 12) shows Emulsion 1 to have icositetrahedral faces. The Miller index of the icositetrahedral faces was determined by measurement of the relative angle between two adjacent icositetrahedral crystal faces. From this angle, the supplement of the relative angle, which is the angle between their respective crystallographic vectors, $\phi$, could be obtained, and the Miller index of the adjacent icositetrahedral crystal faces was identified by comparison of this angle $\phi$ with the theoretical intersecting angle $\theta$ between $[h_1l_1l_1]$ and $[h_2l_2l_2]$ vectors. The angle $\theta$ was calculated as described by Phillips, cited above, at pages 218 and 219.

To obtain the angle $\phi$, a carbon replica of the crystal sample was rotated on the stage of an electron microscope until, for a chosen crystal, the angle of observation was directly along the line of intersection of the two adjacent crystal faces of interest. An electron micrograph was then made, and the relative angle was measured on the micrograph with a protractor. The supplement of the measured relative angle was the angle $\phi$ between vectors. Comparison of $\phi$ with $\theta$ enabled the crystal faces to be assigned. If the experimentally determined angle was nearly mid-way between two theoretical angles, the one associated with the lower Miller index was used for the assignment. The results for Emulsion 1 are summarized in Table I. The number of measurements made is given in parentheses. Theoretical values for vectors up to {544} were considered.

EXAMPLE 2

This example illustrates the preparation of an icositetrahedral silver bromide emulsion having the Miller index {211}, beginning with a cubic host emulsion, and using Compound II as a growth modifier.

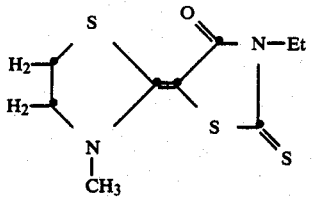

Compound II

Figure 13:
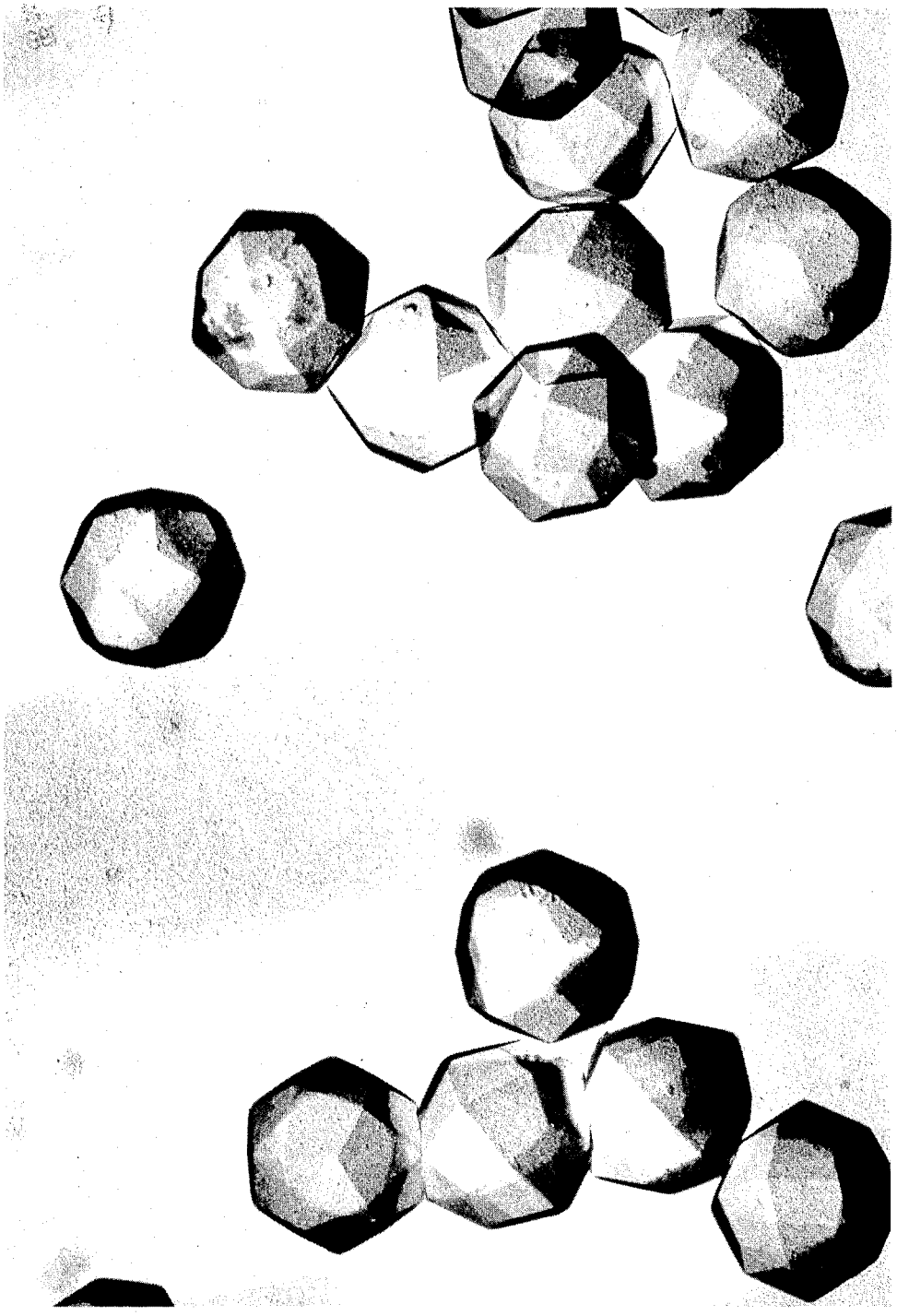

This emulsion was prepared as described for Example 1, except that the growth modifier was 2.0 millimole/Ag mole of Compound II, dissolved in 3 mL. N,N-diemthylformamide. The precipitation was carried out for 100 min., consuming 0.05 moles Ag. An electron micrograph of the resulting icositetrahedral emulsion grains is shown in FIG. 13. The Miller index was determined to be {211} by the measurements listed in Table I, using the method described for Example 1.

EXAMPLE 3

This example illustrates the preparation of an icositetrahedral silver bromide emulsion having the Miller index {211}, beginning with a cubic host emulsion and using 4-hydroxy-6-methyl-2-methylmercapto-1,3,3a,7-tetrazaindene (Compound III) as a growth modifier.

To a reaction vessel supplied with a stirrer was added 0.4 g of deionized bone gelatin dissolved in 24 g of water. To this was added 0.04 mole of a cubic silver bromide emulsion of mean grain size 0.8 μm, containing 10 g/Ag mole gelatin and having a total weight of 15.7 g. The mixture was heated to 40° C., and 6 millimoles/Ag mole of Compound III were added, dissolved in 3 mL. water and 3 drops triethylamine. The resulting mixture was held for 15 min. at 40° C. The pH was adjusted to 6.0 at 40° C. The emulsion was then heated to 60° C., the pAg adjusted to 8.5 at 60° C. with KBr, and maintained at that value during the precipitaton. A 2M solution of $AgNO_3$ was introduced over a period of 100 min. at a constant rate, while a 2M solution of KBr was added as needed to hold the pAg constant. A total of 0.04 mole Ag was added.

Figure 14:
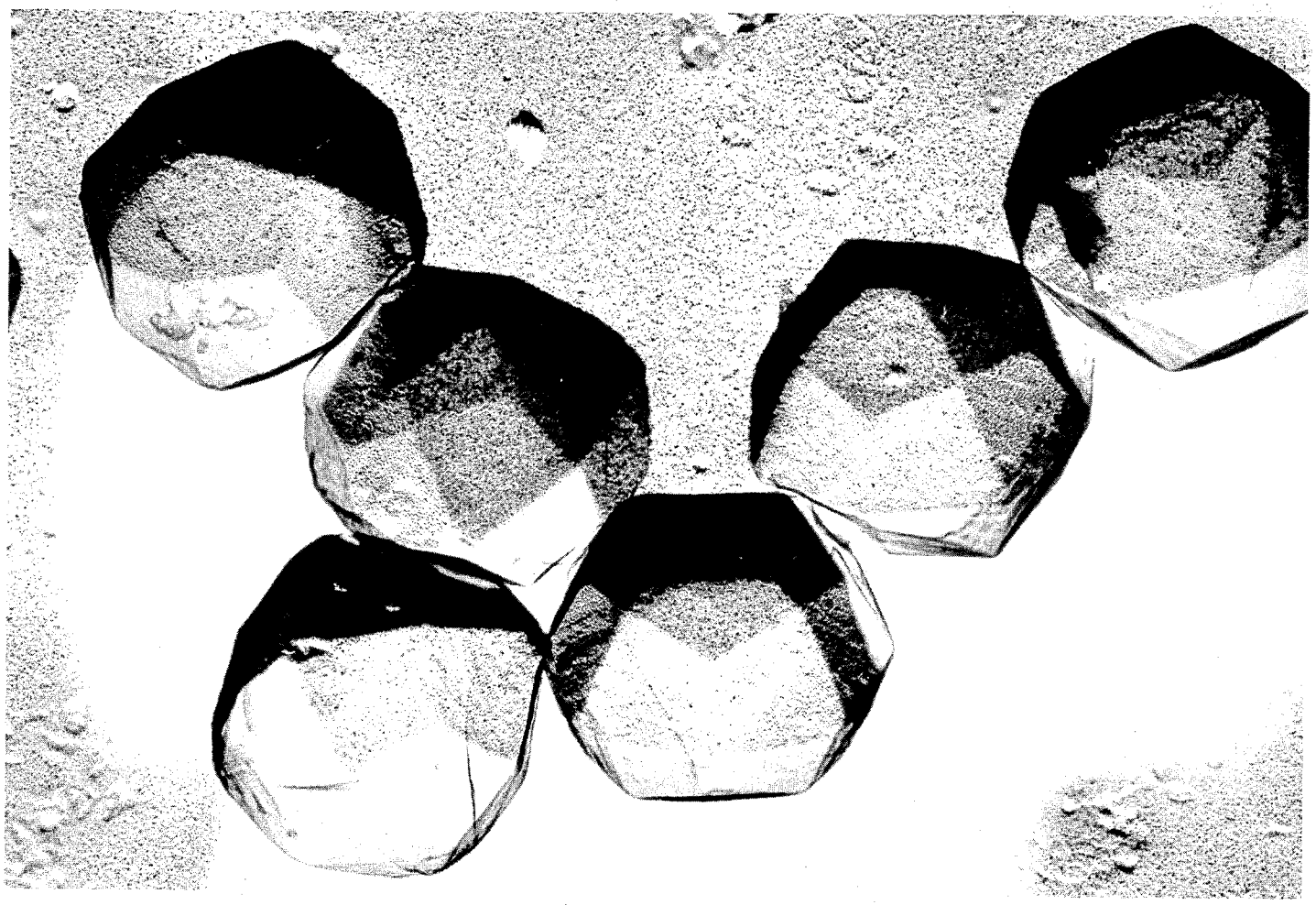

An electron micrograph of the resulting icositetrahedral emulsion grains is shown in FIG. 14. The Miller index was determined to be {211} by visual comparison with an accurate model of a {211} icositetrahedron.

EXAMPLE 4

This example illustrates the preparation of an icositetrahedral silver bromide emulsion having the Miller index {211}, beginning with a cubic host emulsion and using Compound IV as a growth modifier.

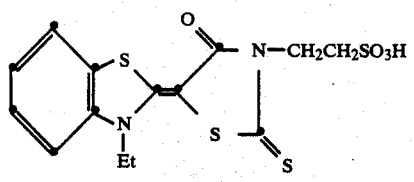

Compound IV

The emulsion was prepared as described for Example 1, except that the growth modifier was 2.0 millimole/Ag mole of Compound IV, dissolved in 6 mL. of N,N-dimethylformamide, 1.5 mL. of water, and 3 drops of triethylamine. The precipitation was carried out for 100 min., consuming 0.05 mole Ag.

Figure 15:
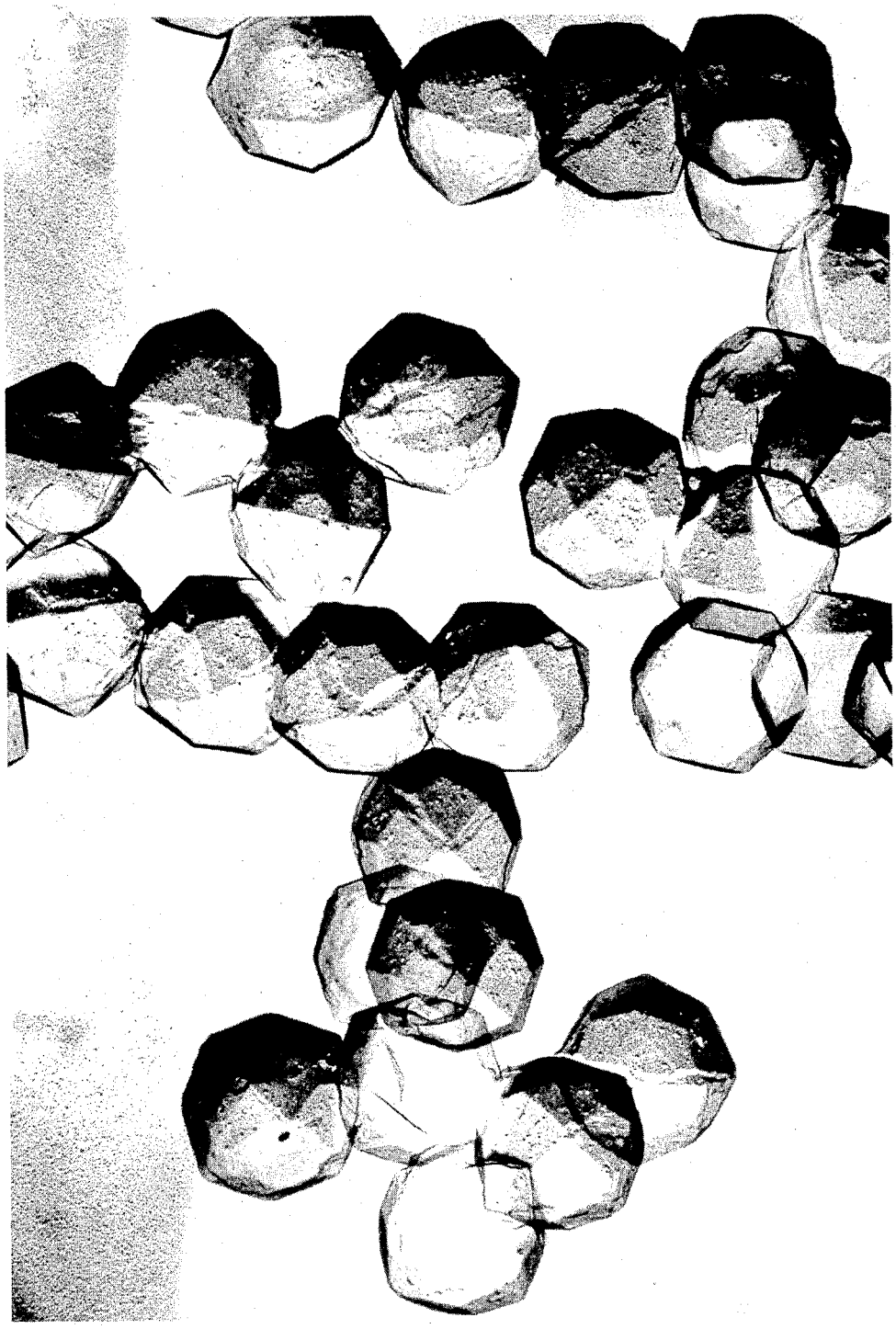

An electron micrograph of the resulting icositetrahedral emulsion grains is shown in FIG. 15. The Miller index was determined to be {211} by the measurements listed in Table I, using the methods described for Example 1.

EXAMPLE 5

This example illustrates the preparation of an icositetrahedral silver bromide emulsion having the Miller index {211}, beginning with a cubic host emulsion, and using Compound V as a growth modifier.

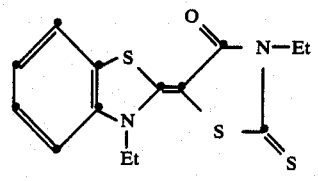

Compound V

Emulsion Example 5 was prepared as described for Example 1, except for the following changes: The growth modifier was 2.0 millimole/Ag mole of Compound V, dissolved in 3 mL. of N,N-dimethylformamide. The precipitation was carried out using 2.0M $AgNO_3$ and 2.0M KBr, in two stages. In the first stage, the $AgNO_3$ solution was added over a period of 75 min., consuming 0.03 mole Ag. In the second stage the $AgNO_3$ addition rate was halved, so that an additional 0.01 mole Ag was added over a period of 50 min. The pAg was maintained at 8.5 throughout by addition of the KBr solution as described for Example 1.

Figure 16:
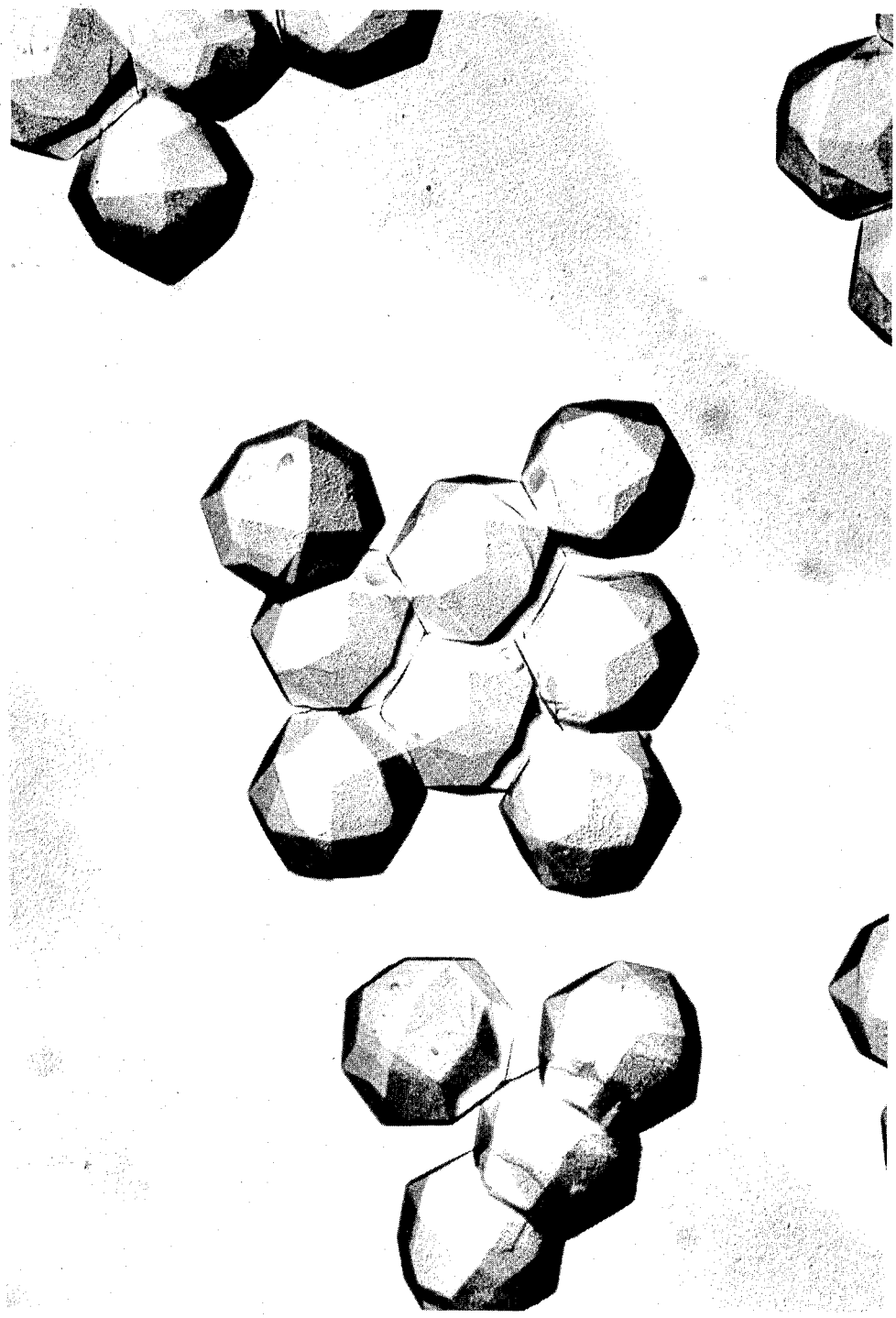

An electron micrograph of the resulting icositetrahedral emulsion grains is shown in FIG. 16. The Miller index was determined to be {211} by the measurements listed in Table I, using the method described for Example 1.

EXAMPLE 6

This example illustrates the preparation of an icositetrahedral silver bromide emulsion having the Miller index {211}, beginning with an octahedral host emulsion and using 2-methyl-5-nitro-1H-benzimidazole (Compound VI) as the growth modifier.

The emulsion was prepared as described for Example 1, except for the following changes: The host emulsion was 0.05 mole of an octahedral silver bromide emulsion of mean grain size 0.8 μm. The growth modifier was 6.0 millimole/initial Ag mole of Compound VI dissolved in 3 mL. methanol. The precipitation was over a period of 100 minutes consuming 0.05 moles Ag.

Figure 17:
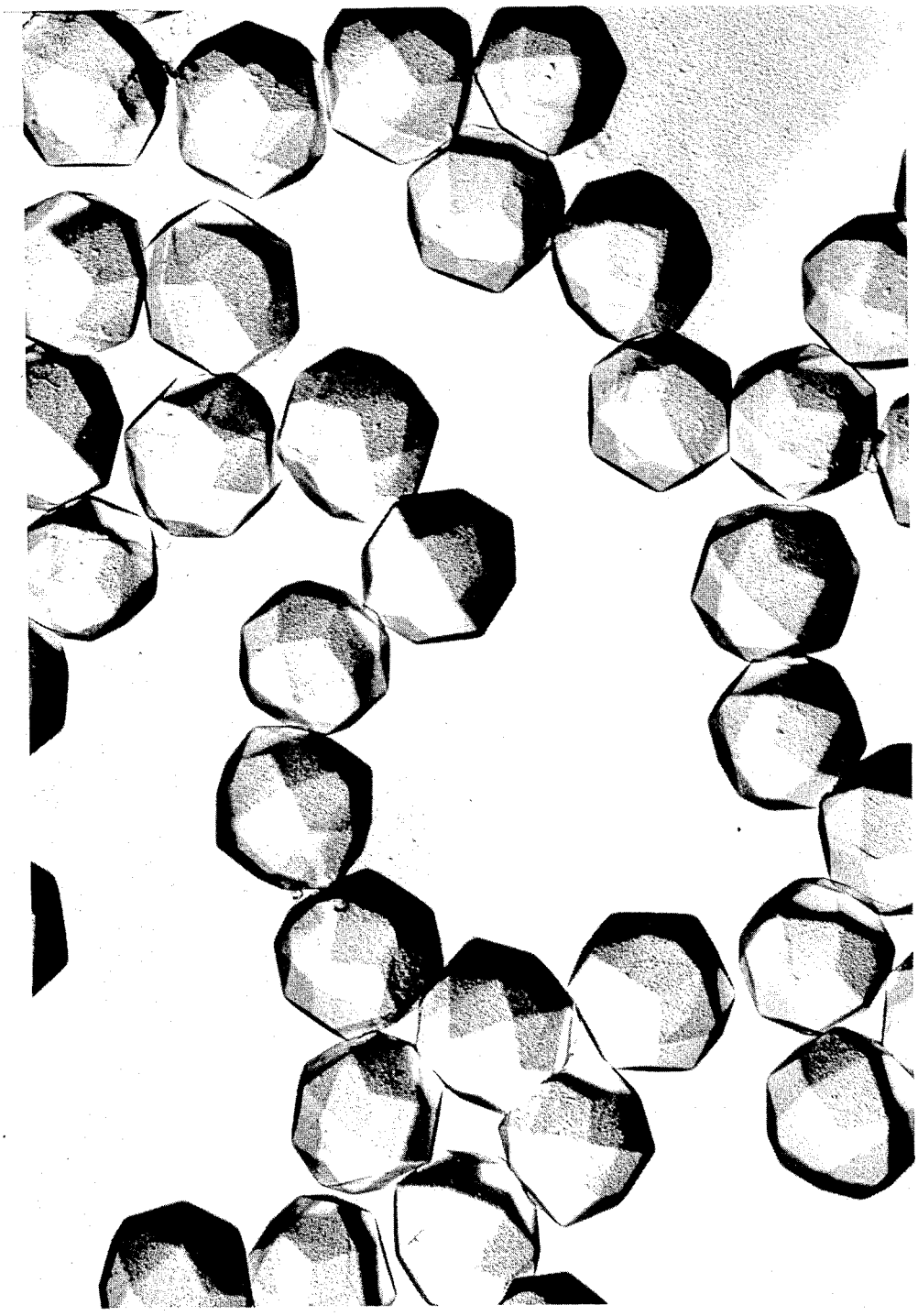

An electron micrograph of the resulting icositetrahedral emulsion grains is shown in FIG. 17. The Miller index was determined to be {211} by the measurements listed in Table I, using the method described for Example 1.

EXAMPLE 7

This example illustrates the preparation of an icositetrahedral silver bromide emulsion having the Miller index {211}, beginning with a cubic host emulsion, using as growth modifier Compound VII, and with ammonia present during the shell precipitation.

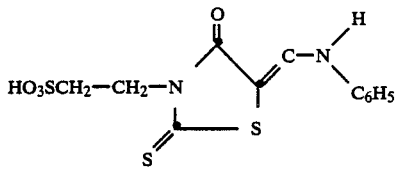

Compound VII

To a reaction vessel supplied with a stirrer was added 1.0 g of deionized bone gelatin dissolved in 27.5 g of water. To this was added 0.05 mole of a cubic silver bromide emulsion of mean grain size 0.8 μm, containing about 10 g/Ag mole of gelatin and having a total weight of 21.6 g. The emulsion was heated to 40° C., and 2.0 millimole/initial Ag mole of Compound VII were added, dissolved in a 2.5 mL. portion of a solvent prepared from 18 mL. N,N-dimethylformamide, 2 mL. water and 1 drop of triethylamine. The mixture was held at 40° C. for 15 min.

Just prior to beginning the precipitation 3.4 millimoles of an aqueous $(NH_3)_2SO_4$ solution (1.0 mL), containing also 0.25 millimoles of KBr, was added, followed by 25.9 millimoles of ammonium hydroxide (2.0 mL). The pAG was measured as 9.2 at 40° C., and was maintained through the precipitation. At 40° C. a 2.5M solution of $AgNO_3$ was added at the constant flow rate along with a 2.5M solution of KBr as necessary to maintain the pAg. The precipitation consumed 0.05 mole Ag over a period of 100 min. The pH was then slowly adjusted to 5.5.

Figure 18:
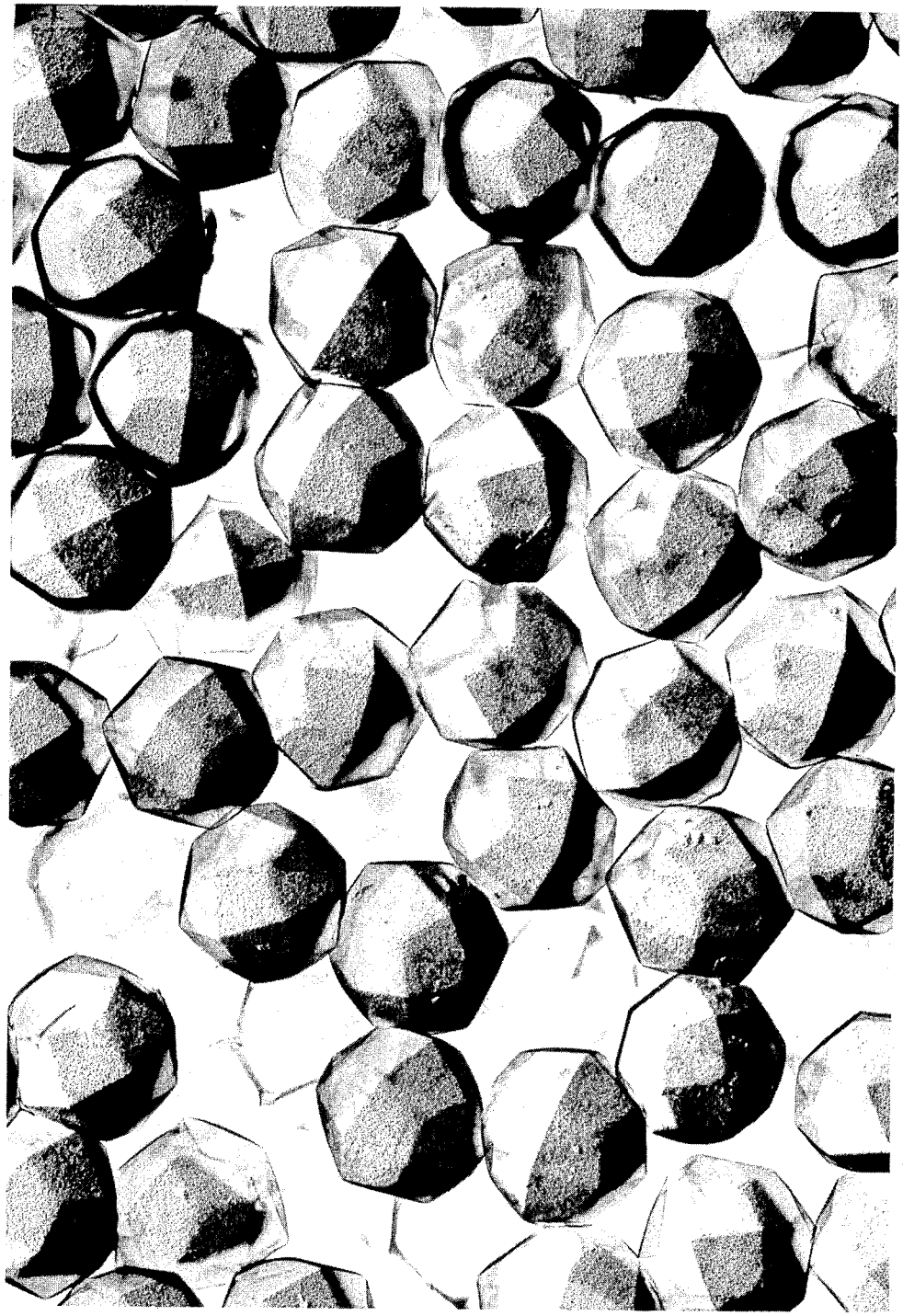

An electron micrograph of the resulting icositetrahedral emulsion grains is shown in FIG. 18. The Miller index was determined to be {211} by the measurements listed in Table I, using the method described for Example 1.

EXAMPLE 8

This example illustrates the preparation of an icositetrahedral silver bromide emulsion using a cubic host emulsion and Compound VII as growth modifier, as in Example 7, but in the absence of ammonia during the precipitation of the outer portion (i.e., shell) of the grains. The resulting grains showed a Miller index of {311} as compared to the {211} index of the grains prepared in the presence of ammonia.

To a reaction vessel supplied with a stirrer was added 0.04 mole of a cubic silver bromide emulsion of mean grain size 1.8 μm, containing about 10 g/Ag mole gelatin. The emulsion was diluted with distilled water to a total weight of 40 grams. KBr solution (0.5 ml) was added to bring the bromide concentration of the emulsion in the reaction vessel to $5\times10_{-3}$M. The emulsion was heated to 40° C., and 1.5 millimoles/Ag mole of Compound VII were added, dissolved in 1 mL. of a solvent prepared from 18 mL. N,N-dimethylformamide, 2 mL. water, and 2 drops of triethylamine. The mixture was held for 15 min. at 40° C. The pH was adjusted to 6.0 at 40° C. The emulsion was then heated to 60° C. The pAg was adjusted to 8.5 at 60° C. with KBr and maintained at that value during the precipitation. A 2M solution of $AgNO_3$ was introduced over a period of 123 min. at a constant rate, while a 2M solution of KBr was added as needed to hold the pAg constant. A total of 0.02 mole Ag was added.

Two scanning electron micrographs of the resulting icositetrahedral emulsion grains are shown in FIGS. 19A and 19B. The Miller index was determined to be {311} by the measurements listed in Table I, using the method described for Example 1.

EXAMPLE 9

This emulsion illustrates the preparation of an icositetrehedral silver bromide emulsion having the Miller index {311}, beginning with a cubic host emulsion, using Compound VIII as the growth modifier, and with ammonia present during the precipitation of the outer portion of the grain.

This emulsion was prepared as described for Example 7, but with the following differences: The deionized bone gelatin was omitted from the starting solution. The growth modifier was 3.0 millimole/Ag mole of Compound VIII dissolved in 3 mL methanol and 2 drops of triethylamine. The pAg prior to the precipitation was measured as 9.4 at 40° C. and maintained at that value during the precipitation.

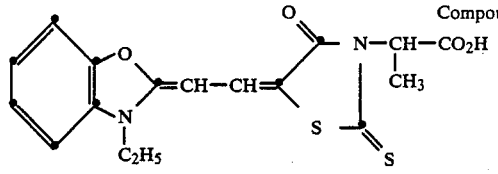

Compound VIII

Figure 20:
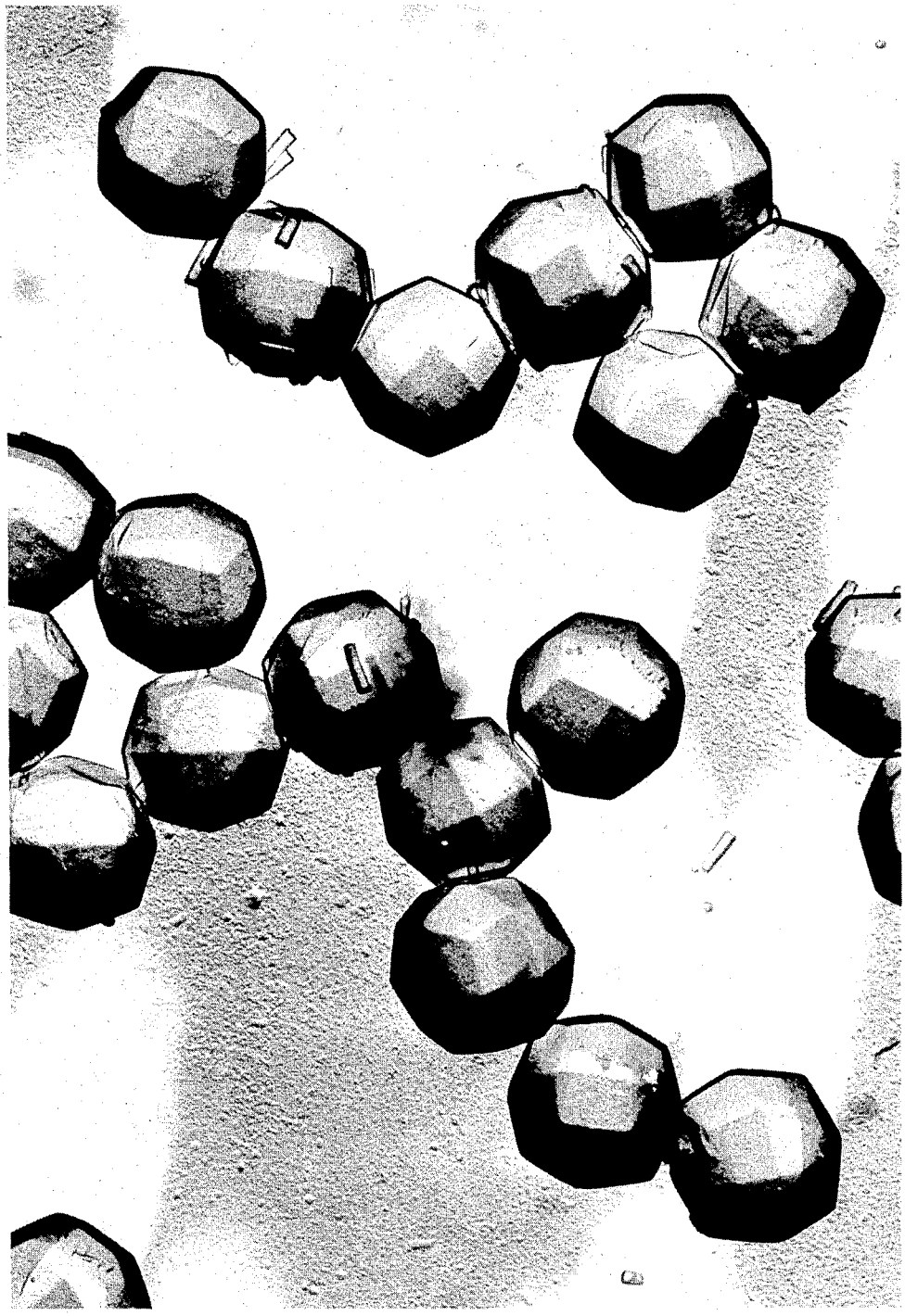

An electron micrograph of the resulting icositetrahedral emulsion grains is shown in FIG. 20. By visual comparison of the micrographs with an accurate model, the Miller index was determined to be {311}.

EXAMPLE 10

This example illustrates the preparation of an icositetrahedral silver bromide emulsion having the Miller index {311}, beginning with a cubic host emulsion and using Compound IX as the growth modifier.

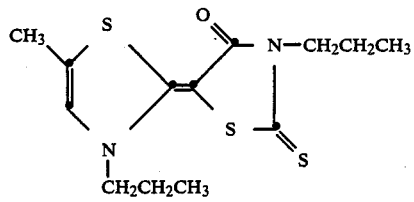

Compound IX

This emulsion was prepared as described for Example 1, but using 2.0 millimole/Ag mole of Compound IX as a growth modifier, dissolved in 3 mL. N,N-dimethylformamide. The precipitation time was 100 min., consuming 0.05 mole Ag.

Figure 21:
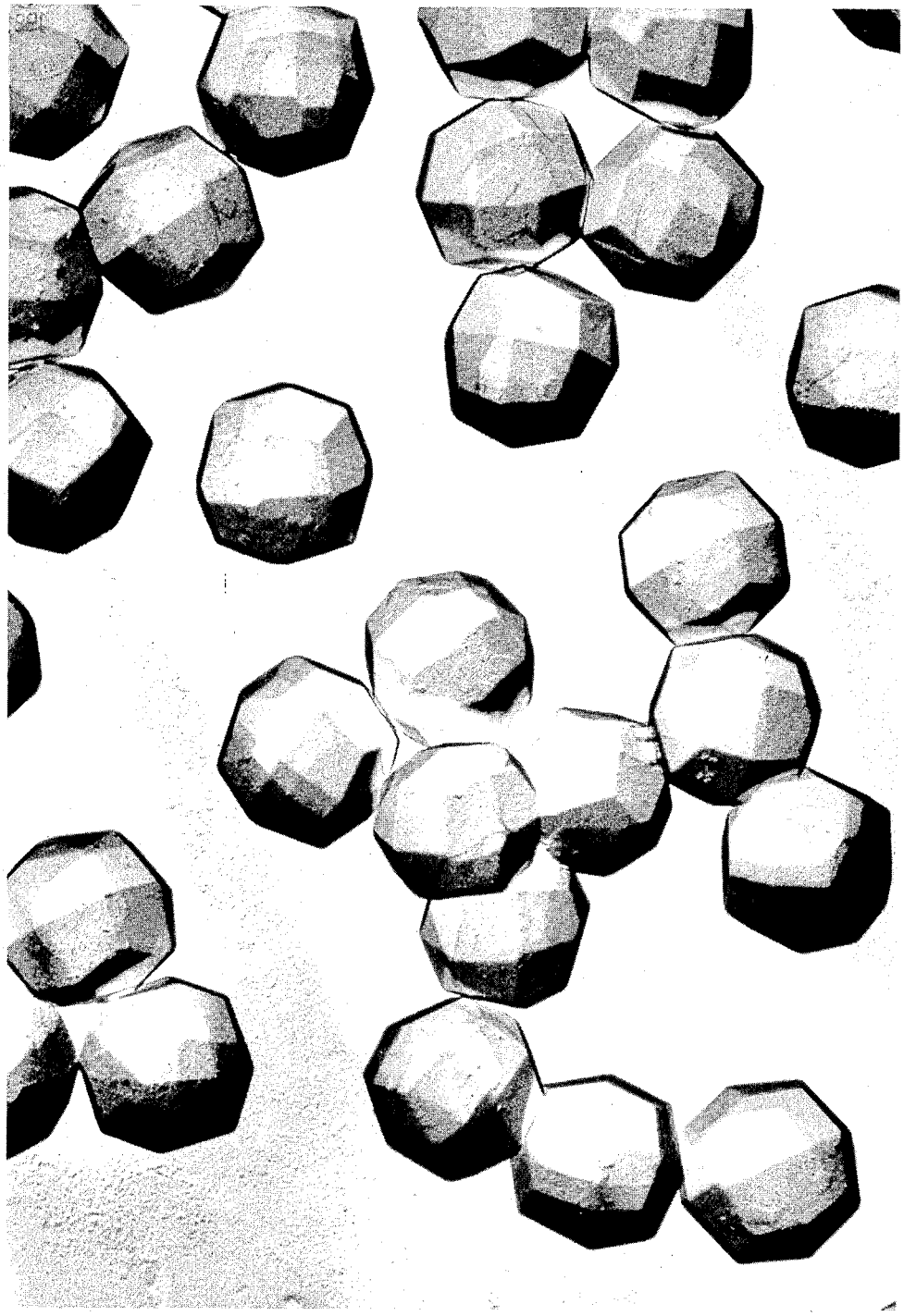

An electron micrograph of the resulting icositetrahedral emulsion grains is shown in FIG. 21. The Miller index was determined to be {311} by the measurements listed in Table I, using the method described for Example 1.

EXAMPLE 11

This emulsion illustrates the preparation of a silver bromide icositetrahedral emulsion having a {311} Miller index by the Ostwald ripening of a small grain size AgBr emulsion onto a mixture of cubic and octahedral host grains in the presence of Compound X acting as a growth modifier.

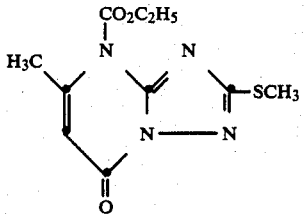

Compound X

To a reaction vessel were added 32.5 g (7.5 millimole) of a freshly prepared AgBr Lippmann emulsion of mean grain size approximately 0.02 μm containing 167 g/Ag mole of gelatin. At 35° C., 0.09 millimole of Compound X was added, dissolved in 1 mL methanol and 1 mL N,N-dimethylformamide. Then 3.0 mL, 7.5 millimole of AgBr consisting of a mixture of two emulsions containing approximately equal numbers of cubes (0.8 μm mean grain size; 10 g/Ag mole gelatin) and octahedra (0.8 μm mean grain size; 10 g/Ag mole gelatin) were added. The pH was adjusted to 0.6 at 40° C., and the pAg to 9.3 with KBr solution. The mixture was then heated to 60° C., and allowed to stir at that temperature for 19 hrs.

Figure 22:
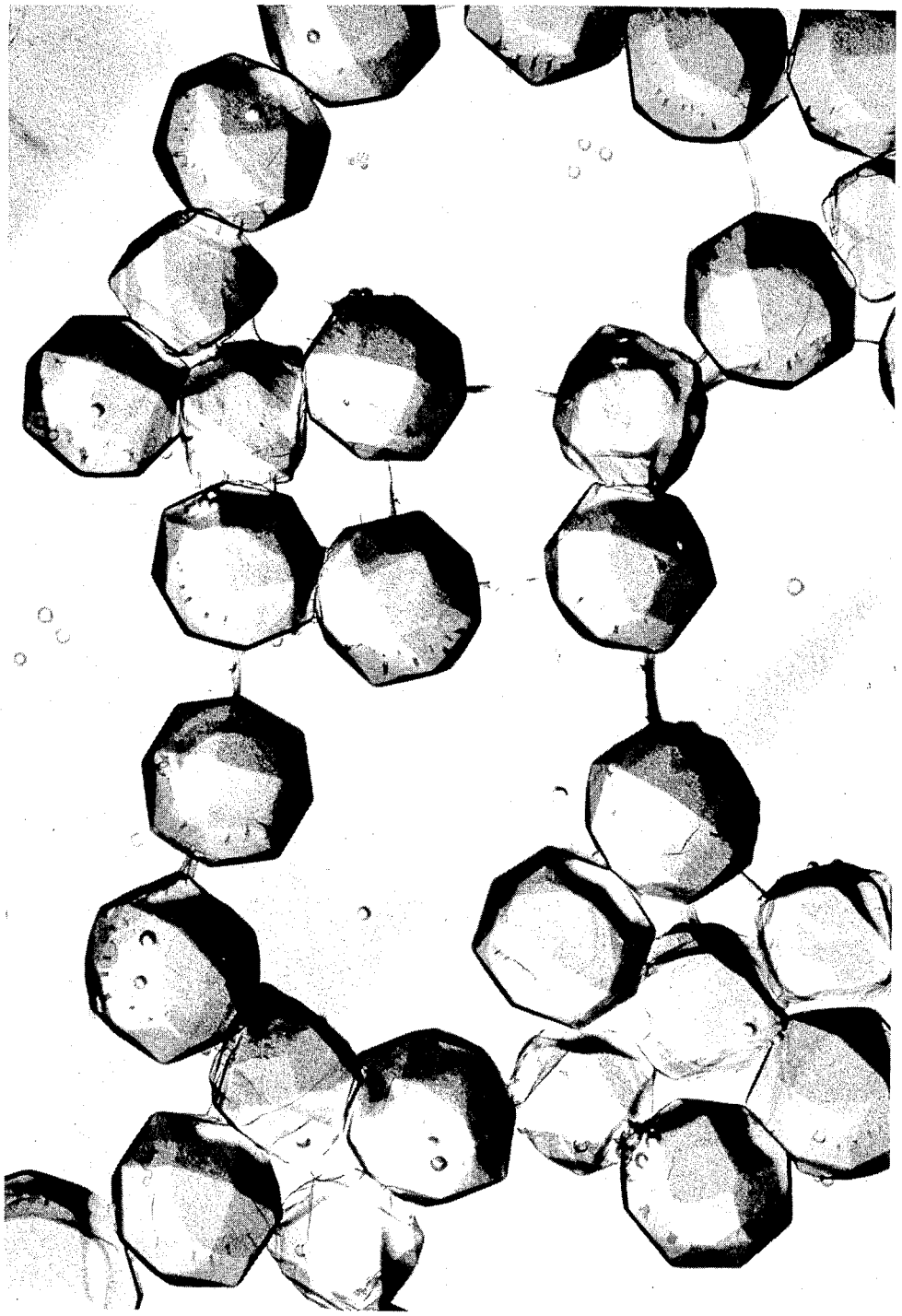

FIG. 22 is an electron micrograph of the resulting emulsion, showing the crystals to have an icositetrahedral habit. The Miller index was determined to be {311} by visual comparison with an accurate model of a regular {311} icositetrahedron.

EXAMPLE 12

This example illustrates the preparation of a silver bromide icositetrahedral emulsion having {533} Miller index crystal faces, using a cubic host emulsion and Compound XI, 2-mercaptoimidazole as a growth modifier.

The emulsion was prepared as described for Example 1, but using 6.0 millimole/Ag mole of Compound XI as growth modifier, dissolved in 3 mL. methanol. The precipitation time was 100 min., consuming 0.05 mole Ag.

Figure 23:
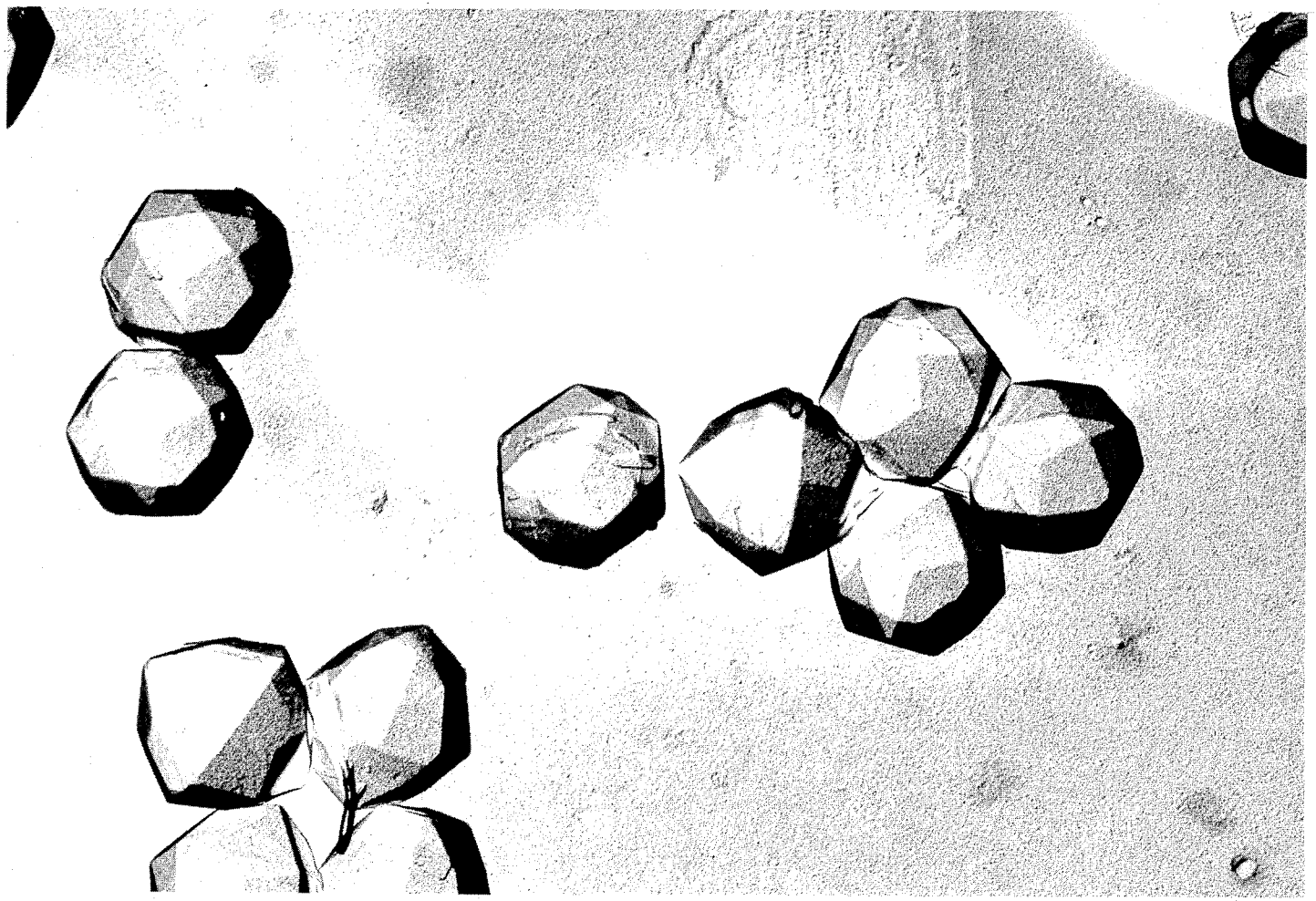

An electron micrograph of the resulting icositetrahedral emulsion grains is shown in FIG. 23. The Miller index was determined to be {533} by the measurements listed in Table I, using the method described for Example 1.

EXAMPLE 13

This example illustrates the preparation of an isositetrahedral silver chloride emulsion having {211} Miller index crystal faces, using a cubic silver chloride host emulsion and Compound VI as the growth modifier. It is to be noted that the same Miller index crystal faces were obtained when this growth modifier was used to prepare the silver bromide emulsion of Example 6.

To a reaction vessel supplied with a stirrer was added 0.05 mole of a cubic silver chloride emulsion of mean grain size 0.65 μm containing 40 g/Ag mole gelatin. Water was added to make the total weight 48 g. To the emulsion at 40° C. were added 6.0 millimole/Ag mole of Compound VI dissolved in 3 mL. methanol. The emulsion was held 15 min. at 40° C. The temperature was then raised to 50° C. The pH was adjusted to 5.93 at 50° C. and maintained at about this value during the precipitation. The pAg was adjusted to 7.7 at 50° C. with NaCl solution and maintained at that value during the precipitation. A 2.5M solution of $AgNO_3$ was introduced at a constant rate over a period of 125 min., while a 2.7M solution of NaCl was added as needed to hold the pAg constant. A total of 0.0625 mole Ag was added.

Figure 24:
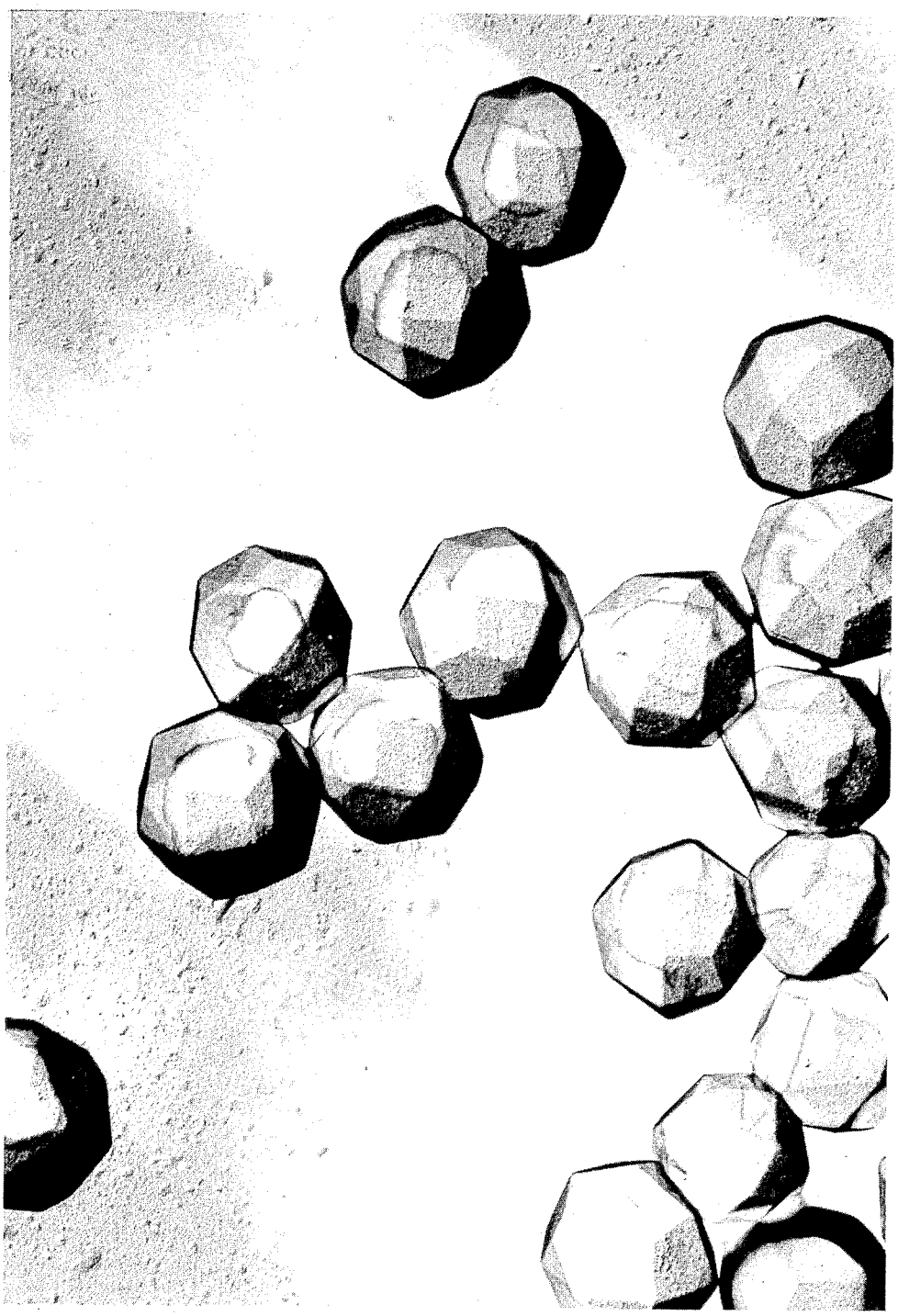

An electron micrograph of the resulting icositetrahedral emulsion grains is shown in FIG. 24. The Miller index was determined to be {211} by the measurements listed in Table I, using the method described for Example 1.

EXAMPLE 14

This example illustrates the preparation of an icositetrahedral silver chloride emulsion having the Miller index {522}, making use of Compound I as the growth modifier. It is noted that the use of Compound I resulted in an index of {211} in the case of the silver bromide emulsion of Example 1.

The emulsion was prepared by a procedure similar to that described in Example 13, but with the following changes: The growth modifier was 2.0 millimoles/Ag mole of Compound I, dissolved in 2 mL. methanol and 2 drops of triethylamine. The pH was maintained at 5.92 at 50° C., and the pAg was maintained at 7.9 during the precipitation.

Figure 25:
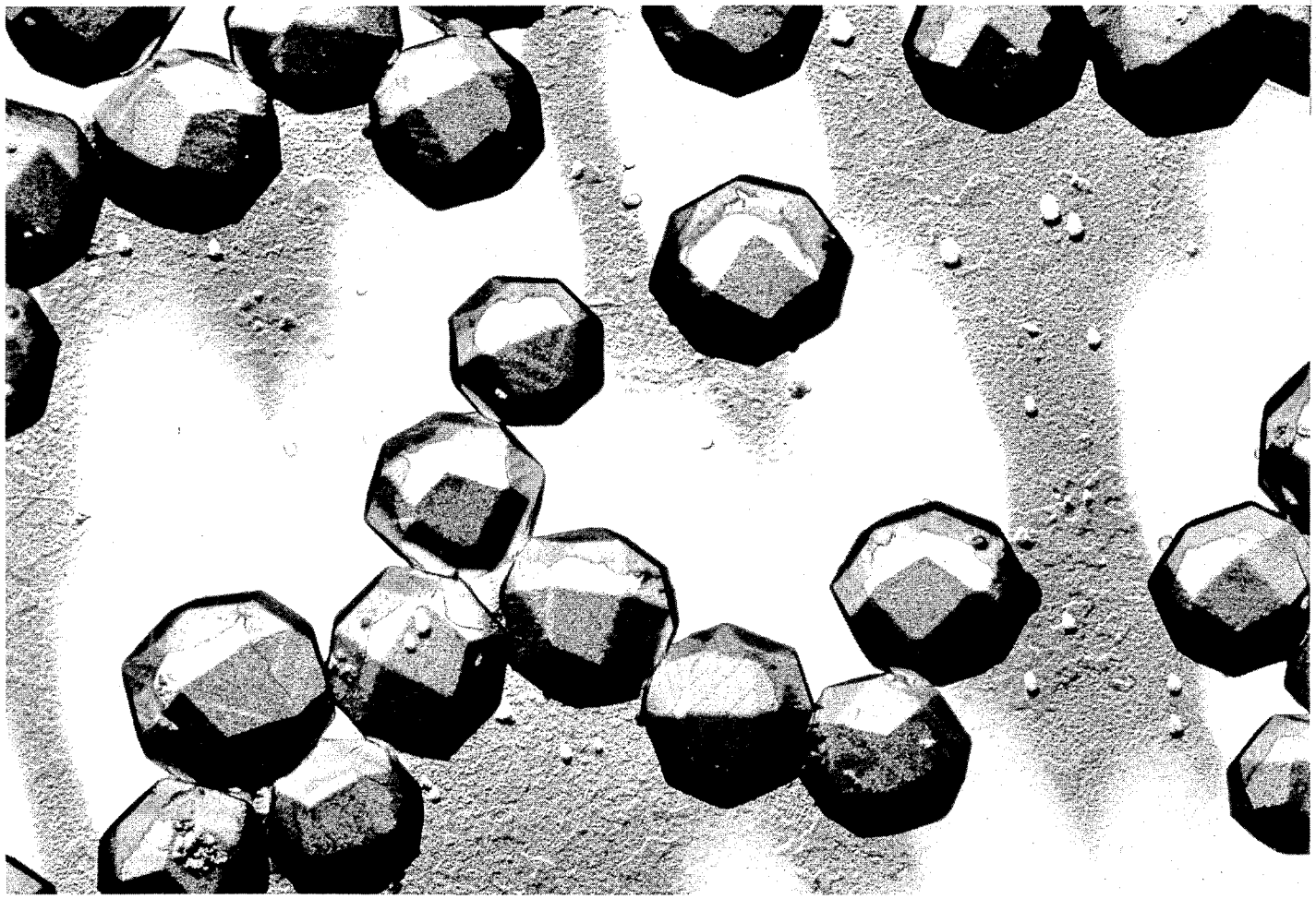

An electron micrograph of the resulting icositetrahedral emulsion grains is shown in FIG. 25. The Miller index was determined to be {522} by the measurements listed in Table I, using the the method described for Example 1.

EXAMPLE 15

This example illustrates the preparation of an icositetrahedral silver bromoiodide (3 mole % iodide) emulsion having the Miller index {211}, employing a cubic AgBrI host emulsion and Compound VI as growth modifier.

To a reaction vessel supplied with a stirrer was added 0.05 mole (50 g) of a cubic silver bromoiodide emulsion, of mean grain size 0.6 μm, containing 3 mole % iodide and 30 g/Ag mole gelatin. To the emulsion at 40° C. were added 6.0 millimoles/Ag mole of Compound VI dissolved in 3 mL. methanol. The emulsion was held 15 min. at 40° C. The temperature was then raised to 60° C. The pH was adjusted to 6.0 at 60° C. and maintained at that value. The pAg was adjusted to 8.5 with KBr and maintained at 8.5 throughout the precipitation. A 2.5M solution of $AgNO_3$ was introduced at a constant rate over a period of 250 min., while a solution which was 2.43M in KBr and 0.07M in KI was added as needed to hold the pAg constant. A total of 0.0625 mole Ag was added.

Figure 26:
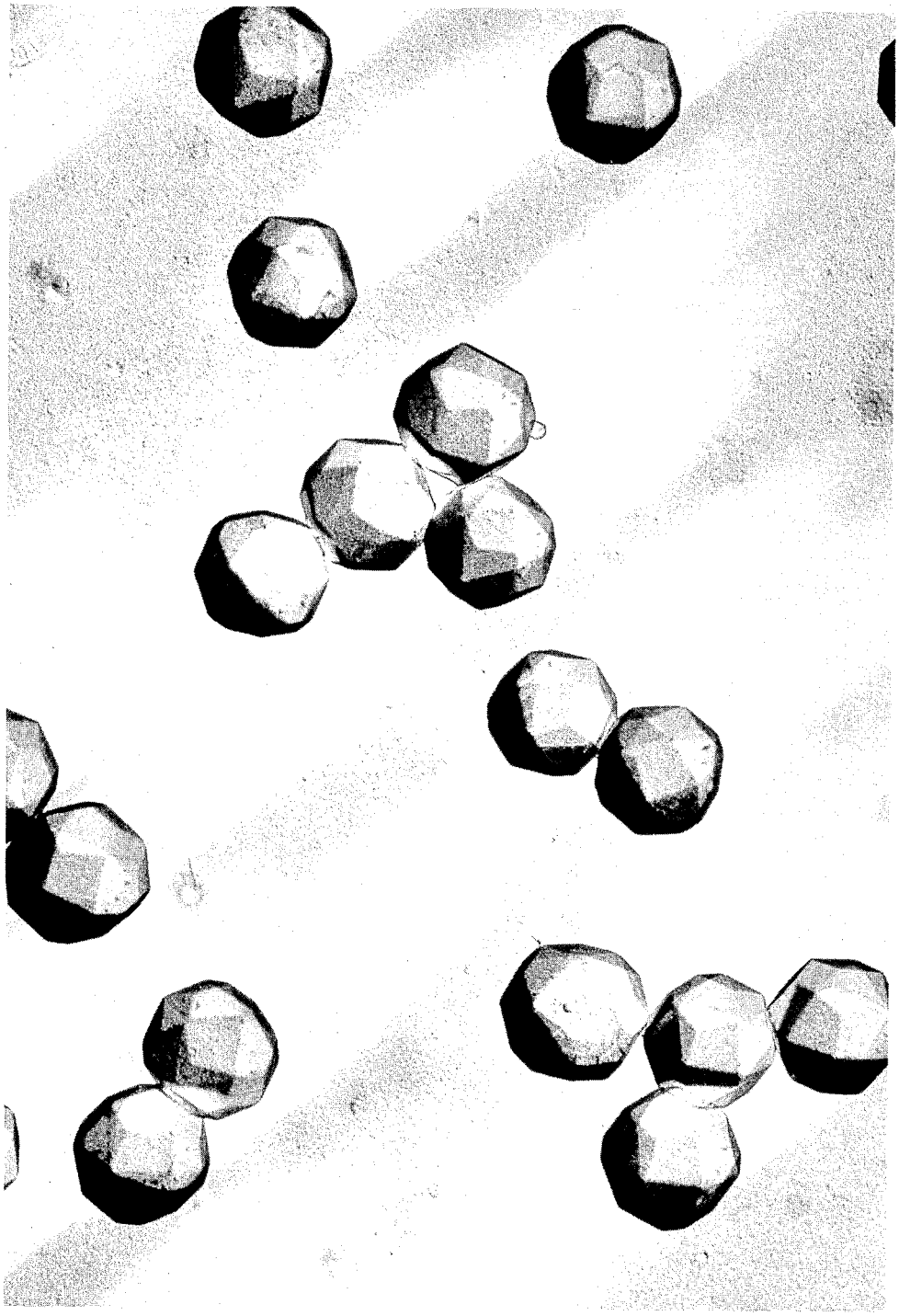

An electron micrograph of the resulting icositetrahedral emulsion grains is shown in FIG. 26. The Miller index was determined to be {211} by visual comparison with an accurate model of a regular {211} icositetrahedron.

EXAMPLE 16

This example illustrates the preparation of an icositetrahedral silver bromoiodide (3 mole % iodide) emulsion having the Miller index {211}, employing a cubic AgBrI host emulsion and Compound I as a growth modifier.

This emulsion was prepared by the procedure described for Example 15, but using 3.0 millimoles/Ag mole of Compound I as a growth modifier, dissolved in 3 mL. methanol and 3 drops of triethylamine. The pH was maintained at 5.87 at 60° C.

Figure 27:
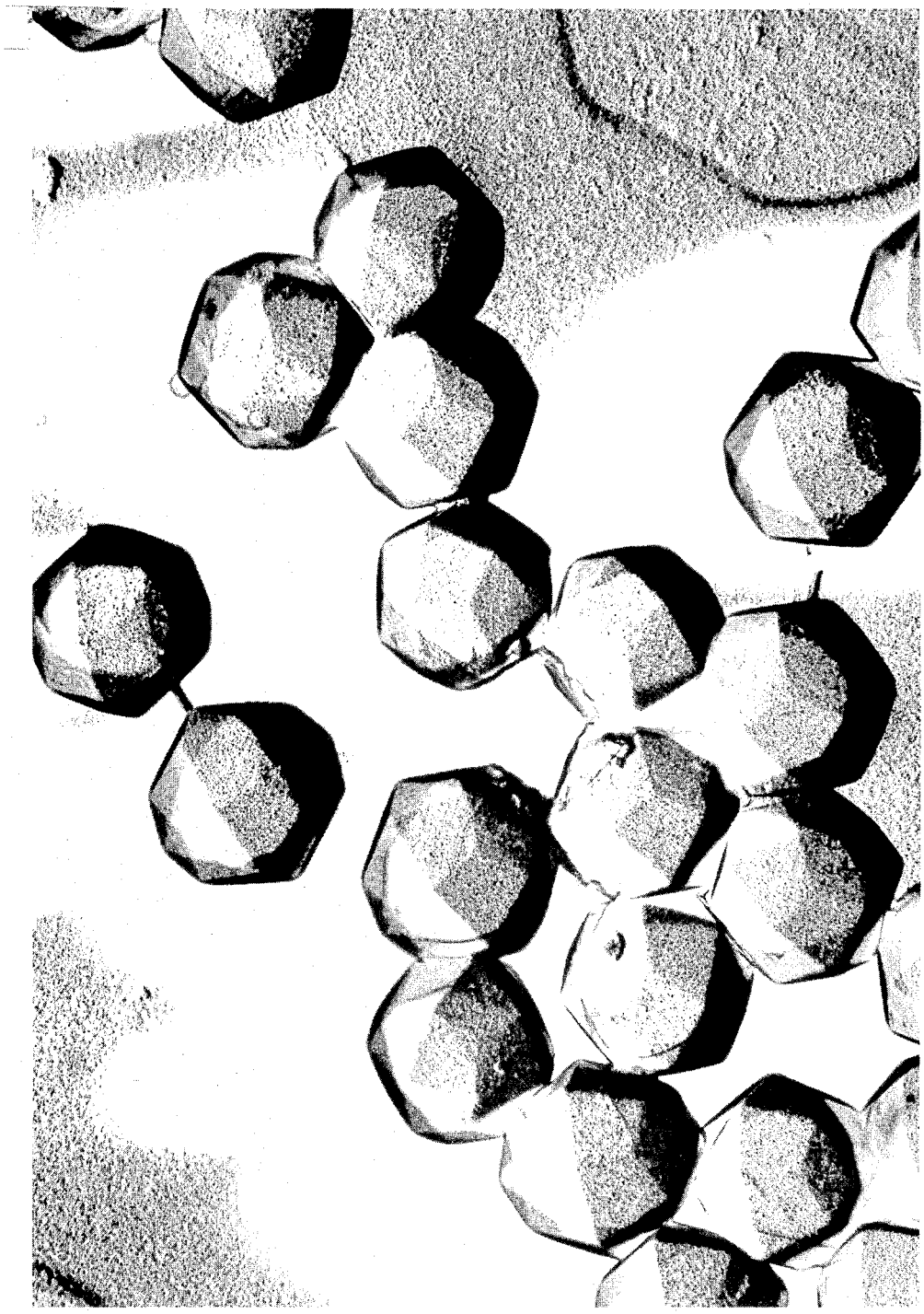

An electron micrograph of the resulting icositetrahedral emulsion grains is shown in FIG. 27. The Miller index was determined to be {211} by comparison with an accurate model of a regular {211} icositetrahedron.

TABLE I

| Angle Measurement Data | | | |
|---|---|---|---|
| | Type | Angle Between Vectors | |
| Theoretical | {211} | 33.6° | 48.2° |
| " | {311} | 50.5° | 35.1° |
| " | {322} | 19.8° | 58.0° |
| " | {411} | 60.0° | 27.3° |
| " | {433} | 13.9° | 61.9° |
| " | {511} | 66.0° | 22.2° |
| " | {522} | 43.3° | 40.8° |
| " | {533} | 24.9° | 54.5° |
| " | {544} | 10.8° | 64.0° |

| Example | Type | Halide | Growth Modifier | Angle Between Vectors | |
|---|---|---|---|---|---|
| 1 | {211} | AgBr | I | 29.2 ± 1.0° (3) | 51.3 ± 0.8° (3) |
| 2 | {211} | AgBr | II | 33.7 ± 1.3° (7) | 48.5 ± 0.8° (8) |
| 3 | {211}* | AgBr | III | — | — |
| 4 | {211} | AgBr | IV | — | 47.4 ± 1.1° (5) |
| 5 | {211} | AgBr | V | — | 50.0 ± 1.4° (4) |
| 6 | {211} | AgBr | VI | 31.0 ± 0.8° (4) | 49.5 ± 2.6° (6) |
| 7 | {211} | AgBr | VII | 34.8 ± 1.9° (6) | 47.2 ± 1.3° (9) |
| 8 | {311} | AgBr | VII | 48.2 ± 3.5° (4) | 35.4 ± 1.3° (8) |
| 9 | {311}* | AgBr | VIII | — | — |
| 10 | {311} | AgBr | IX | 49.6 ± 0.5° (5) | 36.0 ± 0.9° (8) |
| 11 | {311}* | AgBr | X | — | — |
| 12 | {533} | AgBr | XI | 24.0 ± 2.0° (4) | 53.8 ± 1.8° (8) |
| 13 | {211} | AgCl | VI | 34.8 ± 1.3° (4) | 47.2 ± 0.9° (6) |
| 14 | {522} | AgCl | I | 45.8 ± 2.7° (5) | 38.3 ± 2.4° (6) |
| 15 | {211}* | AgBrI | VI | — | — |
| 16 | {211}* | AgBrI | I | — | — |

*Determined by visual comparison with an accurate model of a regular icositetrahedron of the same Miller index

EXAMPLE 17

This example illustrates additional growth modifiers capable of producing icositetrahedral crystal faces and lists potential growth modifiers investigated, but not observed to produce icositetrahedral crystal faces.

The grain growth procedures employed were of three different types:

A. The first grain growth procedure was as follows: To a reaction vessel supplied with a stirrer was added 0.5 g of bone gelatin dissolved in 28.5 g of water. To this was added 0.05 mole of silver bromide host grain emulsion of mean grain size 0.8 μm, containing about 10 g/Ag mole gelatin, and having a total weight of 21.6 g. The emulsion was heated to 40° C., and 6.0 millimoles/Ag mole of dissolved growth modifier were added. The mixture was held for 15 min. at 40° C. The pH was adjusted to 6.0 at 40° C. The emulsion was then heated to 60° C., and the pAg was adjusted to 8.5 at 60° C. with KBr and maintained at that value during the precipitation. The pH, which shifted to 5.92 at 60° C., was held at that value thereafter. A 2.5M solution of $AgNO_3$ and a 2.5M solution of KBr were then introduced with a constant silver addition rate over a period of 125 min., consuming 0.0625 mole Ag.

B. The second grain growth procedure was as follows: To a reaction vessel supplied with a stirrer was added 27.5 mL of water. To this was added 0.05 mole of a silver bromide host grain emulsion of mean grain size 0.8 μm, containing about 10 g/Ag mole of gelatin and having a total weight of 21.6 g. The emulsion was heated to 40° C., and 3.0 millimole/initial Ag mole of dissolved growth modifier was added. The mixture was held at 40° C. for 15 min. Just prior to beginning the precipitation 3.4 millimoles of an aqueous $(NH_4)_2SO_4$ solution (1.0 mL), containing also 0.25 millimole of KBr, was added, followed by 25.9 millimoles of ammonium hydroxide (2.0 mL). The pAg was measured as 9.3 at 40° C. and was maintained at that level through-out the precipitation. At 40° C. a 2.5M solution of $AgNO_3$ was added at a constant flow rate along with a 2.5M solution of KBr, the latter being added at the rate necessary to maintain the pAg. The precipitation consumed 0.05 mole Ag over a period of 100 min. The pH was then slowly adjusted to 5.5.

In the first and second procedure cubic or octahedral host grains were employed as noted in Table I. Small samples of emulsion were withdrawn at intervals during the precipitation for electron microscope examination, any tetrahexahedral crystal faces revealed in such samples are reported in Table I.

C. The third grain growth procedure employed 7.5 millimoles of a freshly prepared very fine grain (approximately 0.02 μm) AgBr emulsion to which was added 0.09 millimole of growth modifier. In this process these very fine AgBr grains were dissolved and reprecipitated onto the host grains. The host grain emulsion contained 0.8 μm AgBr grains. A 7.5 millimole portion of the host grain emulsion was added to the very fine grain emulsion. A pH of 6.0 and pAg of 9.3 at 40° C. was employed. The mixture was stirred at 60° C. for about 19 hours.

The crystal faces presented by the host grains are as noted in Table I. Where both octahedral and cubic host grains are noted using the same growth modifier, a mixture of 5.0 millimoles cubic grains of 0.8 μm and 2.5 millimoles of octahedral grains of 0.8 μm was employed giving approximately the same number of cubic and octahedral host grains. In looking at the grains produced by ripening, those produced by ripening onto the cubic grains were readily visually distinguished, since they were larger. Thus, it was possible in one ripening process to determine the crystal faces produced using both cubic and octahedral host grains.

Differences in individual procedures are indicated by footnote. The {hll} surface column of Table II refers to those surfaces which satisfy the definition above for icositetrahedral crystal faces.

TABLE II

| | Growth Modifier | {hll} Surfaces | Host Grains | Method |
|---|---|---|---|---|
| 1 | 5-Nitro-o-phenyl-eneguanidine nitrate | None | cubic | C |
| 2 | Citric acid, trisodium salt | None | cubic | C |
| 3 | 5-Nitroindazole | None | cubic | C |
| | | None | octahedral | C |
| 4 | 1-Phenyl-5-mercaptotetrazole | None | octahedral (1) (2) | A |
| 5 | 5-Bromo-1,2,3-benzotriazole | None | cubic | A |
| | | None | octahedral | C |
| 6 | 6-Chloro-4-nitro-1,2,3-benzotriazole | None | cubic | C |
| | | None | octahedral | C |

TABLE II-continued

| | Growth Modifier | {hll} Surfaces | Host Grains | Method |
|---|---|---|---|---|
| 7 | 5-Chloro-1,2,3-benzotriazole | None | cubic | C |
| | | None | octahedral | C |
| 8 | 5-Chloro-6-nitro-1,2,3-benzotriazole | None | cubic | C |
| 9 | 3-Methyl-1,3-benzothiazolium p-toluenesulfonate | None | cubic | C |
| | | None | octahedral | C |
| 10 | 4-Hydroxy-6-methyl-1,3,3a,7-tetraazaindene, sodium salt | None | octahedral | C |
| 11 | 4-Hydroxy-6-methyl-2-methylmercapto-1,3,3a,7-tetraazaindene | {211} | cubic | A |
| 12 | 2,6,8-Trichloropurine | None | cubic | C |
| | | None | octahedral | C |
| 13 | 2-Mercapto-1-phenyl-benzimidazole | None | cubic | C |
| | | None | octahedral | C |
| 14 | 3,6-Dimethyl-4-hydroxy-1,2,3a,7-tetraazaindene | None | cubic | C |
| | | None | octahedral | C |
| 15 | 5-Carboxy-4-hydroxy-1,3,3a,7-tetraazaindene | None | cubic | C |
| | | None | octahedral | C |
| 16 | 5-Carbethoxy-4-hydroxy-1,3,3a,7-tetraazaindene | None | cubic | A |
| 17 | 5-Imino-3-thiourazole | None | cubic | C |
| | | None | octahedral | C |
| 18 | 2-Formamidinothiomethyl-4-hydroxy-6-methyl-1,3,3a,7-tetraazaindene | None | cubic | C |
| | | None | octahedral | C |
| 19 | 4-Hydroxy-2-β-hydroxyethyl-6-methyl-1,3,3a,7-tetraazindene | None | cubic | C |
| | | None | octahedral | C |
| 20 | 6-Methyl-4-phenyl-mercapto-1,3,3a,7-tetraazaindene | None | cubic | C |
| | | None | octahedral | C |
| 21 | 2-Mercapto-5-phenyl-1,3,4-oxadiazole | None | cubic | C |
| | | None | octahedral | C |
| 22 | 1,10-Dithia-4,7,13,16-tetraoxacyclooctadecane | None | cubic | C |
| | | None | octahedral | C |
| 23 | 2-Mercapto-1,3-benzothiazole | None | cubic | C |
| | | None | octahedral | C |
| 24 | 6-Nitrobenzimidazole | None | cubic (3) | A |
| 25 | 5-Methyl-1,2,3-benzotriazole | None | cubic | C |
| | | None | octahedral | C |
| 26 | Urazole | None | cubic | C |
| | | None | octahedral | C |
| 27 | 4,5-Dicarboxy-1,2,3-triazole, monopotassium salt | None | cubic | C |
| | | None | octahedral | C |
| 28 | 3-Mercapto-1,2,4-triazole | None | cubic | C |
| | | None | octahedral | C |
| 29 | 2-Mercapto-1,3-benzoxazole | None | cubic | C |
| | | None | octahedral | C |
| 30 | 6,7-Dihydro-4-methyl-6-oxo-1,3,3a,7-tetraazaindene | None | cubic | C |
| | | None | octahedral | C |
| 31 | 1,8-Dihydroxy-3,6-dithiaoctane | None | cubic | C |
| | | None | octahedral | C |
| 32 | 5-Ethyl-5-methyl-4-thiohydantoin | None | cubic | A |
| 33 | Ethylenethiourea | None | cubic | A |
| | | None | octahedral | A |
| 34 | 2-Carboxy-4-hydroxy-6-methyl-1,3,3a,7-tetraazaindene | None | cubic | C |
| | | None | octahedral | C |
| 35 | Dithiourazole | None | cubic | C |
| | | None | octahedral | C |
| 36 | 2-Mercaptoimidazole | {533} | cubic | A |
| 37 | 5-Carbethoxy-3-(3-carboxypropyl)-4-methyl-4-thiazoline-2-thione | None | cubic | C |
| | | None | octahedral | C |
| 38 | Dithiourazolemethyl vinyl ketone monoadduct | None | cubic | C |
| | | None | octahedral | C |
| 39 | 1,3,4-Thiadiazolidine-2,5-dithione | None | cubic | C |
| | | None | octahedral | C |
| 40 | 4-Carboxymethyl-4-thiazoline-2-thione | None | cubic | C |
| | | None | octahedral | C |
| 41 | 1-Phenyl-5-selenol-tetrazole, potassium salt | None | octahedral (1) (2) | A |
| 42 | 1-Carboxymethyl-5H—4-thiocyclopenta-(d)uracil | None | octahedral | C |
| | | None | cubic | C |
| 43 | 5-Bromo-4-hydroxy-6-methyl-1,3,3a,7-tetraazaindene | None | cubic | A |
| 44 | 2-Carboxymethylthio-4-hydroxy-6-methyl-1,3,3a,7-tetraazaindene | None | cubic | C |
| 45 | 1-(3-Acetamidophenyl)-5-mercaptotetrazole, sodium salt | None | octahedral | C |
| 46 | 5-Carboxy-6-hydroxy-4-methyl-2-methylthio-1,3,3a,7-tetraazaindene | None | octahedral | C |
| 47 | 5-Carboxy-4-hydroxy-6-methyl-2-methylthio-1,3,3a,7-tetraazaindene | None | cubic | A |
| 48 | 1-Thiocaprolactam | None | cubic (1) | A |
| 49 | 4-Hydroxy-2-methylthio-1,3,3a,7-tetraazaindene | None | cubic | A |
| 50 | 4-Hydroxy-2,6-dimethyl-1,3,3a,7-tetraazaindene | None | octahedral (4) | A |
| 51 | Pyridine-2-thiol | None | octahedral (8) | A |
| 52 | 4-Hydroxy-6-methyl-1,2,3a,7-tetraazaindene | None | octahedral (4) | A |
| 53 | 7-Ethoxycarbonyl-6-methyl-2-methylthio-4-oxo-1,3,3a,7-tetraazaindene | {311} | cubic | C |
| 54 | 1-(4-Nitrophenyl)-5-mercaptotetrazole | None | octahedral | A |

TABLE II-continued

| | Growth Modifier | {hll} Surfaces | Host Grains | Method |
|---|---|---|---|---|
| 55 | 4-Hydroxy-1,3,3a,7-tetraazaindene | None | (1) (2) octahedral (4) | A |
| 56 | 2-Methyl-5-nitro-1H—benzimidazole | {211} | octahedral | A |
| 57 | Benzenethiol | None | octahedral (1) (8) | A |
| 58 | Melamine | None | cubic | C |
| | | None | octahedral | C |
| 59 | 1-(3-Nitrophenyl)-5-mercaptotetrazole | None | cubic | C |
| | | None | octahedral | C |
| 60 | Pyridine-4-thiol | None | octahedral (1) | A |
| 61 | 4-Hydroxy-6-methyl-3-methylthio-1,2,3a,7-tetraazaindene | None | cubic | A |
| 62 | 4-Methoxy-6-methyl-1,3,3a,7-tetraazaindene | None | octahedral | A |
| 63 | 4-Amino-6-methyl-1,3,3a,7-tetraazaindene | None | octahedral | A |
| 64 | 4-Methoxy-6-methyl-2-methylthio-1,3,3a,7-tetraazaindene | None | cubic | A |
| 65 | 4-Hydroxy-6-methyl-1,2,3,3a,7-pentaazaindene | None | octahedral | A |
| 66 | 3-Carboxymethylrhodanine | None | cubic (1) | A |
| 67 | 1H—Benzimidazole | None | octahedral | A |
| 68 | 4-Nitro-1H—benzimidazole | None | octahedral | A |
| 69 | 3-Ethyl-5-[(3-ethyl-2-benzoxazolinylidene)ethylidene]-4-phenyl-2-thioxo-3-thiazolinium iodide | None | cubic | C |
| | | None | octahedral | C |
| 70 | 3-Ethyl-5-(4-methyl-2-thioxo-3-thiazolin-5-ylidenemethyl)rhodanine | None | cubic | C |
| | | None | octahedral | C |
| 71 | 3-Isopropyl-[(3-ethyl-2-benzothiazolidinylidene)ethylidene]rhodanine | None | cubic | B |
| 72 | 3,3'-Diethylthiacyanine p-toluene sulfonate | None | cubic (5) | A |
| 73 | 3-Ethyl-5-(3-ethyl-2-benzothiazolinylidene)rhodanine | {211} | cubic (5) | A |
| 74 | 3-Ethyl-5-(3-ethyl-2-benzothiazolinylidene)-2-thio-2,4-oxazolidinedione | None | cubic (5) | A |

TABLE II-continued

| | Growth Modifier | {hll} Surfaces | Host Grains | Method |
|---|---|---|---|---|
| | 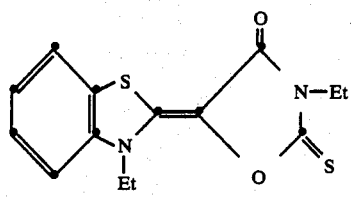 | | | |
| 75 | 5-(3-Ethyl-2-benzothiazolinylidene)-1,3-diphenyl-2-thiohydantoin | None<br>None | cubic<br>octahedral | C<br>C |
| | 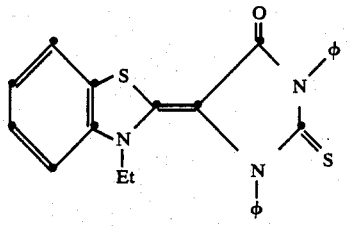 | | | |
| 76 | 3-Ethyl-5-(3-ethyl-2-benzoxazolinylidene)rhodanine | None | cubic (5) | A |
| | 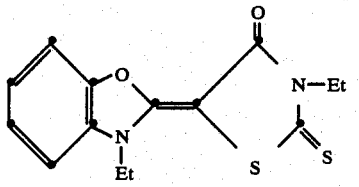 | | | |
| 77 | 3-Methyl-4-[(1,3,3-trimethyl-1(H)—2-indolylidene)ethylidene]-1-phenyl-2-pyrazolin-5-one | None<br>None | cubic<br>octahedral | C<br>C |
| | 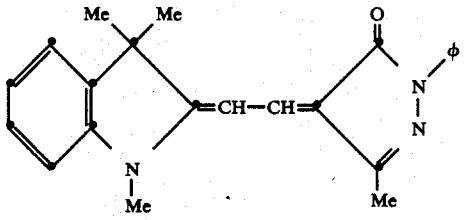 | | | |
| 78 | 5-(1,3-Dithiolan-2-ylidene)-3-ethylrhodanine | {322} | cubic (5) | A |
| | 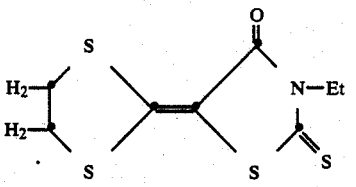 | | | |
| 79 | 5-(5-Methyl-3-propyl-2-thiazolinylidene)-3-propylrhodanine | {311} | cubic (5) | A |
| | 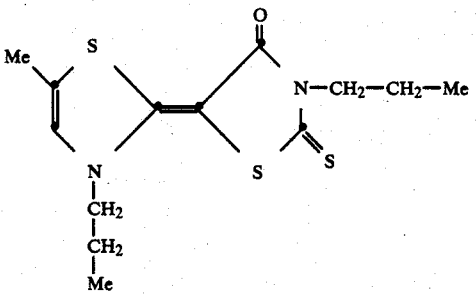 | | | |
| 80 | 3-Carboxymethyl-5-[(3-ethyl-2-benzoxazolinylidene)ethylidene]rhodanine | None | cubic | C |

TABLE II-continued

| | Growth Modifier | {hll} Surfaces | Host Grains | Method |
|---|---|---|---|---|
| | 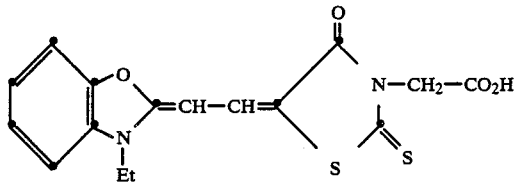 | None | octahedral | C |
| 81 | 5-(3-Ethyl-2-benzothiazolinylidene)-3-β-sulfoethylrhodanine 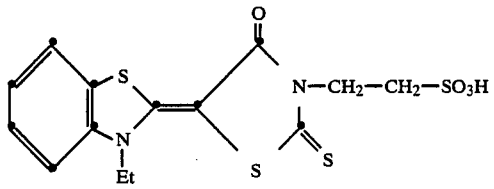 | {211} | cubic (5) | A |
| 82 | 5-Anilinomethylene-3-(2-sulfoethyl)rhodanine 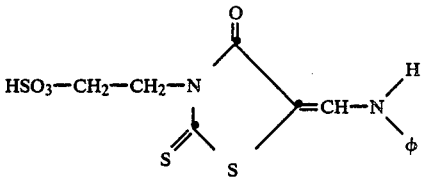 | {311} | cubic (6) | A |
| 83 | 3-(1-Carboxyethyl)-5-[(3-ethyl-2-benzoxazolinylidene)ethylidene]rhodanine 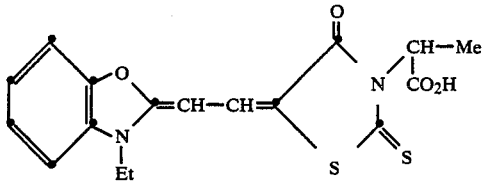 | {311} | cubic | B |
| 84 | 3-(1-Carboxyethyl)-5-[(3-ethyl-2-benzothiazolinylidene)ethylidene]rhodanine 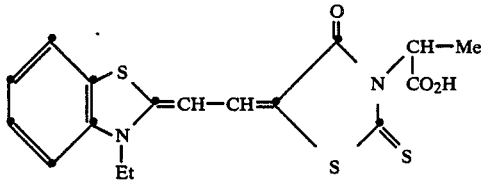 | None | cubic | B |
| 85 | 3-(3-Carboxypropyl)-5-[(3-ethyl-2-benzoxazolinylidene)ethylidene]rhodanine 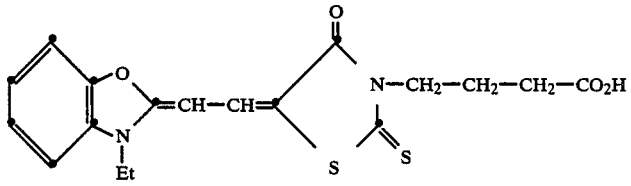 | Yes | cubic | B |
| 86 | 3-(2-Carboxyethyl)-5-[(3-ethyl-2-benzothiazolinylidene)ethylidene]rhodanine 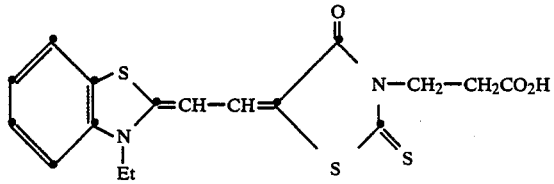 | None<br>None | cubic<br>octahedral | C<br>C |
| 87 | 3-Carboxymethyl-5-[(3-methyl-2-thiazolidinylidene)isopropylidene]rhodanine | None | cubic | B |

TABLE II-continued

| | Growth Modifier | {hll} Surfaces | Host Grains | Method |
|---|---|---|---|---|
| | 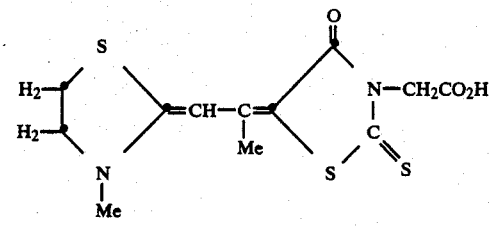 | | | |
| 88 | 3-Carboxymethyl-5-[(3-methyl-2-thiazolidinylidene)ethylidene]rhodanine | None | cubic | B |
| | 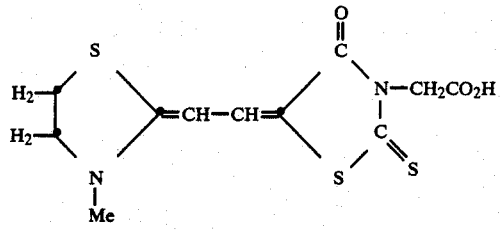 | | | |
| 89 | 3-Carboxymethyl-5-{[3-(2-carboxyethyl)-2-thiazolidinylidene]ethylidene}rhodanine | None | cubic | B |
| | 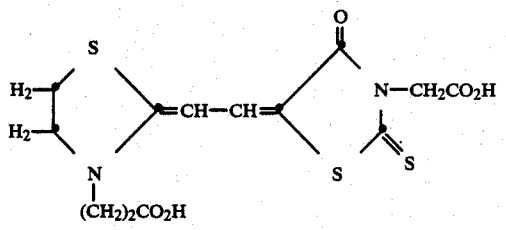 | | | |
| 90 | 3-(α-Carboxybenzyl)-5-[(3-ethyl-2-benzoxazolinylidene)ethylidene]rhodanine | None | cubic | B |
| | 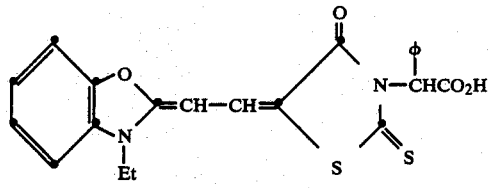 | | | |
| 91 | 3-(α-Carboxybenzyl)-5-[(3-methyl-2-thiazolidinylidene)ethylidene]rhodanine | None | cubic | B |
| | 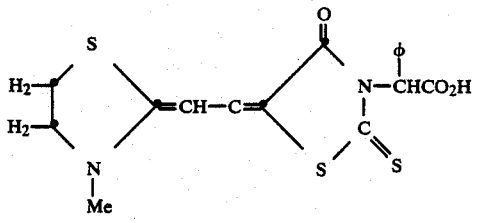 | | | |
| 92 | 1-Ethyl-4-(1-ethyl-4-pyridinylidene)-3-phenyl-2-thiohydantoin | None<br>None | cubic<br>octahedral | C<br>C |
| | 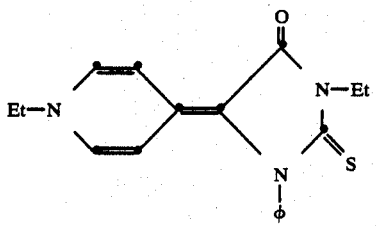 | | | |
| 93 | Anhydro-3-ethyl-9-methyl-3′-(3-sulfobutyl)thiacarbocyanine hydroxide | None | cubic | C |

TABLE II-continued

| | Growth Modifier | {hll} Surfaces | Host Grains | Method |
|---|---|---|---|---|
| | 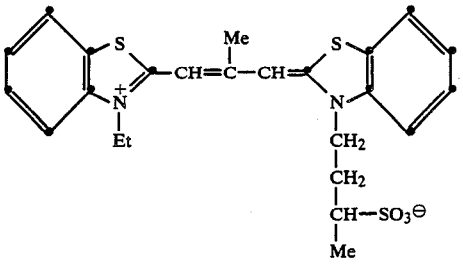 | None | octahedral | C |
| 94 | 3-Ethyl-5-[1-(4-sulfobutyl)-4-pyridinylidene]rhodanine, piperidine salt 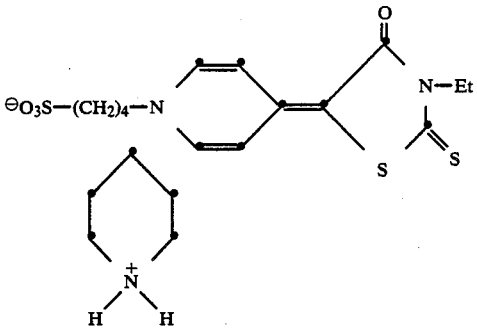 | None<br>None | cubic<br>octahedral | C<br>C |
| 95 | 5-(3-Ethyl-2-benzothiazolinylidene)-1-methoxycarbonylmethyl-3-phenyl-2-thiohydantoin 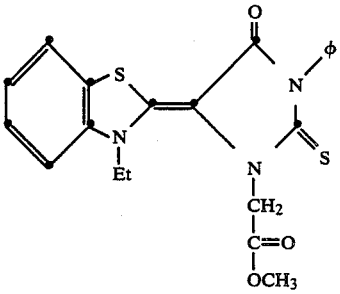 | None<br>None | cubic<br>octahedral | C<br>C |
| 96 | 1,1',3,3'-Tetraethylimidazo(4,5-b)quinoxalinocarbocyanine p-toluenesulfonate 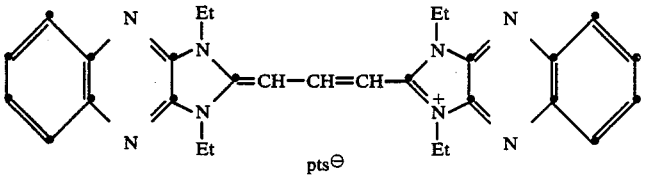 | None | cubic | B |
| 97 | 3-(2-Carboxyethyl)-5-(1-ethyl-4-pyridinylidene)rhodanine 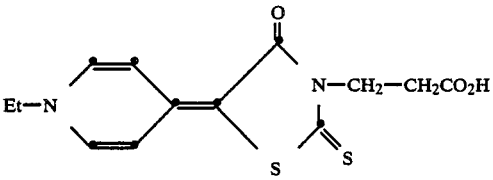 | {311} | cubic (1) (2) | A |
| 98 | 3-Carboxymethyl-5-{[3-(3-sulfopropyl)-2-thiazolidinylidene]ethylidene}rhodanine, sodium salt | None | cubic (1) | A |

TABLE II-continued

| | Growth Modifier | {hll} Surfaces | Host Grains | Method |
|---|---|---|---|---|
| | 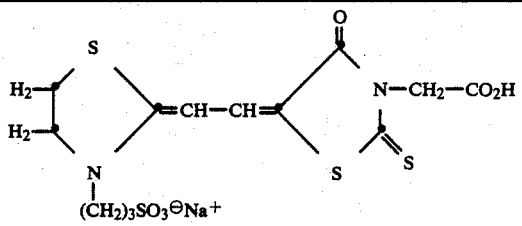 | | | |
| 99 | 3-(1-Carboxyethyl)-5-{[3-(3-sulfopropyl)-2-thiazolidinylidene]ethylidene}rhodanine, sodium salt | None | cubic | B |
| | 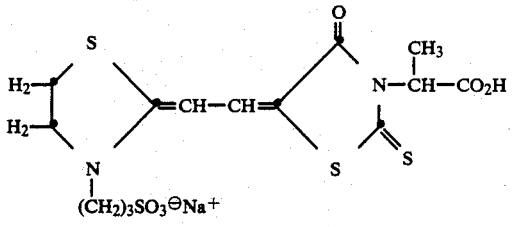 | | | |
| 100 | 3-(3-Carboxypropyl)-5-{[3-(3-sulfopropyl)-2-thiazolidinylidene]ethylidene}rhodanine, sodium salt | None | cubic (7) | A |
| | 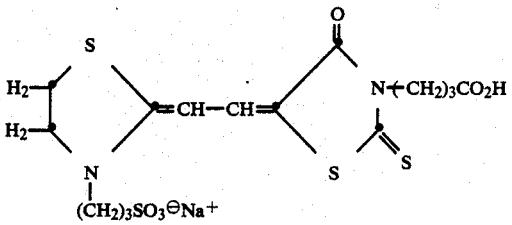 | | | |
| 101 | 3-(2-Carboxyethyl)-5-{[3-(3-sulfopropyl)-2-thiazolidinylidene]ethylidene}rhodanine, sodium salt | None<br>None | cubic<br>octahedral | C<br>C |
| | 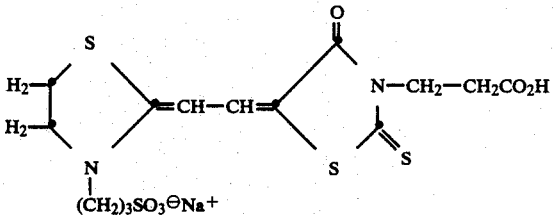 | | | |
| 102 | 3-Carboxymethyl-5-(2-pyrrolino-1-cyclopenten-1-ylmethylene)rhodanine, sodium salt | {211} | octahedral | A |
| | 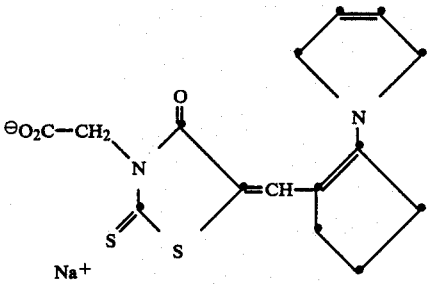 | | | |
| 103 | 3-Ethyl-5-(3-methyl-2-thiazolidinylidene)rhodanine | {211} | cubic (5) | A |
| | 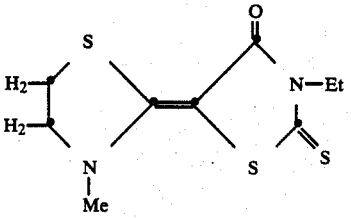 | | | |

TABLE II-continued

| | Growth Modifier | {hll} Surfaces | Host Grains | Method |
|---|---|---|---|---|
| 104 | 5-(4-Sulfophenylazo)-2-thiobarbituric acid, sodium salt 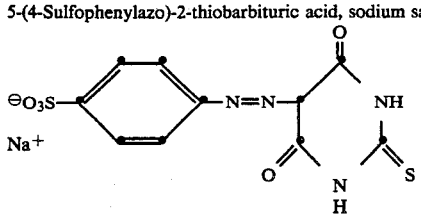 | None<br>None | cubic<br>octahedral | C<br>C |
| 105 | 3-Carboxymethyl-5-(2,6-dimethyl-4(H)—pyran-4-ylidene)rhodanine 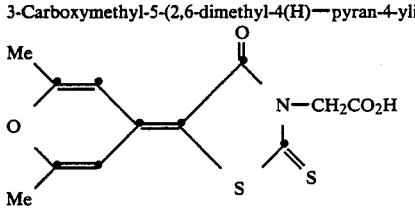 | {211} | cubic (5) | A |
| 106 | Anhydro-1,3'-bis(3-sulfopropyl)naphtho-[1,2-d]-thiazolothiacyanine hydroxide, 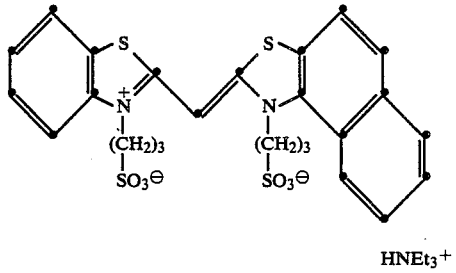 | None | cubic (5) | A |
| 107 | 3-Ethyl-5-[3-(3-sulfopropyl)-2-benzothiazolinylidene]rhodanine, triethylamine salt 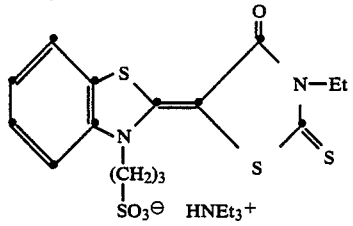 | {211} | cubic (5) | A |
| 108 | 3-Ethyl-5-[3-(3-sulfopropyl)-2-benzoxazolinylidene]rhodanine, potassium salt 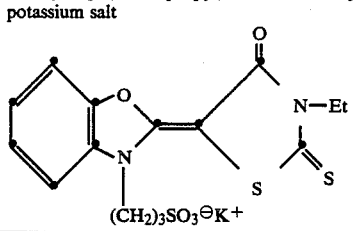 | None<br>None | cubic<br>octahedral | C<br>C |

(1) 3 mmoles of growth modifier/Ag mole of host grain emulsion was employed
(2) a pBr of 1.6 was employed
(3) 9 mmoles of growth modifier/Ag mole of host grain emulsion was employed, added in two portions
(4) 50° C. was employed instead of 60° C.
(5) 2 mmoles of growth modifier/Ag mole of host grain emulsion was employed
(6) 1.5 mmoles of growth modifier/Ag mole of host grain emulsion was employed
(7) 4 mmoles of growth modifier/Ag mole of host grain emulsion was employed
(8) a pBr of 2.3 was employed

COMPARATIVE EXAMPLE 18

The purpose of this comparative example is to report the result of adding 6-nitrobenzimidazole to a reaction vessel prior to the precipitation of silver bromide, as suggested by Wulff et al U.S. Pat. No. 1,696,830.

A reaction vessel equipped with a stirrer was charged with 0.75 g of deionized bone gelatin made up to 50 g with water. 6-Nitrobenzimidazole, 16.2 mg (0.3 weight % based on the Ag used), dissolved in 1 mL of methanol, was added, followed by 0.055 mole of KBr. At 70° C. 0.05 mole of a 2M solution of $AgNO_3$ was added at a uniform rate over a period of 25 min. The grains formed were relatively thick tablets showing {111} crystal faces. There was no indication of the novel icositetrahedral crystal faces of the invention.

COMPARATIVE EXAMPLE 19

The purpose of this comparative example is to report the result of employing 4-hydroxy-6-methyl-1,3,3a,7-tetraazaindene, sodium salt during grain precipitation, as suggested by Smith *Particle Growth and Suspension*, cited above.

To 100 mL of a 3% bone gelatin solution were added simultaneously 10 mL of 1.96M $AgNO_3$ and 10 mL of 1.96M KBr at 50° C. with stirring over a period of about 20 sec. The AgBr dispersion was aged for 1 min at 50° C., then diluted to 500 mL. The dispersion was adjusted to pBr 3 with KBr.

Samples 19a and 19b

To 80 mL of $1\times10^{-3}$M KBr containing 0.4 mmole/l of 4-hydroxy-6-methyl-1,3,3a,7-tetraazaindene, sodium salt and 0.6 mmole/l of 1-dodecylquinolinium bromide was added 20 mL of the above dispersion, which was then stirred at 23° C. Samples were removed after 15 min (Sample 19a) and 60 min (Sample 19b).

Samples 19c and 19d

Samples 19c and 19d were prepared similarly as Samples 19a and 19b, respectively, except that 0.8 mmole/l of 4-hydroxy-6-methyl-1,3,3a,7-tetraazaindene and 0.6 mmole/l of 1-dodecylquinolinium bromide were used.

Examination of the grains of each of the samples revealed rounded cubic grains. No icositetrahedral crystal faces were observed.

EXAMPLE 20

Emulsion Example 20 illustrates the preparation of a ruffled tabular grain silver bromide emulsion using as a growth modifier Compound 81, 5-(3-ethyl-2-benzothiazolinylidene)-3-β-sulfoethyl rhodanine, which is known to be useful as a blue spectral sensitizing dye.

To a reaction vessel supplied with a stirrer was added 0.04 mole of a thin and high aspect ratio tabular grain AgBr emulsion of mean grain size 5.6 μm, thickness 0.10 μm containing about 20 g/Ag mole gelatin. Water was added to make the total weight 40 g. To the emulsion at 40° C. was added 4 millimole/initial Ag mole of Compound 81 dissolved in 7 mL of N,N-dimethylformamide, 3 mL water, and 2 drops of triethylamine. The emulsion was then held for 15 min at 40° C. The pH was adjusted to 6.0 at 40° C. The temperature was raised to 60° C., and the pAg adjusted to 8.5 at 60° C. with KBr and maintained at that value during the precipitation. A 2.0M solution of $AgNO_3$ was introduced at a constant rate over a period of 20 min while a 2M solution of KBr was added as needed to hold the pAg constant. A total of 0.02 mole Ag was added.

Figure 28:
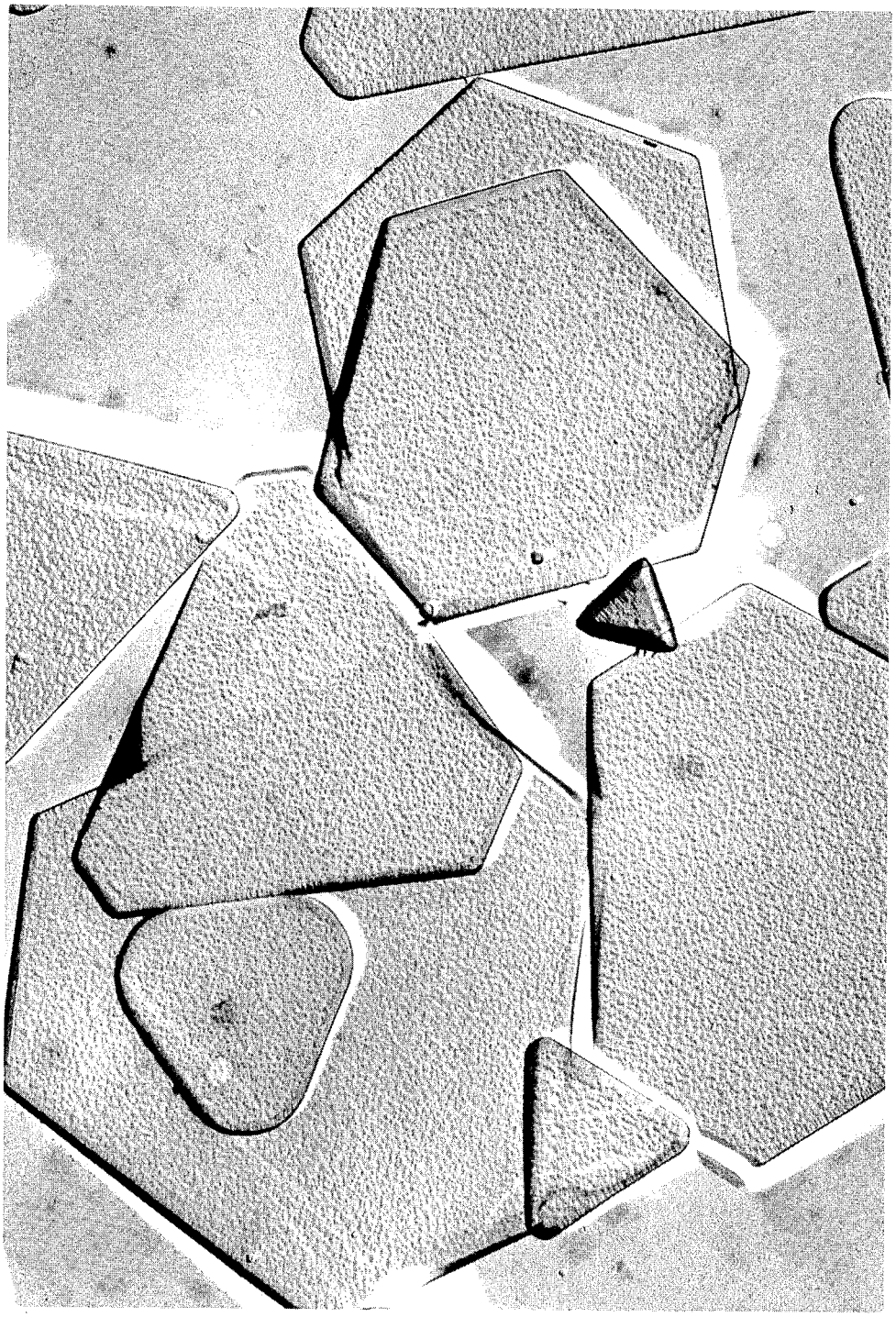
FIGS. 28, 29B, 29C, 30C, 30D, and 31A are electron micrographs of silver halide grains having icositetrahedral protrusions on host grains.

An electron micrograph of the resulting emulsion grains is shown in FIG. 28. The grain faces were uniformly covered with closely arranged, sharp, small pyramidal ruffles. This was consistent with the {211} icositetrahedral crystal faces expected from investigation of the same growth modifier employing a nontabular host grain emulsion.

EXAMPLE 21

Example 21 illustrates the preparation of ruffled tabular grain silver bromoiodide emulsions using Compound 81 as the growth modifier. Example 21A is a control showing that no ruffles are formed if the growth modifier is added following, rather than preceding, the silver halide precipitation on the host emulsion.

To a reaction vessel supplied with a stirrer was added 0.05 mole of a thin and high aspect ratio tabular grain silver bromoiodide emulsion (6 mole % I) of mean grain size 5.3 μm, thickness 0.07 μm, and containing about 40 g/Ag mole gelatin. Water was added to make the total weight 50 g. To the emulsion at 40° C. prepared according to the invention was added Compound 81 dissolved in 12 mL of N,N'-dimethylformamide-water-triethylamine mixture similar to that described in the previous example. In the control the introduction of Compound 81 was delayed until after precipitation. The emulsion was then held for 15 min. at 40° C. The pH was adjusted to 6.0 at 40° C. The temperature was raised to 60° C., and the pAg adjusted to 8.5 at 60° C. with KBr and maintained at that value during the precipitation. A 2.0M solution of $AgNO_3$ was introduced at a constant rate over a period of 74 min. while a solution that was 1.88M in KBr and 0.12M in KI was added as needed to hold the pAg constant. A total of 0.015 mole Ag was added. The details of the three experiments are shown in Table III.

TABLE III

Example 21 Precipitations

| Example | Figure No | Cpd. 81 mmole/ Ag mole | Comments |
|---|---|---|---|
| 21A | 29A | 3.0 | Control - Cpd. 81 added after precipitation |
| 21B | 29B | 3.0 | Invention |
| 21C | 29C | 4.5 | Invention |

Figure 29A:
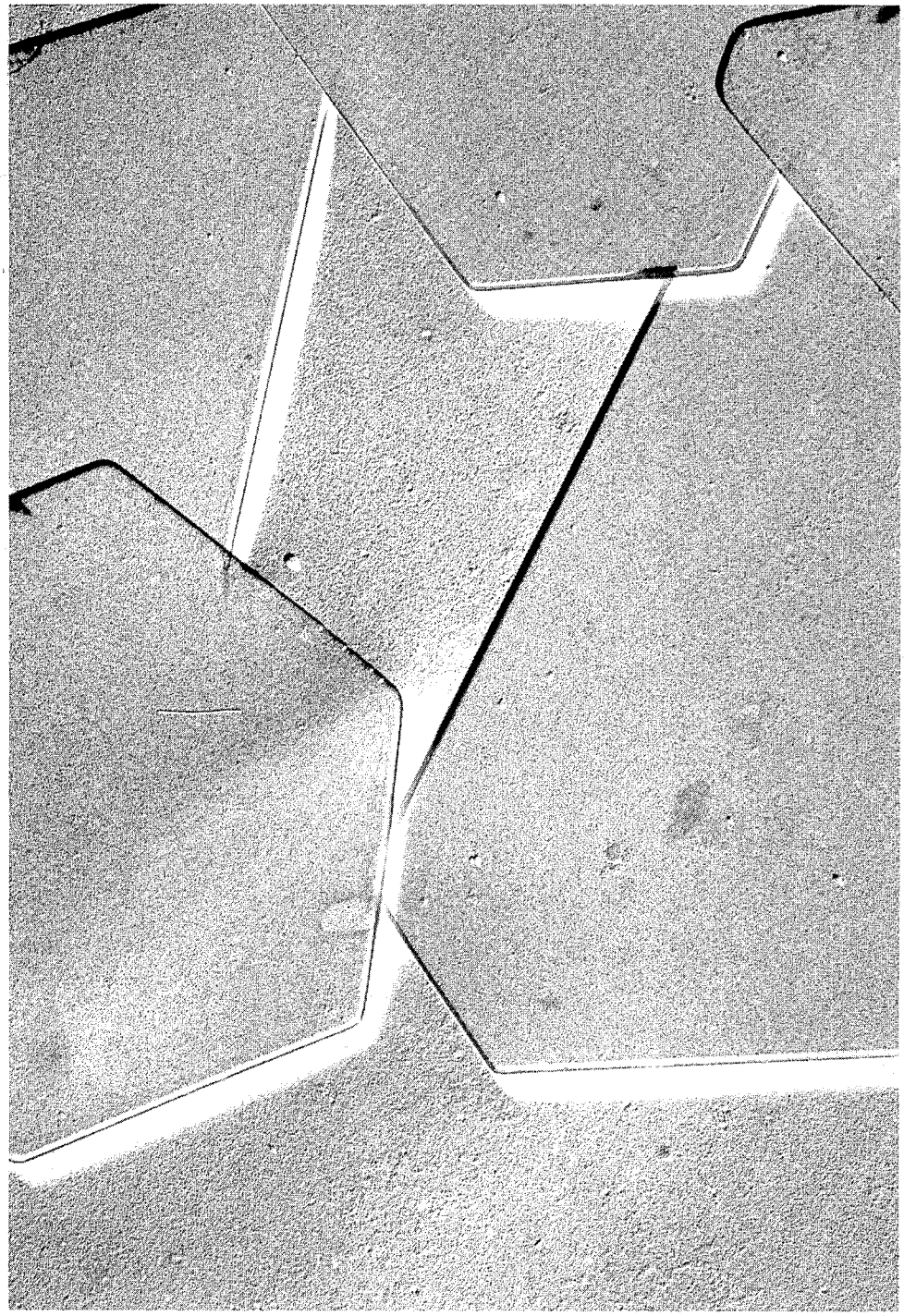
FIGS. 29A, 30A, and 30B are electron micrographs of tabular grain emulsions without icositetrahedral protrusions.
Figure 29B:
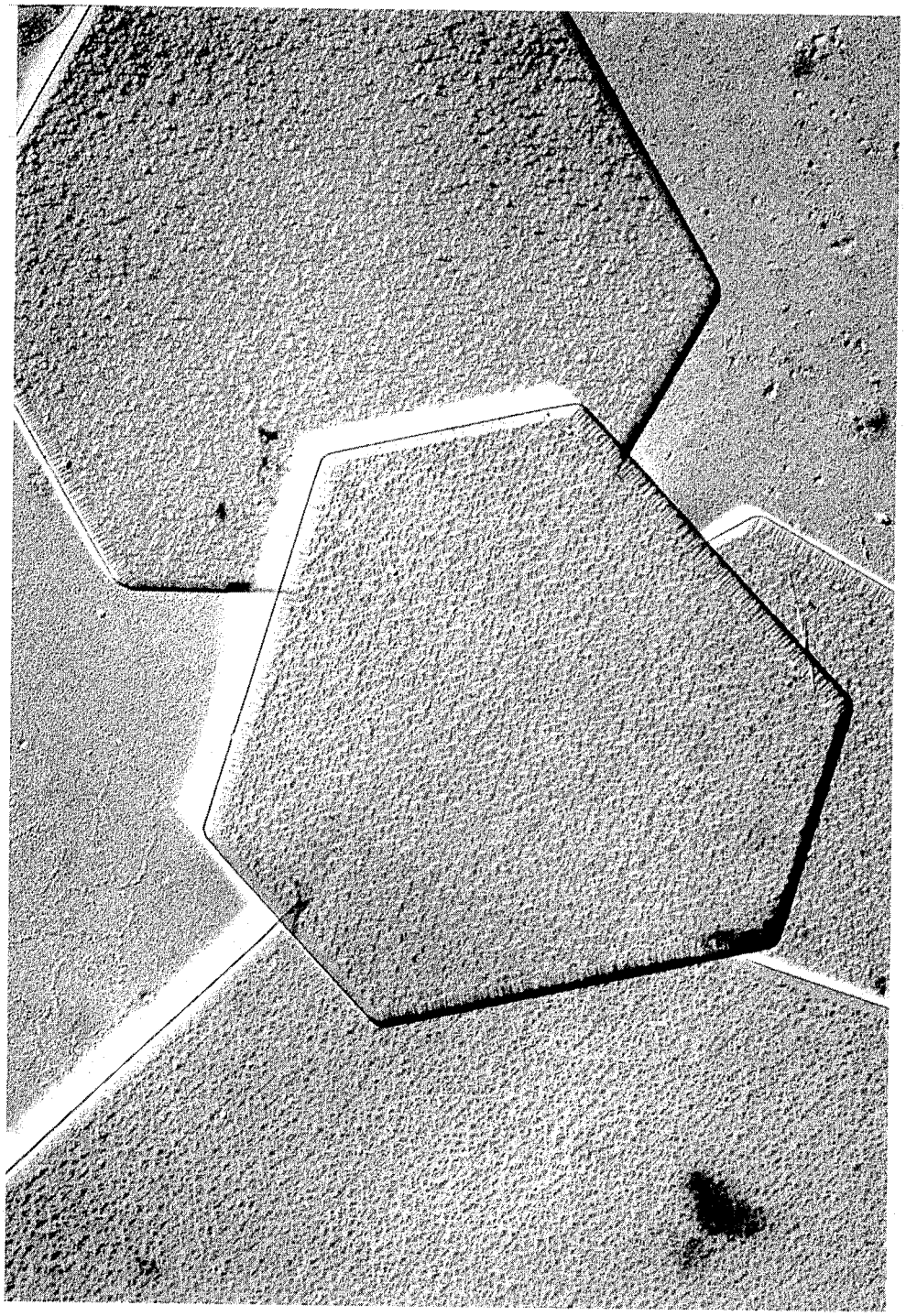
Figure 29C:
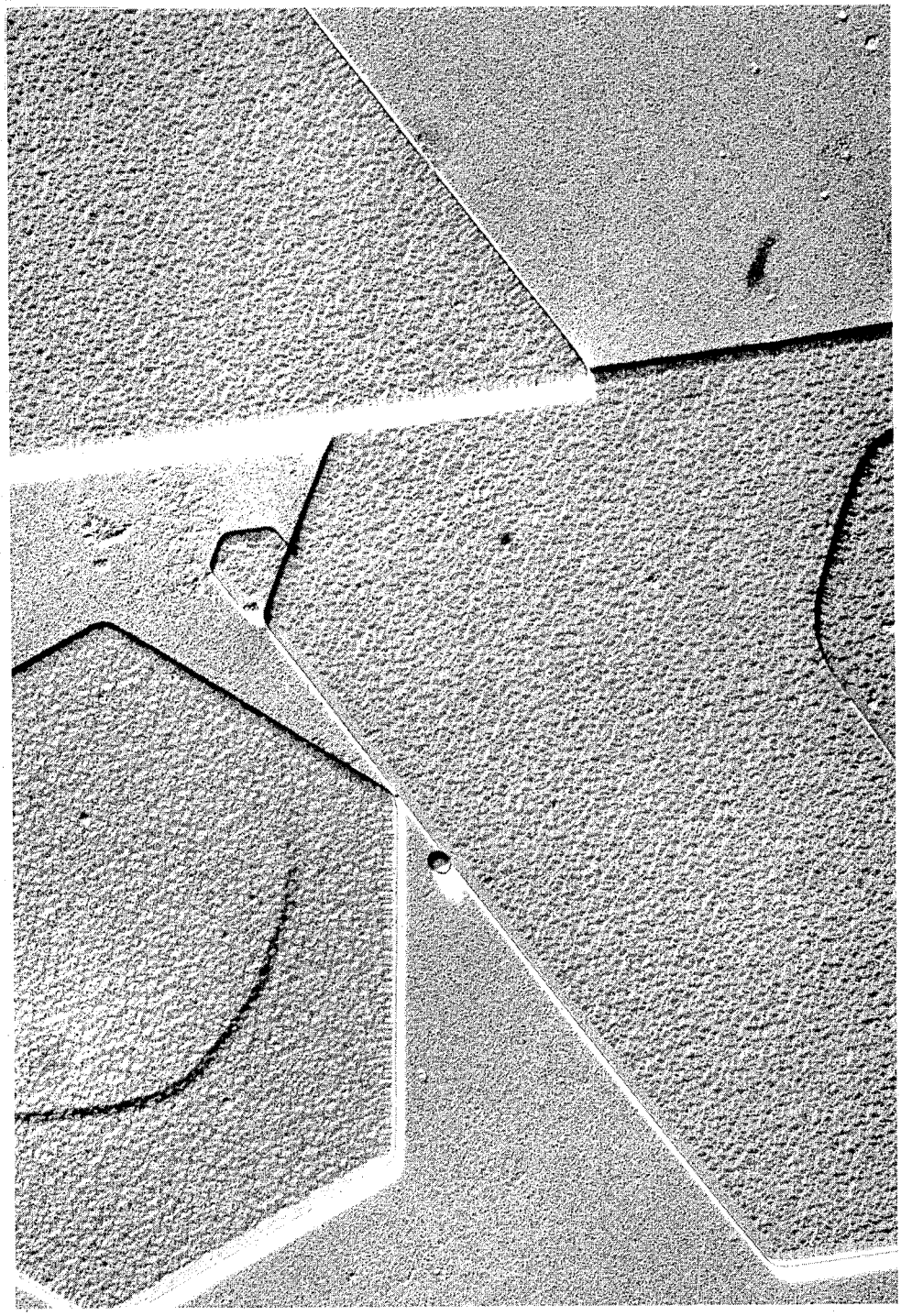

FIGS. 29A, B, and C show electron micrographs of the resulting grains. In Example 21A, addition of the growth modifier after the precipitation resulted in no growth of ruffles on the host emulsion grains. Example 21B, with the same amount of growth modifier added prior to the precipitation, produced uniform, closely arranged, small ruffles. Example 21C, with a higher level of growth modifier, produced a similar result, but with slightly better defined ruffles (pyramids).

Measurement was made of the interfacial angle of a ruffle on an electron micrograph of Example 6C in order to determine the crystallographic form. The angle between the face vectors was found to be 35°. The theoretical angle between [211] vectors is 33.6°. The form was therefore {211} icositetrahedral. This is consistent with other observations of {211} icositetrahedra being formed starting with nontabular host grains and employing Compound 81 as a growth modifier.

EXAMPLE 22

Example 22 again illustrates the preparation of ruffled tabular grain silver bromoiodide emulsions using Compound 81 (Example 20) as the growth modifier, but shows the dependence of the result on the level of growth modifier added.

The host emulsion (0.05 mole for each experiment) and the precipitation conditions were as described in Example 21. The details of the experiments are shown in Table IV.

TABLE IV

| Example 22 Precipitations | | |
|---|---|---|
| Example | Figure No | Cpd. 81 mmole/Ag mole |
| 22A | 30A | 0 |
| 22B | 30B | 0.75 |
| 22C | 30C | 1.5 |
| 22D | 30D | 3.0 |

Figure 30A:
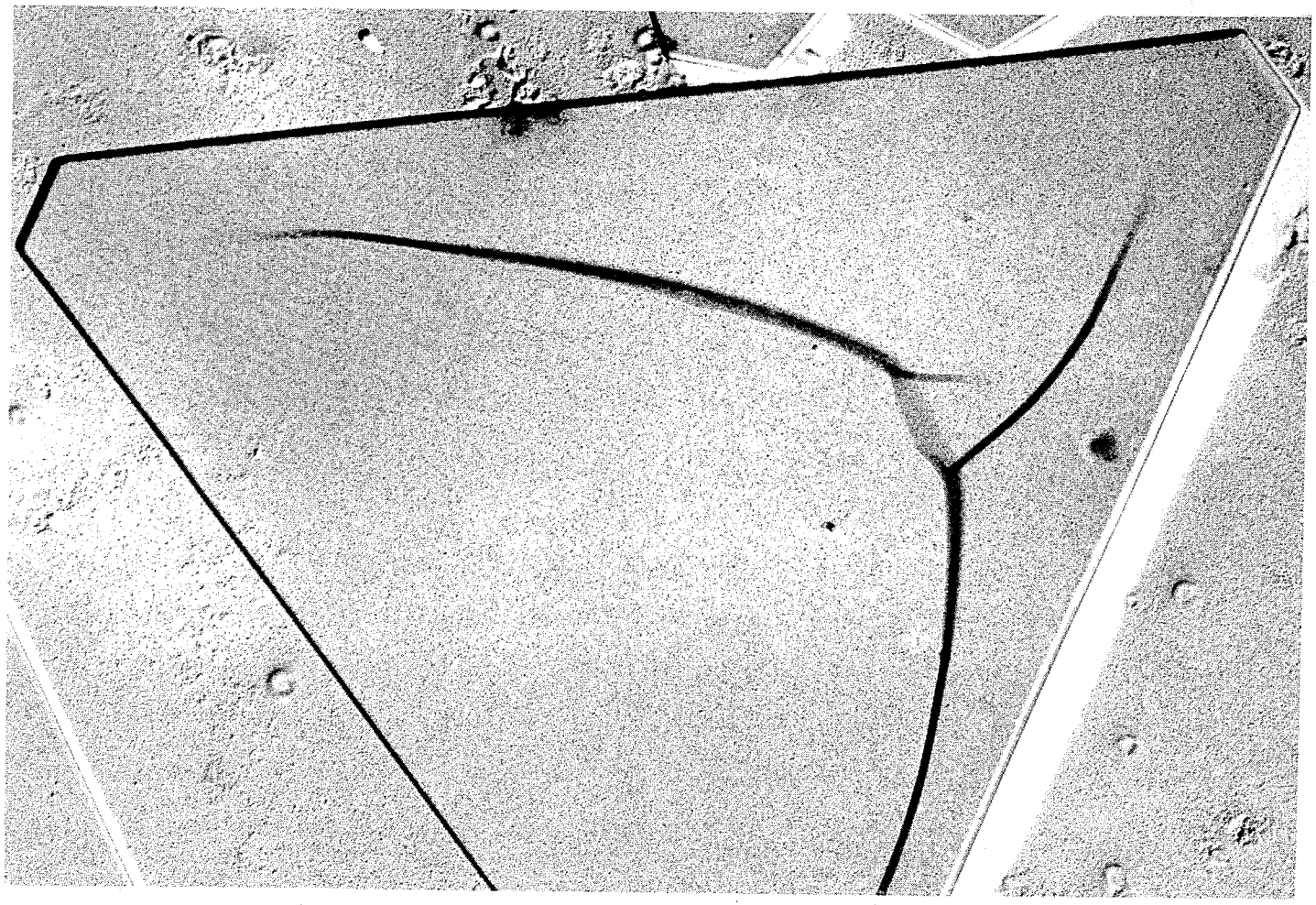
Figure 30B:
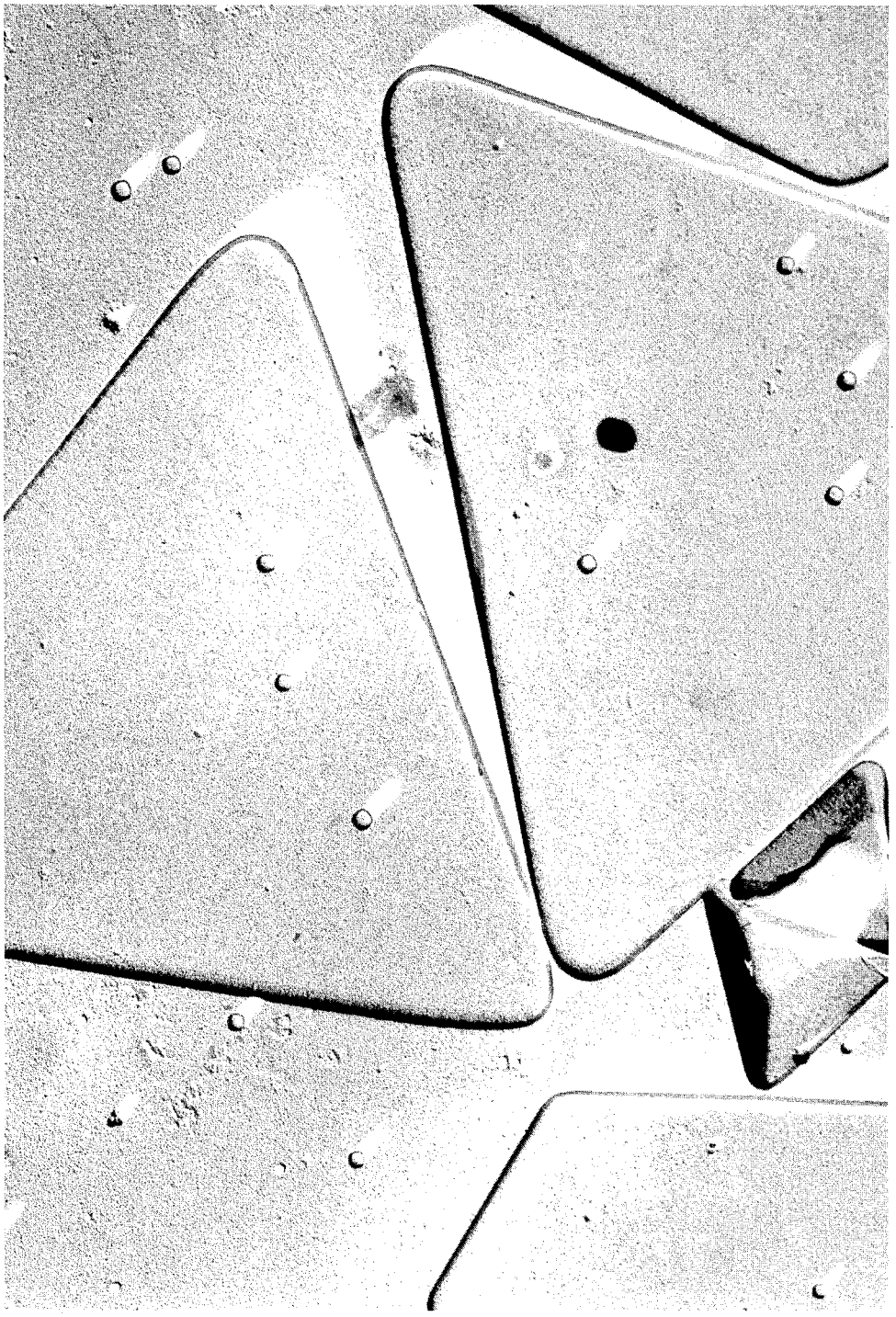
Figure 30C:
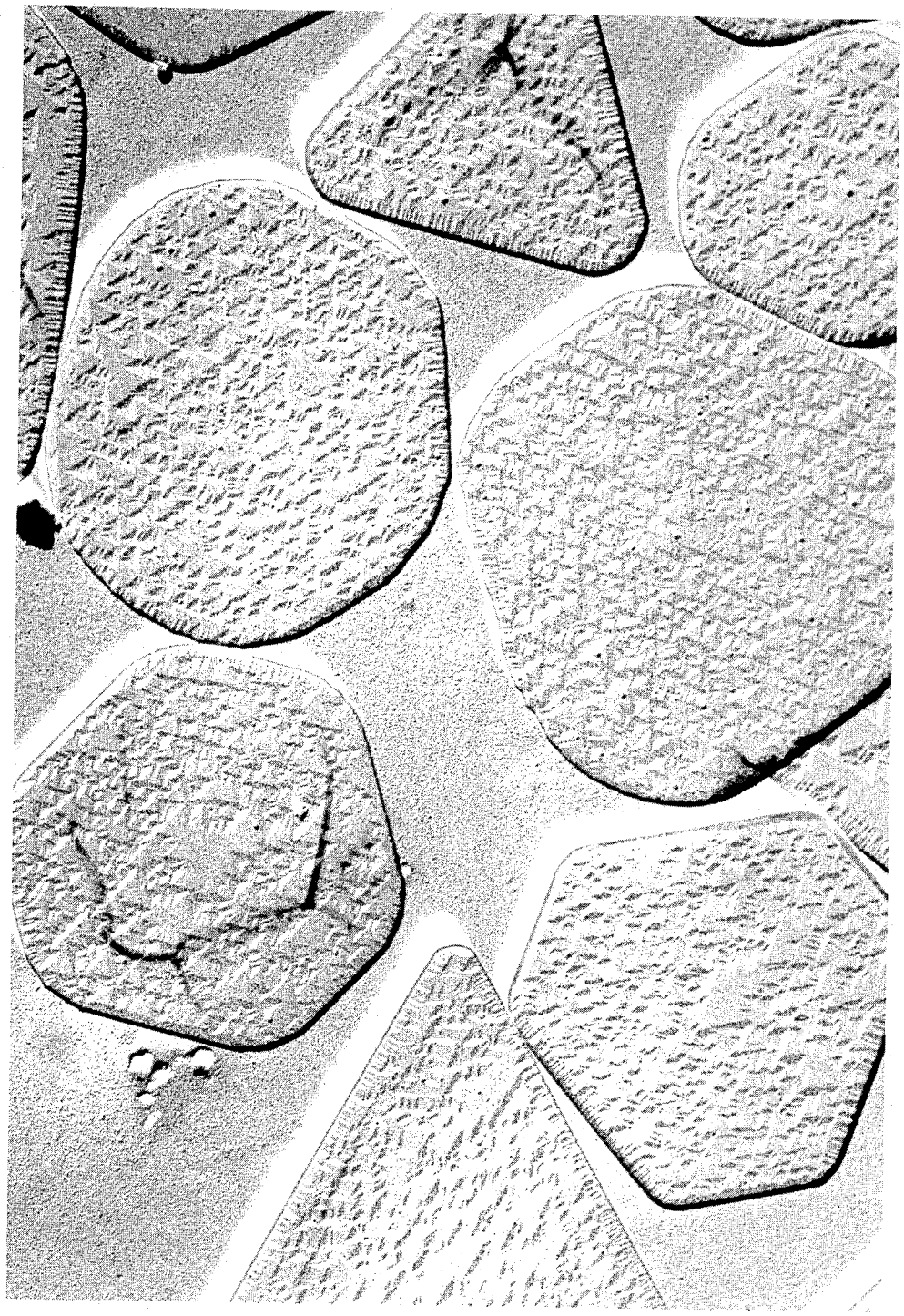
Figure 30D:
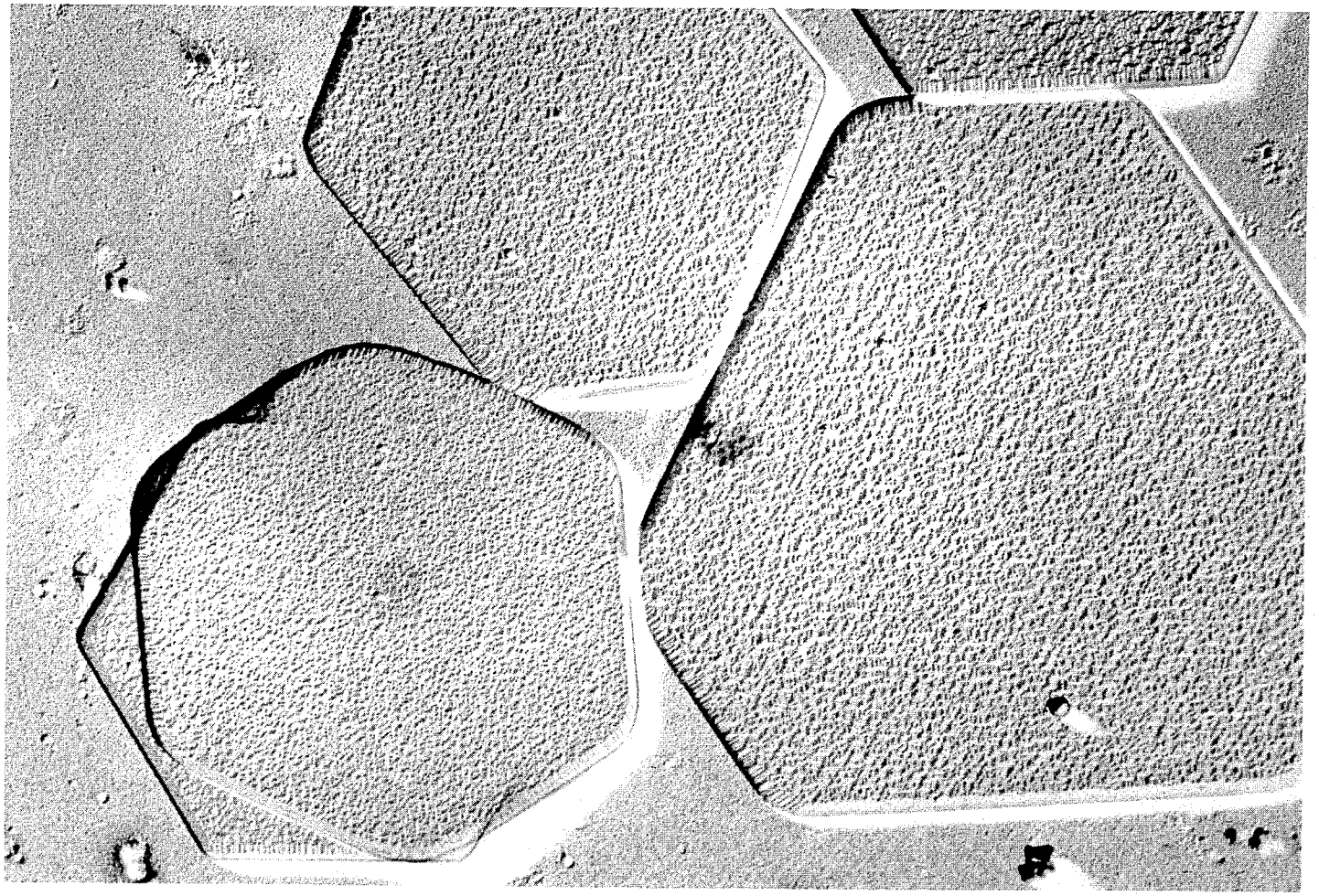

FIGS. 30A, B, C, and D are electron micrographs of the resulting emulsion grains. Example 22A, without growth modifier, and 22B, with 0.75 millimole/Ag mole, showed no ruffles. At 1.5 millimole, relatively large truncated pyramids appeared, as shown in FIG. 30C. At 3.0 millimoles Example 22D produced uniform, closely arranged, small ruffles. The pyramidal crystal faces were consistent with the {211} crystal face expected from using Compound 81 as a growth modifier in the previous examples.

EXAMPLE 23

Example 23 illustrates the preparation of ruffled cubic silver bromide grains using Compound 36, 2-mercaptoimidazole, as a growth modifier. Continued growth results in ocositetrahedral grains.

To a reaction vessel supplied with a stirrer was added 0.05 mole of a cubic regular grain silver bromide emulsion of mean grain size 0.8 μm, containing about 10 g/Ag mole gelatin. Water was added to make the total weight 50 g. To the emulsion at 40° C. was added 3.0 millimole/Ag mole of Compound 36 dissolved in 3 mL methanol. The emulsion was then held for 15 min at 40° C. The pH was adjusted to 6.0 at 40° C. The temperature was raised to 60° C., and the pAg adjusted to 8.5 at 60° C. with KBr and maintained at that value during the precipitation. A 2.5M solution of $AgNO_3$ was added at a constant rate over a period of 25 min while a 2.5M solution of KBr was added as needed to hold the pAg constant. A total of 0.0125 mole Ag was added to form Example 23A. For Example 23B the precipitation was continued for a total of 175 min, using a total of 0.0875 mole Ag. An additional 3 millimole/initial Ag mole of Compound 36 was added after 100 min of precipitation time.

Figure 31A:
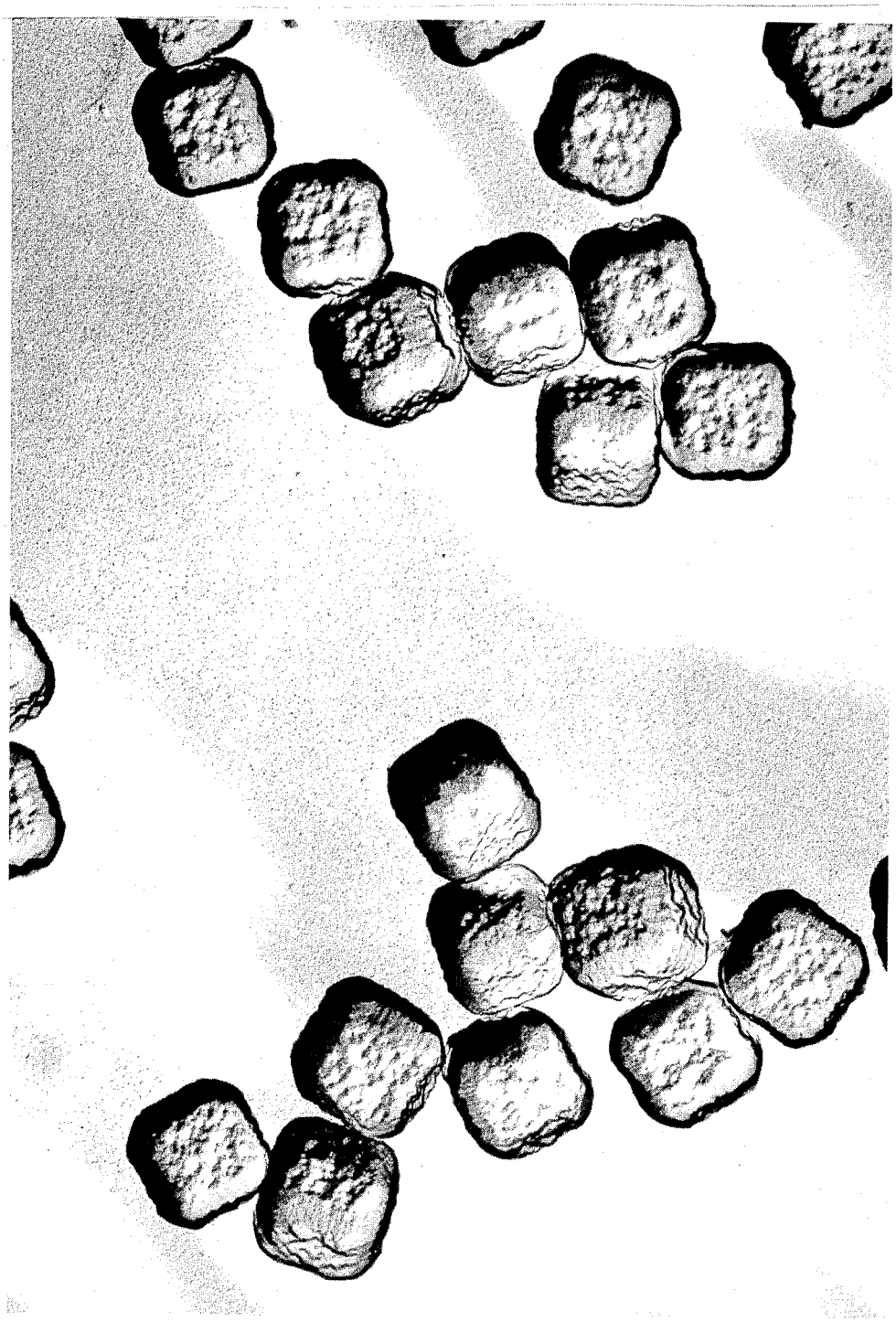
Figure 31B:
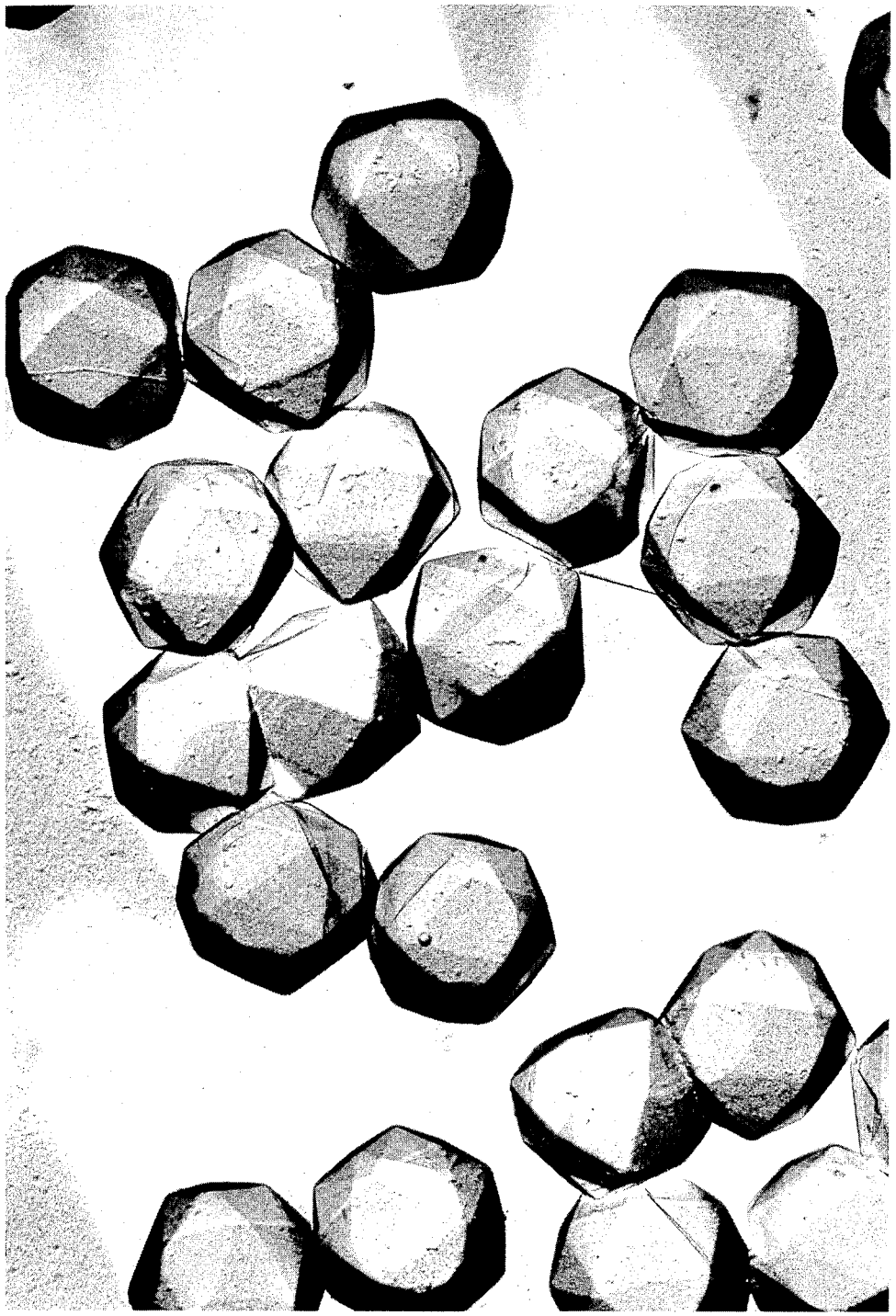

FIGS. 31A and 31B are electron micrographs of the resulting emulsion grains produced by Examples 23A and 23B, respectively. FIG. 31A shows a pattern of growths covering the crystal faces. FIG. 31B illustrates the formation of {533} icositetrahedral grains with continued precipitation.

EXAMPLE 24

This example illustrates the modification of a growth modifier adsorbed to icositetrahedral grain surfaces.

The emulsion employed was a silver bromoiodide (6 mole percent iodide) emulsion containing icositetrahedral grains, the emulsion being prepared by a procedure similar to that of Example 9, except that the host emulsion was a 0.7 μm silver bromoiodide (6 mole percent iodide) octahedral grain emulsion and the overgrowth phase consisted of silver bromoiodide (6 mole percent iodide) obtained by having an appropriate amount of NaI in the NaBr salt solution. The amount of overgrowth precipitated was 3.13 times the number of moles of host emulsion used.

The resulting icositetrahedral grain emulsion had a pink color due to the adsorption of Compound VIII, a dye employed as the growth modifier, onto the grain's surfaces. The addition of bromine water resulted in the complete disappearance of the pink color, indicating destruction of the dye, leaving a yellow color having a slight brownish tint. The yellow color is that expected for AgIBr and the brownish tint is attributed to the reaction products formed in destroying Compound VIII.

EXAMPLE 25

This example illustrates the preparation of an icositetrahedral silver bromide emulsion having the Miller index {211}, beginning an octahedral core emulsion, and using Compound 102 from Table II as a growth modifier. This example further illustrates that the growth modifier can be rendered inactive by treatment with bromine water, and a new spectral sensitizing dye can then be used.

The emulsion for this example was prepared as described for Example 1, except for the following changes: The growth modifier was 2.0 millimole/Ag mole of Compound 102, dissolved in 8 mL methanol, 5 drops triethylamine and 8 mL distilled water. The starting emulsion was 0.4 mole of a 0.7 μm AgBr octahedral emulsion containing 16 g of gelatin and a total volume of 400 g. The $AgNO_3$ solution was added at a constant rate for 140 min, resulting in 0.70 moles of additional AgBr being precipitated. The NaBr solution was twice as concentrated (5.0M) as the $AgNO_3$ solution and was added as needed to hold the pAg constant.

Carbon replica electron micrographs showed that well formed {211} icositetrahedra resulted. The resulting emulsion was divided in half.

Portion A. This half was gently centrifuged and the solid portion resuspended in 300 g of 3.7% bone gelatin solution.

Portion B. To this half at 40° C., bromine water was slowly added with good stirring until the pink color caused by the adsorbed growth modifier had disappeared as determined by dissolving small samples and examining them in white light. Note: 42 g of bromine water had been added in 13 min. After the pink color had disappeared, an additional 10 g of bromine water was slowly added. The resulting emulsion was gently centrifuged and the solid AgBr phase was resuspended in 300 g of 3.7% bone gelatin solution.

Portions A and B were further treated as listed below and coated on acetate support at 1.08 g Ag/m$^2$, 4.31 g bone gelatin/m$^2$, and 0.81 g/m$^2$ of a dispersion of the coupler 2-benzamido-5-[2-(4-butanesulfonylamidophenoxy)tetradecanamido]-4-chlorophenol, 0.14 g saponin/m$^2$ as spreading agent, and 18 mg bis(vinylsulfonylmethyl)ether/g gelatin as hardener.

| Coating | Emulsion |
|---|---|
| 1 | Portion A |
| 2 | Portion A + 0.26 mmole/mole Dye A |
| 3 | Portion A heated 15 min at 70° C. with 1.2 mg/mole sodium thiosulfate and 0.4 mg/mole potassium chloroaurate |
| 4 | Portion B + 0.26 mmole/mole Dye A |
| 5 | Portion B heated 15 min at 70° C. with 3.6 mg/mole sodium thiosulfate and 1.2 mg/mole potassium chloroaurate |
| 6 | Portion B heated 15 min at 70° C. with 3.6 mg/mole sodium thiosulfate and 1.2 mg/mole |

-continued

| Coating | Emulsion |
|---|---|
| | potassium chloroaurate + 0.26 mmole/mole Dye A |

Dye A is a red spectral sensitizing dye having the formula:

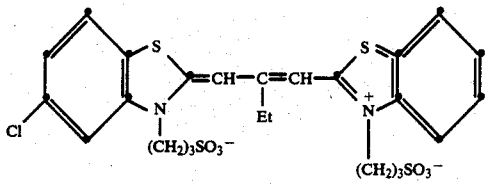

Figure 32A:
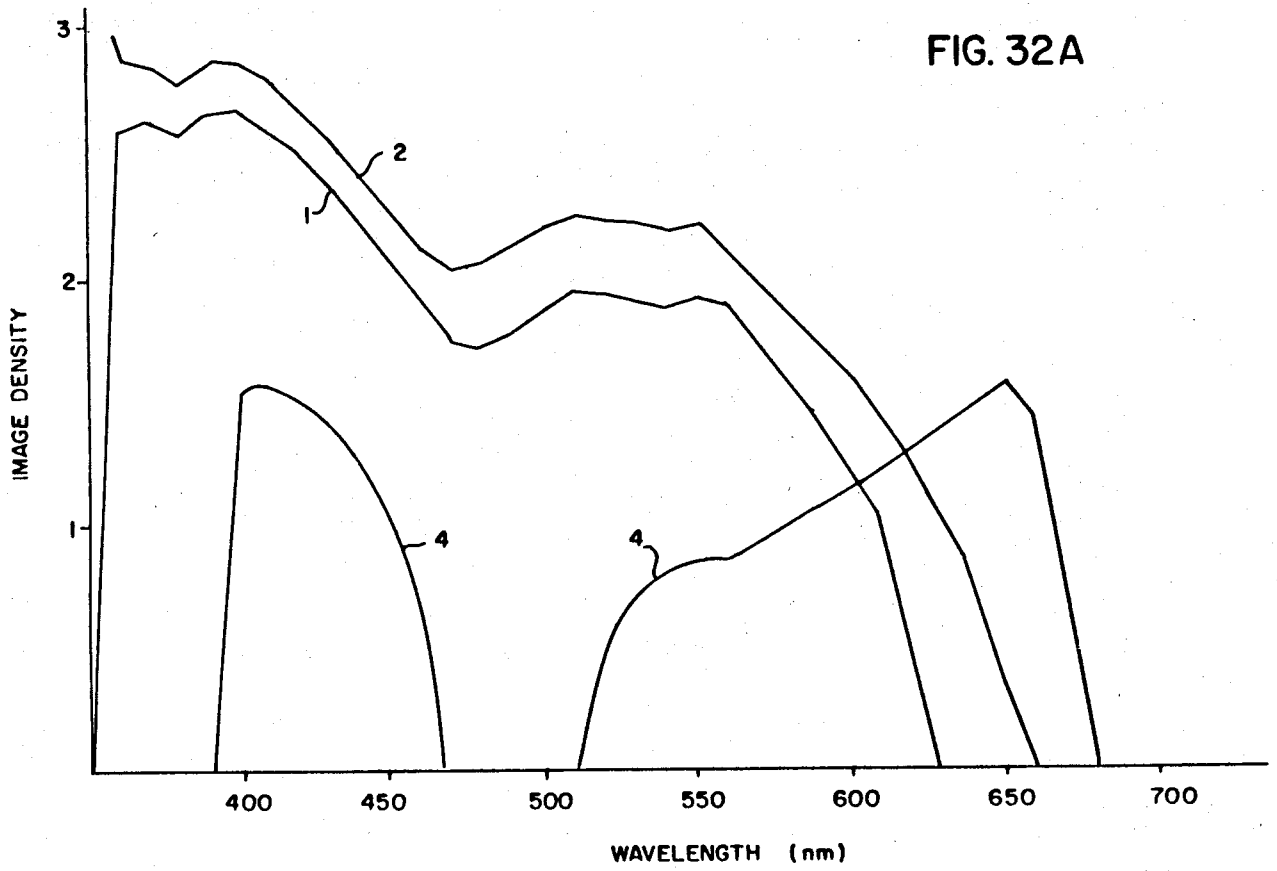
FIGS. 32A and 32B are plots of image density versus wavelength of exposure.

Anhydro-5,5'-dichloro-9-ethyl-3,3'-di(3-sulfopropyl)thiacarbocyanine hydroxide, sodium salt These coatings were exposed to a regulated light source which progressively increased in wavelength in one direction and progressively increased in density in a second direction normal to the first. The coatings were then processed in the Kodak C-41® Color Negative Process (with development for 3 min 15 s at 38° C.) which formed a cyan image showing the spectral response of each coating. This image was scanned by a densitometer, and corrected for variable lamp energy to produce the traces of constant image density shown in FIGS. 32A and 32B. In FIG. 32A the curves 1, 2, and 4 indicate results for the correspondingly numbered coatings, which were not chemically sensitized. Similarly, in FIG. 32B the curves 3, 5, and 6 indicate results for the correspondingly numbered coatings, where were chemically sensitized.

By comparing curves 1 and 2 in FIG. 32A it can be seen that the addition of red sensitizing dye A increased the sensitivity of the emulsion somewhat, but did not function to shift the spectral response of the emulsion. This is because growth modifier Compound 102, which is itself a green spectral sensitizing dye, was already adsorbed to the icositetrahedral grain surfaces. Curve 4 shows the spectral response obtained when the green spectral sensitizing dye, Compound 102, is destroyed as a dye prior to addition of Dye A. As can be seen from curve 4, the emulsion exhibits no measurable sensitivity in the 470 to 510 nm region of the spectrum, but exhibits a marked increase in spectral sensitivity beyond 650 nm. The curves demonstrate that the spectral sensitivity imparted by the growth modifier can be destroyed to allow spectral sensitization of the icositetrahedral emulsions according to the invention to a differing portion of the visible spectrum, if desired.

Figure 32B:
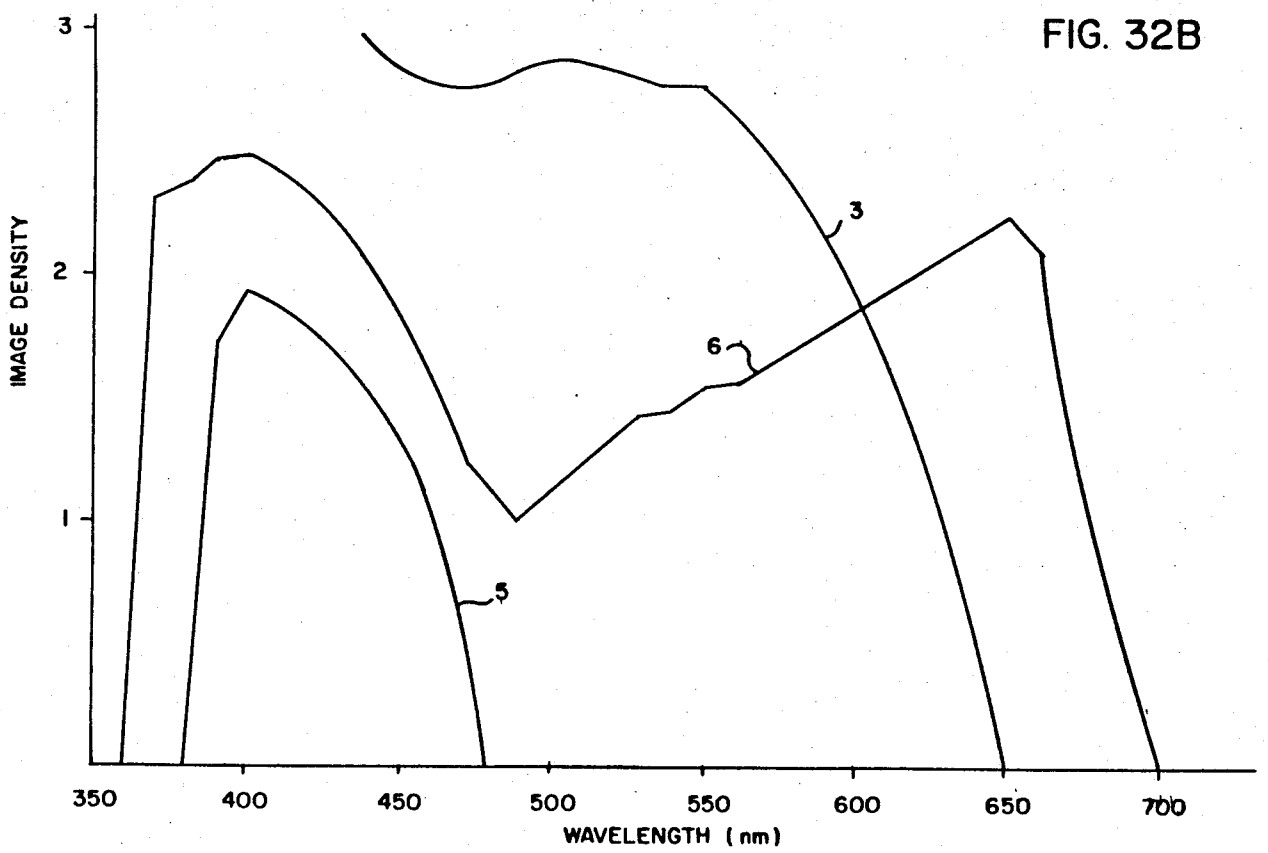

Looking at FIG. 32B, it can be seen from curve 3 that the chemically sensitized icositetrahedral emulsion exhibits measurable sensitivity out to about 650 nm as initially prepared. Sensitivity in the green portion of the spectrum is attributable to the green sensitization provided by the growth modifier, Compound 102. Curve 5 shows the native sensitivity remaining when the spectral sensitization provided by Compound 102 is destroyed by treating the emulsion with bromine water. Curve 6 shows the response obtained when the red spectral sensitizing dye, Dye A, is thereafter added to the emulsion. Cumulatively FIGS. 32A and 32B show the spectral sensitization effects to be achievable independently of chemical sensitization of the emulsions.

EXAMPLE 26

This example illustrates the selective site epitaxial deposition of a silver salt onto icositetrahedral grains of an emulsion satisfying the requirements of this invention.

To a reaction vessel supplied with a stirrer was added 0.4 mole of a 0.7 μm silver bromoiodide (6 mole percent iodide) octahedral emulsion containing ≃8 g bone gelatin/Ag mole. Distilled water was added so that the contents of the kettle weighed 400 g. The emulsion was heated to 40° C., and 6.0 mmoles/Ag mole of 2-methyl-5-nitro-1H-benzimidazole dissolved in 25 ml of methanol was added. The mixture was held for 15 min at 40° C. The pH was adjusted to 6.0 at 60° C. and the pAg adjusted to 8.5 at 60° C. and maintained at these values during the precipitation. A 2.5M solution of $AgNO_3$ was added at a constant rate over a period of 200 min consuming 0.5 moles of Ag. Concurrently, a solution of 4.95M in NaBr and 0.3M in NaI was added at a rate necessary to maintain a constant pAg of 8.5 at 60° C. The resulting emulsion was centrifuged and the solid silver halide phase was resuspended in 200 ml of 3% bone gelatin solution. Carbon replica electron micrographs showed this emulsion to consist of well formed icositetrahedra.

Two epitaxial emulsions were prepared. One was made in the presence of the epitaxial site director, Compound I, the other was not.

Compound I

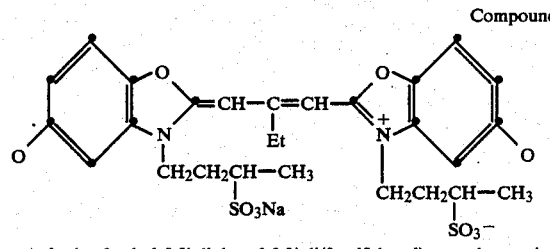

Anhydro-9-ethyl-5,5'-diphenyl-3,3'-di(3-sulfobutyl)oxacarbocyanine hydroxide, monosodium salt To prepare Emulsion A, to a reaction vessel supplied with a stirrer was added 0.05 mole of the above icositetrahedral host emulsion. Distilled water was added to make a total contents weight of 50 g. The contents were heated to 40° C. and 0.92 mmole of NaCl was added. An 0.50M solution of $AgNO_3$ and a 0.52M solution of NaCl was then introduced with a constant silver addition rate over a period of 10 min, consuming 2.5 mmole of silver. During the precipitation, the pAg was held constant at 7.5 and the temperature held constant at 40° C.

To prepare Emulsion B, a similar procedure was followed as in the precipitation of Emulsion A, but with the following exceptions: Before the start of the AgCl precipitation, 0.64 mmole of Compound I (as shown above)/host Ag mole in 2 ml methanol was added.

Both Emulsion A and Emulsion B showed discrete epitaxial deposits. In the case of Emulsion B, which was precipitated in the presence of the site director, the cubic {100} crystal faces on the epitaxy were quite distinct. This example demonstrates that no additional site director, such as Compound I, is essential to achieving selective site epitaxy, but an adsorbed site director can be advantageous in achieving better definition of crystal faces.

EXAMPLE 27

This example illustrates selected site epitaxy on an icositetrahedral host emulsion.

The host emulsion for this example was that employed for Example 25. To a reaction vessel supplied with a stirrer was added 0.05 mole of the host emulsion, 0.52 mmole 1,1'-diethyl-2,2'-cyanine p-toluenesulfonate in 2 ml of methanol and distilled water to make a total weight of contents of 50 g. The contents were heated to 40° C. and 0.92 mmole of NaCl was added. A 0.50M solution of $AgNo_3$ and a 0.52M solution of NaCl were then introduced with a constant silver addition rate over a period of 10 min consuming 2.5 mmoles of silver. During the precipitation, the pAg was held constant at 7.5, and the temperature held constant at 40° C.

A 20,000× carbon replica electron micrograph of the resulting emulsion which has discrete epitaxial growths along the edges joining coigns formed by the intersections of four crystal faces, but no epitaxy along the edges intersecting at coigns formed by the intersections of three crystal faces. Thus, there were three well defined, mutually perpendicular rings of epitaxy around each icositetrahedral grain.

The invention has been described in detail with particular reference to preferred embodiments thereof, but it will be understood that variations and modifications can be effected within the spirit and scope of the invention.

What is claimed is:

1. A silver halide photographic emulsion comprised of radiation sensitive silver halide grains of a cubic crystal lattice structure comprised of icositetrahedral crystal faces.

2. A silver halide photographic emulsion according to claim 1 wherein said silver halide grains comprised of icositetrahedral crystal faces are silver bromide grains.

3. A silver halide photographic emulsion according to claim 1 wherein said silver halide grains comprised of icositetrahedral crystal faces are silver chloride grains.

4. A silver halide photographic emulsion according to claim 1 wherein said silver halide grains comprised of icositetrahedral crystal faces contain at least one of bromide and chloride ions and optionally contain a minor proportion of iodide ions based on total silver.

5. A silver halide photographic emulsion according to claim 1 wherein said silver halide grains are additionally comprised of at least one of cubic and octahedral crystal faces.

6. A silver halide photographic emulsion according to claim 1 wherein said silver halide grains are regular icositetrahedral grains.

7. A silver halide photographic emulsion according to claim 1 wherein a grain growth modifier is adsorbed to said icositetrahedral crystal faces.

8. A silver halide photographic emulsion according to claim 1 wherein said icositetrahedral crystal faces satisfy the Miller index assignment {hll}, wherein h and l are integers greater than zero, h is greater than l, and h is no greater than 5.

9. A silver halide photographic emulsion according to claim 8 wherein said icositetrahedral crystal faces exhibit a {211}, {311}, {322}, {522}, or {533} Miller index.

10. A silver halide photographic emulsion according to claim 9 wherein a grain growth modifier is present in said emulsion chosen from the class consisting of a 4-hydroxy-6-methyl-1,3,3a,7-tetraazaindene, sodium salt; 2-mercaptoimidazole; 4-hydroxy-6-methyl-2-methylmercapto-1,3,3a,7-tetraazaindene; 7-ethoxycarbonyl-6-methyl-2-methylthio-4-oxo-1,3,3a,7-tetraazaindene; 2-methyl-5-nitro-1-H-benzimidazole; 3-ethyl-5-(3-ethyl-2-benzothiazolinylidene)rhodanine; 5-(1,3-dithiolan-2-ylidene)-3-ethylrhodanine; 5-(3-ethyl-2-benzothiazolinylidene)-3-β-sulfoethylrhodanine; 5-anilinomethylene-3-(2-sulfoethyl)rhodanine; 3-(1-carboxyethyl)-5-[(3-ethyl-2-benzoxazolinylidene)ethylidene]rhodanine; 3-(3-carboxypropyl)-5-[(3-ethyl-2-benzoxazolinylidene)ethylidene]rhodanine; 3-(2-carboxyethyl)-5-(1-ethyl-4-pyridinylidene)rhodanine; 3-carboxymethyl-5-(2-pyrrolino-1-cyclopenten-1-ylmethylene)rhodanine, sodium salt; 3-ethyl-5-(3-methyl-2-thiazolidinylidene)rhodanine; 3-carboxymethyl-5-(2,6-dimethyl-4(H)-pyran-4-ylidene)rhodanine; 5-(5-methyl-3-propyl-2-thiazolinylidene)-3-propylrhodanine, and 3-ethyl-5-[3-(3-sulfopropyl)2-benzothiazolinylidene]-rhodanine, triethylamine salt.

11. A photographic element containing an emulsion according to claim 1.

* * * * *